US012319993B2

(12) United States Patent
Valls Anglés

(10) Patent No.: US 12,319,993 B2
(45) Date of Patent: Jun. 3, 2025

(54) LOW COST HIGH PERFORMANT TOOL STEELS

(71) Applicant: ROVALMA, S.A., Rubí (ES)

(72) Inventor: Isaac Valls Anglés, Rubí (ES)

(73) Assignee: ROVALMA, S.A., Rubí (ES)

( * ) Notice: Subject to any disclaimer, the term of this patent is extended or adjusted under 35 U.S.C. 154(b) by 667 days.

(21) Appl. No.: 17/427,847

(22) PCT Filed: Feb. 10, 2020

(86) PCT No.: PCT/EP2020/053347

§ 371 (c)(1),
(2) Date: Aug. 2, 2021

(87) PCT Pub. No.: WO2020/161359

PCT Pub. Date: Aug. 13, 2020

(65) Prior Publication Data

US 2022/0127706 A1 Apr. 28, 2022

(30) Foreign Application Priority Data

Feb. 8, 2019 (ES) ..... ES201930103

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |
| ***C22C 38/54*** | (2006.01) |

(52) U.S. Cl.
CPC ..... *C22C 38/58* (2013.01); *C22C 38/001* (2013.01); *C22C 38/02* (2013.01); *C22C 38/06* (2013.01); *C22C 38/44* (2013.01); *C22C 38/46* (2013.01); *C22C 38/50* (2013.01); *C22C 38/54* (2013.01)

(58) Field of Classification Search
None
See application file for complete search history.

(56) References Cited

U.S. PATENT DOCUMENTS

2010/0221139 A1 9/2010 Beguinot et al.
2016/0024621 A1* 1/2016 Cheney ..... B22F 7/06 420/101

FOREIGN PATENT DOCUMENTS

EP 1 887 096 A1 2/2008
EP 2 154 260 A1 2/2010
(Continued)

OTHER PUBLICATIONS

English language machine translation of RU-2308531-C1. Generated Jan. 11, 2024. (Year: 2024).*
(Continued)

*Primary Examiner* — Brian D Walck
(74) *Attorney, Agent, or Firm* — LADAS & PARRY LLP

(57) ABSTRACT

The present invention relates to very high performant tool steels which can be produced at low cost. The high performance is achieved through an exceptional combination of thermo-mechanical properties attained trough novel alloying and microstructural guidelines. Several of the tool steels of the present invention can be obtained in large cross-section without significant deterioration of the most relevant properties.

17 Claims, 1 Drawing Sheet

(56) References Cited

FOREIGN PATENT DOCUMENTS

| | | | |
|---|---|---|---|
| JP | 2012 251189 | A | 12/2012 |
| JP | 2018 154884 | A | 10/2018 |
| RU | 2308531 | C1 * | 10/2007 |

OTHER PUBLICATIONS

ISR for International Application PCT/EP2020/053347.
Written Opinion for International Application PCT/EP2020/053347.
JP 2018 154884 A _English Translation.
JP 2012 251189 A _English Translation.
EP1887096 A1 _English Translation.

* cited by examiner

LOW COST HIGH PERFORMANT TOOL STEELS

RELATED APPLICATION

This application is an application under 35 U.S.C. 371 of International Application No. PCT/EP2020/053347 filed on 10 Feb. 2020, which claims the benefit of ES P201930103 filed 8 Feb. 2019 the disclosures of which are incorporated in their entirety by reference herein.

FIELD OF THE INVENTION

The present invention relates to steels, in particular tool steels which present a novel combination of an alloying principle and microstructure designed to decrease the manufacturing cost of the tool steel while providing unprecedented performance leading to further reduction of the cost of the components manufactured with the tools build with the tool steels of the present invention. Given the combination of properties and manufacturing cost, the tool steels of the present invention can also be employed for other applications other than tooling.

SUMMARY

Figure 1:
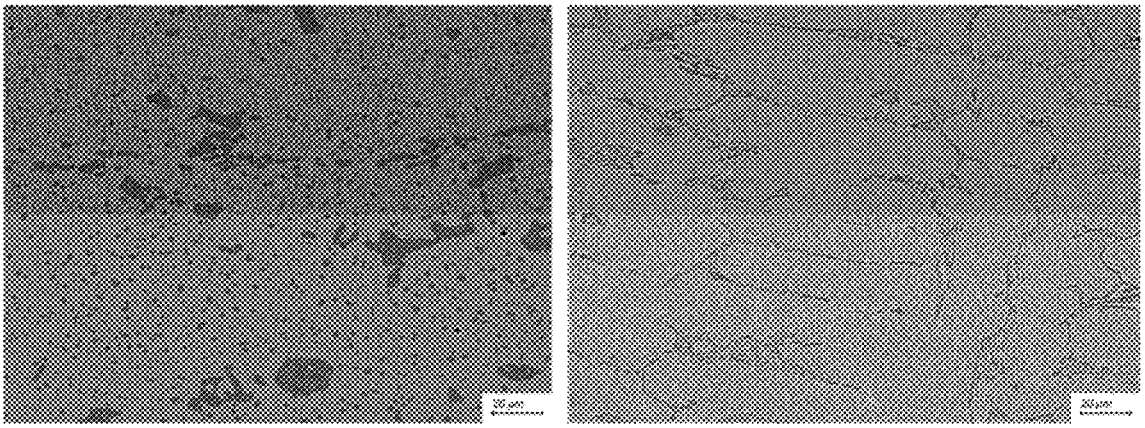
FIG. 1. Microstructure of DIN 1.2379/AISI D2 steel in heat treated state (left) and welded state (right).
Figure 2:
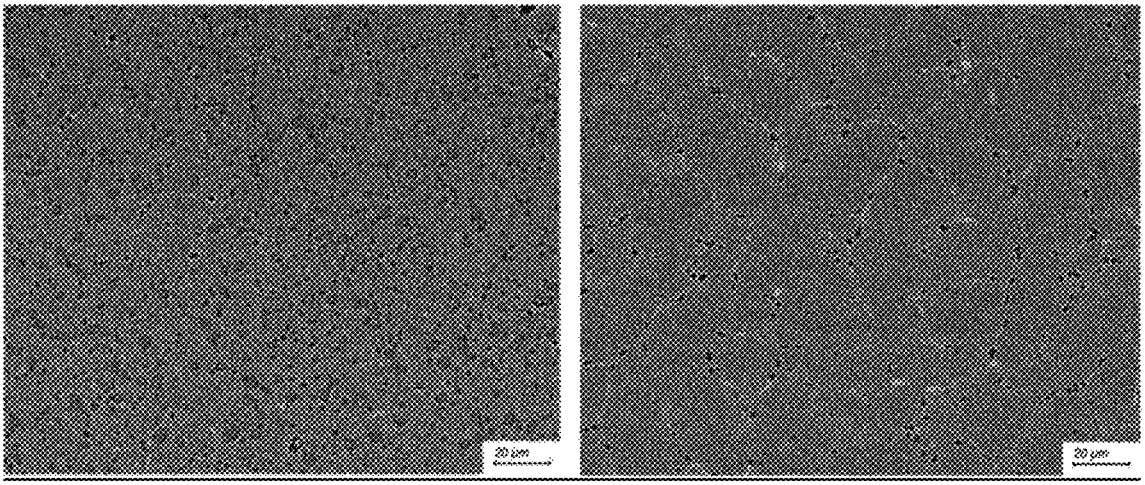
FIG. 2. Microstructure of PM steel in heat treated state (left) and welded state (right).
Figure 3:
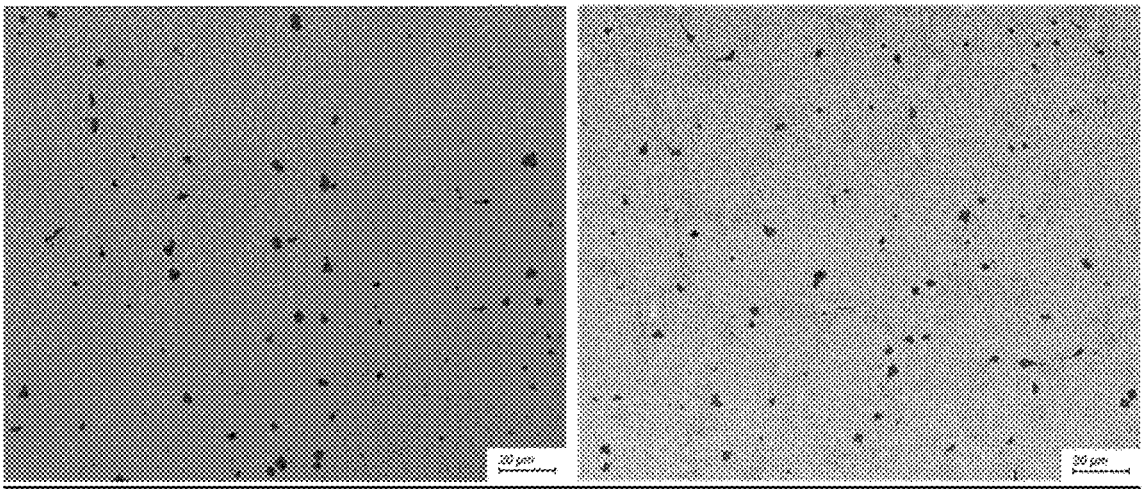
FIG. 3. Microstructure of steel according to the invention in heat treated state (left) and welded state (right).

For many metal shaping industrial applications where high strength sheets or abrasive components are shaped or cut in complex geometries, a combination of high wear resistance, high resistance against cracking (sudden breakage, chipping, . . . ) and high resistance against plastic deformation are required simultaneously in the tooling materials. Traditionally, the wear problem has been solved by providing the tool materials with a sufficient volume fraction of primary carbides. Iron based primary carbides are not very hard, so traditionally cold work tool steels are highly alloyed with carbide forming elements (Chromium, Molybdenum, Vanadium and Tungsten being the most used ones, specially the first three). While Chromium is the most used carbide forming alloying element in tool steels, chromium primary carbide is not very hard and has a tendency to coarsen, which leads to a vicious cycle where it cannot be used in small volume fractions for high wear resistances due to the low hardness and when used in high volume fractions it coarsens leading to a great decrease of the resistance to breakage. This has been traditionally solved by the employment of the other principal carbide formers together with chromium, principally molybdenum and vanadium. Unfortunately, in the last decades the cost associated to alloying with molybdenum and vanadium has increased exponentially. In particular, alloying cost related to alloying with vanadium has increased almost an order of magnitude in the last decade. Also, the traditional way to increase the volume fraction of primary carbides while not allowing them to coarsen is through the powder-metallurgical (PM) route, which provides exceptional mechanical property combinations but has also a very high associated cost.

For many metal shaping industrial applications where there is a heat extraction from the manufactured product, thermal conductivity is of extreme importance; when this heat extraction is discontinuous, it becomes crucial. Thermal conductivity is related to fundamental material properties like the bulk density, specific heat and thermal diffusivity. Traditionally for tool steels, this property has been considered opposed to hardness and wear resistance since the only way to improve it was by means of decreasing alloying content. During many hot work applications, like plastic injection, hot stamping, forging, extrusion, metal injection, light alloy casting and composite curing among many others, extremely high thermal conductivity is often simultaneously required with wear resistance, strength and toughness. For many of these applications, big cross-section tools are required, for which high hardenability of the material is also necessary.

Until the moment, it was believed that high toughness levels were just attainable for low levels of hardness, the same applying for thermal conductivity, decreasing other properties like wear resistance. Moreover, for dies which afterward will need to undergo a surface hardening treatment, like for example nitriding or surface coating, it is normally necessary that substrate base material has enough hardness in order to support the coating, and again hardness should not decrease when exposing the material to the coating/surface treatment required application temperature.

For some other applications like most of plastic injection for the automotive industry, thick tools are used, especially when sufficient strength is required as for to require a thermal treatment. In this case, it is also often convenient to have a good hardenabilty to be able to achieve the desired hardness level on surface and, preferably, all the way to the core. Hardenability is inherent of each material and is given by the time available to go from a high temperature, normally above austenization temperature, to low temperatures, normally below martensitic start transformation without entering in any stable phase region like ferrite-pearlite zone and/or the bainitic zone. It is well known that pure martensitic structures present higher toughness values once tempered than mixed microstructures with stable phases. For that, the use of severe quenching mediums is needed in order to go from temperatures typically above 700° C. down to temperatures typically below 200° C. (in this document if no otherwise indicated, degrees are ° C.). For this reason, on the other hand, such treatments are very costly. The alloying elements required to achieve such hardenability also increase the cost of the tool steel and often have a negative effect in either toughness or thermal conductivity.

There are many other desirable properties, if not necessary, for tool steels that do not necessarily influence the longevity of the tool, but their production costs, like: ease of machining, capability to be polished, capability of being welded or repaired in general, support provided to the coating, costs . . . . Steels of the present invention present some clear advantages in some of these properties while not presenting significant disadvantages in any.

The inventor has discovered that the problem to simultaneously obtain very high performance in tool steels while reducing the manufacturing cost can be attained through the simultaneously application of a smart alloying principle and microstructure optimization.

For cold work applications, low cost tool steels with excellent relevant property compromise like the one provided by powder-metallurgical steels or even combinations of properties equaling or exceeding the wear resistance of powder-metallurgical tool steels while approaching or even surpassing the breakage resistance of matrix steels can be attained at a fraction of the manufacturing cost of PM steels.

For hot work and plastic injection molding applications: thermal conductivity, wear resistance, easy machinability and uniformity of properties, together with good levels of toughness at low cost, can be attained simultaneously with improved polish-ability and weldabliity amongst others. Some of the selection rules of the alloying principles within the range and thermo-mechanical treatments required to obtain the microstructure described in the present invention and also the levels of thermal conductivity indicated in the present invention are presented in the detailed description of the invention section. Obviously, a detailed description of all possible combinations is out of reach. The thermal diffusivity is regulated by the mobility of the heat energy carriers, which unfortunately cannot be correlated to a singular compositional range and a thermo-mechanical treatment. In fact, the thermal diffusivity is the best macroscopic property to measure the attaining of the correct microstructure at the atomic-placement level described in the present invention.

A specific thermal diffusivity value cannot be derived from a steel composition; actually thermal diffusivity is a parameter describing a structural feature in the sub-nanometric scale (atomic arrangement, regarding the optimization of density of states and mobility of carriers in all phases). When writing the application, the applicant referring to the Guidelines C-II, 4.11 (nowadays Guidelines 2012, Part F, Chapter IV, point 4.11, "Parameters") realized that almost all parameters (available) to describe this structural feature in the sub-nanometric scale are unusual parameters and that would be prima facie objectionable on grounds of lack of clarity. The sole exception for unequivocally describe mentioned structural feature in the sub-nanometric scale is thermal diffusivity and therefore this parameter is chosen to reasonably describe the structural feature.

In the meaning of this document, the values of thermal diffusivity refer to measures at room temperature, otherwise indicated. In the meaning of this document, room temperature refers to 23° C., unless context clearly indicates otherwise. In an embodiment, the thermal diffusivity is measured at room temperature by means of the Flash Method. In an embodiment, the thermal diffusivity is measured at room temperature according to ASTM-E1461-13. In an embodiment, the thermal diffusivity can alternatively be measured at room temperature according to ASTM-E2585-09(2015).

STATE OF THE ART

AISI D2 (or the closely related SKD-61 in Asia and 1.2379 in Europe), have managed to become the reference cold work tool steels worldwide. In recent years, the colloquially called 8% Cr steels (like 1.2965 or other cold work tool steels with 7 to 8.5% by weight % Cr with % V anywhere between 1 and 3.5% by weight, % C between 0.7 and 1.3 by weight and other alloying elements like % Si, % Mn, % Mo, % W, . . . ) have managed to substitute some of the AISI D2 for applications requiring high wear resistance or a better compressive yield/resilience compromise. For applications requiring higher toughness, the so-called matrix steels, with little or even absence of primary carbides, have also found a place in the market despite their lower wear resistance which sometimes is somewhat minimized by applying superficial hardening or carburizing in the wear prone areas. Typical examples of matrix steels are AISI A8, W.Nr. −1.2358). Finally, for the most demanding applications powder-metallurgical tool steels are employed, which present a very good combination of resistance against plastic deformation, resilience and wear resistance, specially against galling or adhesive wear, they also provide good support to coatings but unfortunately, they are even much costlier to produce that the other two.

Until the development of high thermal conductivity tool steels (EP1887096A1), the only known way to increase thermal conductivity of a tool steel was keeping its alloying content low and consequently, showing poor mechanical properties, especially at high temperatures. Tool steels capable of surpassing 42 HRc after a tempering cycle at 600 or more, were considered to be limited to a thermal conductivity of 30 W/mK and a structure at the atomic level (atomic arrangement) prescribed in the present invention whose implementation can be monitored by a thermal diffusivity value greater than of 8 $mm^2/s$ and 6.5 $mm^2/s$ for hardness above 42 HRc and 52 HRc respectively.

DETAILED DESCRIPTION OF THE INVENTION

The inventor has discovered that the problem of having simultaneously very high performant tool steel with low manufacturing cost can be solved with a steel with the features of claim 1. Inventive uses and preferred embodiments follow from the other claims. Some further inventive features and preferred embodiments can be encountered in the text, since they have not been incorporated in the claims at this time.

This invention is the result of several years of investigations trying to reduce the alloying cost of tool steels while improving the performance for certain applications. The compositional rules and guidelines to be followed and microstructures to be favored have been determined for several tooling applications when using less expensive alloying elements or at least replacing some of the most expensive alloying elements.

Two main important discoveries have been made regarding the carbides in the tool steels. On the one hand, it has been found that for several of the applications of interest in the present invention size of the carbides plays an important role, as was to be expected, but very surprisingly the desirable tendency is exactly the opposite one when considering primary or secondary carbides. Traditionally, the size of carbides has been considered inversely proportional to toughness related properties. The literature reports, that vanadium and chromium-vanadium alloyed secondary carbides can be obtained with very small size and therefore such kind of carbides have been used for most hot work tool steels. Literature also reports that smaller primary carbides have a more negative effect on toughness related properties, but in more recent publications, size has been rated as second rank to other properties, like coherence (or adhesion of the carbide to the matrix) and even fracture toughness of the carbide. Therefore, almost all cold work tool steels with primary carbides, employ carbides with good adhesion to the matrix, and in last years with high fracture toughness despite their tendency to coarsen and thus presenting large sizes when large cross sections are involved. In the studies made by the inventor leading to the present invention, it was found that for several applications of the present invention, in primary carbides size is of first rank importance and thus measures have to be taken to assure primary carbides do not tend to coarsen, even if some fracture toughness of the carbide or coherence to the matrix is sacrificed and even more surprising, coarse secondary carbides are preferable. This has a limit since excessively coarse secondary carbides are also not desirable. Many other relevant observations were made by the inventor in these studies preceding the present invention, some of which will be further analyzed in the following paragraphs. The observations described in this paragraph, lead to some alloying rules for the steels of the present invention. To have the right size of secondary carbides, at least a certain amount of molybdenum-like alloying elements have to be employed, even if this results in an increase of the alloying price. To provide good guidelines in this aspect the concept of equivalent molybdenum (% $Mo_{eq}$=% Mo+½*% W) can be of help for several of the applications. In this invention when not otherwise indicated, the alloying element fractions refer to weight fractions and the carbide content fractions refer to volume fractions. Besides the required presence of % $Mo_{eq}$ some further alloying guidelines derive from this first observations. For applications where primary carbides are not desirable or necessary, a bainite containing microstructure is desirable which should contain % Mn and/or % Ni but not too much % Si, extremely low contents of % P are preferred and boron can be present in small amounts or even larger amounts but then together with % Zr or another equivalent boride former. For applications where primary carbides are desirable or necessary, a martensite containing microstructure is desirable which can contain higher levels of % Si, and % Ti primary carbides should be prioritized, often (but not always) complex % Ti carbides which also contain shape modifying addition like % Nb. As is to be expected, also in this document when a characteristic, guideline, rule or any other is described as something which is desirable, often used, several times occurring or something of the like, the meaning is the literal one, so while it might be indicating an important part of the invention, it is not one that is mandatory for the whole scope of the invention although it might be mandatory for a reduced scope of the invention like some certain applications but not the whole invention—in the event of reducing the scope of the invention, then they can become mandatory for the remaining scope—. Clearly differentiated from other instances where a characteristic, guideline, rule or any other is described as mandatory for the whole scope of the invention where it is implied that that particular characteristic is not only very important or capital to the invention but also obligatory for the whole scope.

The inventor has found that the problem of obtaining high performant low cost tool steels can be solved with the guidelines provided in the following paragraphs.

In this document, when not otherwise indicated, equivalent carbon (% $C_{eq}$) is defined as follows:

% Ceq=% C+0.8*% N+1.2*% B.

In this document, when not otherwise indicated, equivalent molybdenum (% $Mo_{eq}$) is defined as follows:

% $Mo_{eq}$=% Mo+½*% W.

This is because in many instances of the present invention % Mo can be replaced partially or completely with % W obtaining the same technical effect. Alloying with % W is currently considerably more expensive and thus less desirable, therefore in some applications it will be preferred to not have any intentional addition of % W. On the other hand, % W tends to promote harder carbides and therefore some instances where wear resistances is one of the top priorities might benefit from the usage of % W. When it comes to % C, in some instances of the present invention it is desirable to alter the shape of the hard particles, and it has been found by the inventor that often the partial replacement of % C with % B and/or % N is advantageous. Moreover, in some applications the partial replacement of % C with % B and/or % N changes the friction coefficient and the wear behavior, which can be capitalized for better performance. This raises a language issue since replacing some of the % C with % B and/or % N more often than not leads to the hard particles becoming mixtures of carbides, borides and/or nitrides sometimes pure and sometimes as mixtures (carbo-borides, carbo-boro-nitrides, carbo-nitrides, boro-nitrides), but for the sake of simplicity in this document when not otherwise indicated the terms: carbides, primary carbides, secondary carbides (also in singular and any other variation) refer to the hard particles present which often are not pure carbides (for example in a steel of the present invention with significant % B present, the steel might have primary carbo-borides which will be referred as primary carbides). That does not apply to the terms borides and nitrides.

An implementation of the present invention can be made through providing a steel, in particular a tool steel, having the following composition, all percentages being in percentage by weight % wt):

| | | | |
|---|---|---|---|
| % $C_{eq}$ = 0.15-1.9 | % C = 0.15-1.9 | % N = 0-0.49 | % B = 0-1.9 |
| % Cr = 0-14 | % Ni = 0-4.9 | % Si = 0-1.9 | % Mn = 0-2.8 |
| % Al = 0-0.9 | % Mo = 0-5.9 | % W = 0-4.9 | % Ti = 0-4.9 |
| % Ta = 0-0.4 | % Zr = 0-0.9 | % Hf = 0-0.3 | % V = 0-3.9 |
| % Nb = 0-1.4 | % Cu = 0-1.9 | % Co = 0-2.9 | % $Mo_{eq}$ = 0.26-5.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Pm = 0-0.3 | % Eu = 0-0.3 | % Tb = 0-0.3 | % Dy = 0-0.3 |
| % Ho = 0-0.3 | % Er = 0-0.3 | % Tm = 0-0.3 | % Yb = 0-0.3 |
| % Lu = 0-0.3 | % Cs = 0-0.3 | | |

The rest consisting of iron and trace elements, wherein

% Ceq=% C+0.86*% N+1.2*% B, and

% $Mo_{eq}$=% Mo+½*% W.

Trace elements refers to several elements, unless context clearly indicates otherwise, including but not limited to, H, He, Xe, F, Ne, Na, P, S, Cl, Ar, K, Br, Kr, Sr, Tc, Ru, Rh, Pd, Ag, I, Ba, Re, Os, Ir, Pt, Au, Hg, Tl, Po, At, Rn, Fr, Ra, Ac, Pa, U, Np, Pu, Am, Cm, Bk, Cf, Es, Fm, Md, No, Lr, Rf, db, Sg, Bh, Hs, O, Li, Be, Mg, Ca, Rb, Zn, Cd, Ga, In, Ge, Sn, Pb, Bi, Sb, As, Se, Te, Th, Ds, Rg, Cn, Nh, Fl, Mc, Lv, Ts, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments the sum of all trace elements in the steel is below 2.0% by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% $C_{eq}$). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % $C_{eq}$ should not be too high. In different embodiments, % $C_{eq}$ is 1.69% by weight or less, 1.49% by weight or less, 0.98% by weight or less, 0.59% by weight or less, 0.55% by weight or less, 0.48% by weight or less and even 0.44% by weight or less. Some applications, like sometimes applications requiring a rather good polishing ability in the tool steel or good weldability it is often interesting to keep even lower levels of % $C_{eq}$. In different embodiments, % $C_{eq}$ is 0.39% by weight or less, 0.34% by weight or less, 0.29% by weight or less and even 0.19% by weight or less. In contrast, in some applications higher contents of % $C_{eq}$ are preferred. In different embodiments, % $C_{eq}$ is 0.17% by weight or more, above 0.21% by weight, above 0.32% by weight, above 0.43% and even above 0.71% by weight. For some applications, if abundant primary carbides are desirable, then the % $C_{eq}$ content should be higher. In different embodiments, % $C_{eq}$ is 0.81% by weight or more, 0.91% by weight or more, 1.01% by weight or more, 1.12% by weight or more and even 1.26% by weight or more.

Different applications require different levels of carbon (% C). For some applications, % C should not be too high. In different embodiments, % C is 1.67% by weight or less, 1.49% by weight or less, 0.94% by weight or less, 0.59% by weight or less, 0.53% by weight or less, 0.51% by weight or less, 0.42% by weight or less and even 0.39% by weight or less. Some applications, like sometimes applications requiring a rather good polishing ability in the tool steel or good weldability it is often interesting to keep even lower levels of % C. In different embodiments, % C is 0.34% by weight or less, 0.31% by weight or less, 0.24% by weight or less and even 0.16% by weight or less. In contrast in some applications higher contents of % C are preferred. In different embodiments, % C is above 0.16% by weight, above 0.23% by weight, above 0.31% by weight, above 0.58% by weight and even above 0.66% by weight. For some applications, if abundant primary carbides are desirable, then the % C content should be higher, in different embodiments, % C is 0.91% by weight or more, 1.01% by weight or more, 1.11% by weight or more, 1.22% by weight or more and even 1.36% by weight or more.

It has been found that for some applications the presence of nitrogen (% N) is desirable while yet for other applications it is rather an impurity. In different embodiments, % N is 0.002% by weight or higher, 0.01% by weight or higher and even 0.12% by weight or higher. In contrast, in some applications an excessively high content of % N is rather detrimental. In different embodiments, % N is 0.3% by weight or less, less than 0.26% by weight, less than 0.18% by weight, less than 0.09% by weight, less than 0.009% by weight, less than 0.0059% by weight, less than 0.0019% by weight, and even less than 0.00095% by weight. Obviously, there are cases where the desired nominal content is 0% by weight or nominal absence of the element as occurs with all optional elements for certain applications.

It has surprisingly been found that for some applications, a strict control on the level of % N leads to a marked improvement of the mechanical properties increasing both strength and toughness related properties. In an embodiment, % N is between 2 ppm and 190 ppm by weight. In different embodiments, the lower limit for the controlled % N content is 11 ppm by weight, 16 ppm by weight, 21 ppm by weight, 32 ppm by weight, 140 ppm by weight and even 98 ppm by weight. In different embodiments, the upper limit for the controlled % N content is 68 ppm by weight, 48 ppm by weight and even 33 ppm by weight. In an embodiment, the upper limit for the controlled % N content is 19 ppm by weight. In an embodiment, % N refers to total % N present. In an embodiment, % N refers only to free nitrogen. In an embodiment, % N refers to the nitrogen in solid solution at room temperature. In an embodiment, % N refers to the maximum nitrogen in solid solution during austenitization. In an embodiment, very special care is taken during the degassing of the material to assure the specially low % N levels specified in some of the embodiments in this application. In an embodiment, vacuum degassing is applied to the melt. In an embodiment, the vacuum degassing is performed with a vacuum level reaching $9*10^{-2}$ mbars at some point in the vacuum degassing process. In another embodiment, the vacuum degassing is performed with a vacuum level reaching $9*10^{-3}$ mbars at some point in the vacuum degassing process. In another embodiment, the vacuum degassing is performed with a vacuum level reaching $9*10^{-4}$ mbars at some point in the vacuum degassing process. In an embodiment, the melt is vacuum degassed during 31 minutes or more. In another embodiment, the melt is vacuum degassed during 46 minutes or more. In an embodiment, the melt is vacuum degassed during 61 minutes or more. In another embodiment, the melt is vacuum degassed during 91 minutes or more. In another embodiment, the melt is vacuum degassed during 121 minutes or more. This special care in keeping a low % N would be considered madness for such kind of alloys which normally address a very price sensitive market, but the inventor has found with great surprise that this extra cost can be compensated by the increase in properties.

In some applications it has been found that some alloying elements, affect the quantity of desirable % N, to better describe this effect, the concept of an equivalent nitrogen (% Neq) will be introduced:

$$\%\ Neq = \%\ N - \%\ Ti/3.4 - (\%\ Zr + \%\ Nb)/6.5 - (\%\ Hf + \%\ Ta)/12.7 - (\%\ AC + \%\ LA)/11.$$

Where % AC refers to the sum of actinides (% Ac+% Ti+% Pa+% U+% Np+% Pu+% Am+% Cm+% Bk+% Cf+% Es+% Fm+% Md+% No+% Lr).

And where % LA refers to the sum of lanthanides (% La+% Ce+% Pr+% Nd+% Pm+% Sm+% Eu+% Gd+% Tb+% Dy+% Ho+% Er+% Tm+% Yb+% Lu).

In an embodiment, % Neq is between 0.2 ppm and 140 ppm by weight. In different embodiments the lower limit for the controlled % Neq content is 1.2 ppm by weight, 6 ppm by weight, 11 ppm by weight and even 22 ppm by weight. In different embodiments, the upper limit for the controlled % Neq content is 89 ppm by weight, 78 ppm by weight, 58 ppm by weight, 48 ppm by weight and even 28 ppm by weight. In another embodiment, the upper limit for the controlled % Neq content is 19 ppm by weight. In another embodiment, the upper limit for the controlled % Neq content is 9 ppm by weight.

In some applications it has been found that the % Neq has a combined effect with % Mn, % Ni and in some cases % Si. For such applications and to make understanding easier, the NMN parameter has been developed, where:

$$NMN=\%\ Mn+1.7*\%\ Ni-20^{\circ}\ \%\ Neq$$

In an embodiment, NMN is between 0.125 and 1.8. In different embodiments, the upper limit for the controlled NMN parameter is 1.4. In different embodiments, the upper limit for the controlled NMN parameter is 0.94, 0.74, 0.68 and even 0.49. In different embodiments, the lower Emit for the controlled NMN parameter is 0.22, 0.32, 0.41 and even 0.52. In an embodiment, when NMN is 0.34 or larger, then % Si has to be 0.28% by weight or lower. In an embodiment, when NMN is 0.44 or larger, then % Si has to be 0.18% by weight or lower. In an embodiment, when NMN is 0.51 or larger, then % Si has to be 0.14% by weight or lower. In an embodiment, when NMN is 0.54 or larger, then % Si has to be 0.09% by weight or lower.

It has been found that for some applications the presence of boron (% B) is desirable while yet for other applications it is rather an impurity. In different embodiments, % B is above 1 ppm by weight, above 11 ppm by weight, above 21 ppm by weight, above 26 ppm by weight, above 31 ppm by weight, above 32 ppm by weight, above 41 ppm by weight, above 42 ppm by weight, above 0.002% by weight, and even above 0.0032% by weight. In some applications if primary borides or carbo-nitro borides are desirable, then the % B content should be higher, in different embodiments, % B is 0.01% by weight or higher, 0.02% by weight or higher, 0.04% by weight or higher, 0.1% by weight or higher, 0.26% by weight or higher and even 0.36% by weight or higher. In contrast, in some applications an excessively high content of % B is rather detrimental. In different embodiments, % B is 0.49% by weight or less, less than 0.49% by weight, less than 0.26% by weight, less than 0.2% by weight, less than 0.18% by weight, less than 0.09% by weight, less than 0.035% by weight, less than 0.009% by weight, less than 0.0058% by weight, less than 0.002% by weight and even less than 0.0004% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is above 0.001% by weight, above 0.04% by weight, above 0.11% by weight, above 0.21% by weight, above 0.31% by weight and even above 0.41% by weight. In contrast, in some applications an excessively high content of % Nb is rather detrimental. In different embodiments, % Nb is less than 0.9% by weight, less than 0.49% by weight, less than 0.39% by weight, less than 029% by weight and even less than 0.19% by weight. Obviously, there are cases where the desired nominal content is 0% by weight or nominal absence of the element as occurs with all optional elements for certain applications.

It has been found that for some applications the presence of chromium (% Cr) is desirable while yet for other applications it is rather an impurity. For example in some systems % Cr increases the concentration of atomic placement defects on carbides, when properly manufactured. This can be an advantage in some applications and a disadvantage in others. In different embodiments, % Cr is 0.001% by weight or higher, 0.01% by weight or higher, 0.12% by weight or higher, 0.63% by weight or higher, 1.1% by weight or higher, 1.6% by weight or higher, 2.1% by weight or higher, 2.3% by weight or higher, 3.1% by weight or higher, and even 4.6% by weight or higher. For some applications higher levels are preferred. In different embodiments, % Cr is above 6.1% by weight, above 7.1% by weight, above 8.1% by weight and even above 10.1% by weight. In contrast, in some applications an excessively high content of % Cr is rather detrimental. In different embodiments, % Cr is less than 12.8% by weight, less than 9.6% by weight, less than 8.4% by weight, less than 5.9% by weight, less than 3.8% by weight, less than 2.3% by weight, 1.9% by weight or less, less than 1.4% by weight, less than 0.9% by weight, less than 0.12% by weight, less than 0.06% by weight and even less than 0.02% by weight. Obviously, there are cases where the desired nominal content is 0% by weight or nominal absence of the element as occurs with all optional elements for certain applications.

It has been found that for some applications the presence of nickel (% N) is desirable while yet for other applications it is rather an impurity. For example % Ni can increase toughness but also decrease it depending on final microstructure. It has been found that % Ni sometimes affects both the ferritic and bainitic hardenability but in a different way depending on concentration of other elements and processing. In different embodiments, % Ni is 0.001% by weight or higher, 0.01% by weight or higher, 0.12% by weight or higher, 0.58% by weight or higher, 0.69% by weight or higher, 1.19% by weight or higher, 1.64% by weight or higher, 2.1% by weight or higher and even 2.6% by weight or higher. In contrast, in some applications an excessively high content of % Ni is rather detrimental. In different embodiments, % Ni is less than 3.8% by weight, less than 2.9% by weight, less than 2.3% by weight, less than 1.8% by weight, less than 1.4% by weight, less than 0.9% by weight, and even less than 0.46% by weight. Obviously, there are cases where the desired nominal content is 0% by weight or nominal absence of the element as occurs with all optional elements for certain applications.

It has been found that for some applications the presence of silicon (% Si) is desirable while yet for other applications it is rather an impurity. In different embodiments, % Si is 0.001% by weight or higher, 0.02% by weight or higher, 0.16% by weight or higher, 0.52% by weight or higher, 0.61% by weight or higher, and even 0.92% by weight or higher. In contrast, in some applications an excessively high content of % Si is rather detrimental. In different embodiments, % Si is less than 1.4% by weight, less than 0.86% by weight, less than 0.49% by weight, and even less than 0.46% by weight. For some applications lower levels are preferred. In different embodiments, % Si is less than 0.44% by weight, less than 0.28% by weight, less than 0.14% by weight, less than 0.09% by weight and even less than 0.04% by weight. Obviously, there are cases where the desired nominal content is 0% by weight or nominal absence of the element as occurs with all optional elements for certain applications.

It has been found that for some applications the presence of manganese (% Mn) is desirable while yet for other applications it is rather an impurity. For example % Mn can increase toughness but also decrease it depending on final microstructure. It has been found that % Mn sometimes affects both the ferritic and bainitic hardenability but in a different way depending on concentration of other elements and processing. In some applications it has surprisingly found that % Mn strongly affects the toughness in a positive way for microstructures containing balnite and pro-eutectoid carbides. In different embodiments, % Mn is 0.001% by weight or higher, 0.03% by weight or higher, 0.23% by weight or higher, 0.64% by weight or higher, 0.88% by weight or higher, and even 1.16% by weight or higher. In contrast, in some applications an excessively high content of % Mn is rather detrimental. In different embodiments, % Mn is less than 2.4% by weight, less than 1.9% by weight, less than 1.4% by weight, and even less than 0.8% by weight. Obviously, there are cases where the desired nominal content is 0% by weight or nominal absence of the element as occurs with all optional elements for certain applications.

It has been found that for some applications the presence of molybdenum (% Mo) is desirable while yet for other applications should be limited. In different embodiments, % Mo is 0.002% by weight or higher, 0.01% by weight or higher, 0.38% by weight or higher, 0.59% by weight or higher, 0.63% by weight or higher, 0.84% by weight or higher, 1.16% by weight or higher, 1.71% by weight or higher, 1.92% by weight or higher, and even 2.2% by weight or higher. In contrast, in some applications an excessively high content of % Mo is rather detrimental. In different embodiments, % Mo is less than 5.3% by weight, less than 4.4% by weight, 3.9% by weight or less, less than 3.9% by weight, less than 3.4% by weight, less than 2.9% by weight, less than 2.6% by weight, less than 2.4% by weight, less than 2.3% by weight, less than 1.8% by weight, less than 1.4% by weight, less than 0.7% by weight, and even less than 0.4% by weight. Obviously, there are cases where the desired nominal content is 0% by weight or nominal absence of the element as occurs with all optional elements for certain applications.

It has been found that in some applications the steels benefit from having a higher content of equivalent molybdenum (% $Mo_{eq}$, being % $Mo_{eq}$=% Mo+½*% W). In different embodiments, % $Mo_{eq}$ is 0.51% by weight or higher, 0.6% by weight or higher, 0.79% by weight or higher, 1.04% by weight or higher, 1.36% by weight or higher, 1.91% by weight or higher, 2.12% by weight or higher, and even 2.4% by weight or higher. In contrast, in some applications an excessively high content of % Mop is rather detrimental. In different embodiments, % $Mo_{eq}$ is less than 4.9% by weight, less than 4.2% by weight, 3.9% by weight or less, less than 3.9% by weight, less than 3.7% by weight, less than 3.2% by weight, less than 2.9% by weight, less than 2.4% by weight, less than 2.2% by weight, less than 2.1% by weight, less than 1.6% by weight, less than 1.4% by weight, less than 1.2% by weight, less than 1.19% by weight, less than 1.14% by weight, less than 0.46% by weight, and even less than 0.2% by weight.

It has been found that for some applications the presence of tungsten (% W) is desirable while yet for other applications it is rather an impurity. In different embodiments, % W is 0.003% by weight or higher, 0.02% by weight or higher, 0.22% by weight or higher, 0.61% by weight or higher, 0.89% by weight or higher, 1.14% by weight or higher, and even 1.62% by weight or higher. In contrast, in some applications an excessively high content of % W is rather detrimental. In different embodiments, % W is less than 3.9% by weight, less than 2.9% by weight, less than 2.8% by weight, less than 2.4% by weight, less than 1.9% by weight, less than 1.3% by weight, less than 0.8% by weight, and even less than 0.41% by weight. Obviously, there are cases where the desired nominal content is 0% by weight or nominal absence of the element as occurs with all optional elements for certain applications.

It has been found that for some applications the presence of titanium (% Ti) is desirable while yet for other applications it is rather an impurity. In different embodiments, % Ti is 0.001% by weight or higher, 0.03% by weight or higher, 0.16% by weight or higher, 0.59% by weight or higher, 0.83% by weight or higher, 1.12% by weight or higher, and even 1.58% by weight or higher. In contrast, in some applications an excessively high content of % Ti is rather detrimental. In different embodiments, % Ti is less than 4.1% by weight, less than 3.2% by weight, less than 2.6% by weight, less than 2.1% by weight, less than 1.9% by weight, less than 1.6% by weight, less than 0.9% by weight, less than 0.82% by weight, and even less than 0.42% by weight. Obviously, there are cases where the desired nominal content is 0% by weight or nominal absence of the element as occurs with all optional elements for certain applications.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.12% by weight or higher, 0.26% by weight or higher, and even 0.56% by weight or higher. In contrast, in some applications an excessively high content of % Zr is rather detrimental. In different embodiments, % Zr is less than 0.83% by weight, less than 0.7% by weight, less than 0.62% by weight, less than 0.43% by weight, less than 0.29% by weight, less than 0.16% by weight, less than 0.02% by weight, and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.01% by weight or higher, 0.18% by weight or higher, 0.42% by weight or higher, 0.62% by weight or higher, and even 0.81% by weight or higher. In contrast, in some applications an excessively high content of % Co is rather detrimental. In different embodiments, % Co is less than 2.6% by weight, less than 2% by weight, less than 1.3% by weight, less than 0.8% by weight, less than 0.4% by weight, and even less than 0.12% by weight. Obviously, there are cases where the desired nominal content is 0% by weight or nominal absence of the element as occurs with all optional elements for certain applications.

It has been found that for some applications the presence of vanadium (% V) is desirable while yet for other applications it is rather an impurity. In different embodiments, % V is 0.002% by weight or higher, 0.007% by weight or higher, 0.01% by weight or higher, 0.02% by weight or higher, 0.21% by weight or higher, 0.32% by weight or higher, and even 0.66% by weight or higher. In contrast, in some applications an excessively high content of % V is rather detrimental. In different embodiments, % V is 1.4% by weight or less, less than 1.4% by weight, less than 0.8% by weight, less than 0.4% by weight, less than 0.34% by weight, less than 0.08% by weight, less than 0.02% by weight, and even less than 0.001% by weight. Obviously, there are cases where the desired nominal content is 0% by weight or nominal absence of the element as occurs with all optional elements for certain applications.

It has been found that for some applications the presence of copper (% Cu) is desirable while yet for other applications it is rather an impurity. In different embodiments, % Cu is 0.0001% by weight or higher, 0.003% by weight or higher, 0.02% by weight or higher, 0.04% by weight or higher, 0.12% by weight or higher, 0.36% by weight or higher, and even 0.73% by weight or higher. In contrast, in some applications an excessively high content of % Cu is rather detrimental. In different embodiments, % Cu is less than 1.4% by weight, less than 12% by weight, less than 0.6% by weight, less than 0.28% by weight, less than 0.01% by weight, less than 0.002% by weight, and even less than 0.001% by weight. Obviously, there are cases where the desired nominal content is 0% by weight or nominal absence of the element as occurs with all optional elements for certain applications.

The inventor has found that the sum of % Al+% Ti+% Ta+% Zr+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs is 1.9% by weight or less, 1.4% by weight or less, 0.9% by weight or less 0.4% by weight or less and even 0.1% by weight or less. In different embodiments, % Al+% Ti+% Ta+% Zr+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs is 0.002% by weight or more, 0.11% by weight or more, 0.41% by weight or more, 0.71% by weight or more and even 1.01% by weight or more.

The inventor has found that the sum of % Al+% Ta+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs can be of importance for some applications, and different levels are desirable for different embodiments. In different embodiments, % Al+% Ta+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Pm+% Eu+% Tb+% Dy+% Ho+% Er+% Tm+% Yb+% Lu+% Cs is 0.002% by weight or more, 0.02% by weight or more, 0.12% by weight or more and even 0.21% by weight or more.

The inventor has found that the sum of % Ni+% Mn+% Si can be of importance for some applications, and different levels are desirable for different embodiments. In different embodiments, % Ni+% Mn+% Si is 0.04% by weight or more, above 0.04% by weight, 0.11% by weight or more, above 0.11% by weight, above 0.16% by weight, above 0.21% by weight, above 0.41% by weight, above 0.51% by weight and even above 0.66% by weight. For some applications and excessive value of the sum of these elements can be detrimental. In different embodiments, % Ni+% Mn+% Si is 1.9% by weight or less, below 1.9% by weight, 1.4% by weight or less, below 1.4% by weight, below 0.9% by weight, below 0.78% by weight, below 0.58% by weight and even below 0.47% by weight. All the upper and lower limits disclosed in the different embodiments can be combined in any combination provided they are not mutually exclusive, for example % Ni+% Mn+% Si=0.04-1.9% by weight or % Ni+% Mn+% Si=0.11-1.4% by weight.

The inventor has found that the sum of % Ni+% Mn can be of importance for some applications, and different levels are desirable for different embodiments. In different embodiments, % Ni+% Mn is 0.04% by weight or more, 0.12% by weight or more, 0.21% by weight or more, 0.3% by weight or more, 0.41% by weight or more, 0.42% by weight or more, 0.51% by weight or more and even 0.66% by weight or more. For some applications and excessive value of the sum of these elements can be detrimental. In different embodiments, % Ni+% Mn is 1.9% by weight or less, 1.4% by weight or less, 1.2% by weight or less, 0.9% by weight or less, 0.78% by weight or less and even 0.58% by weight or less. All the upper and lower limits disclosed in the different embodiments can be combined in any combination provided they are not mutually exclusive, for example % Ni+% Mn=0.3-1.9% by weight or % Ni+% Mn=0.42-1.2% by weight.

The inventor has found that the sum of % Mn+% Si can be of importance for some applications, and different levels are desirable for different embodiments. In different embodiments, % Mn+% Si is 0.002% by weight or more, 0.04% by weight or more, 0.12% by weight or more, 0.31% by weight or more and even 0.62% by weight or more. For some applications and excessive value of the sum of these elements can be detrimental. In different embodiments, % Mn+% Si is 3.9% by weight or less, 3.41% by weight or less, 2.89% by weight or less, 1.9% by weight or less, 1.42% by weight or less and even below 0.92% by weight or less. All the upper and lower limits disclosed in the different embodiments can be combined in any combination provided they are not mutually exclusive, for example % Mn+% Si=0.04-3.9% by weight.

The inventor has found that for some applications certain element combinations are preferred. In different embodiments, % Ti+% V+% W+% Nb>4% by weight, % Ti+% V+% W+% Nb>6% by weight, % Ti+% V+% W+% Nb>7% by weight, % Ti+% V+% W+% Nb>8, % Ti+% V+% W+% Nb>10% by weight and even % Ti+% V+% W+% Nb>11% by weight.

The inventor has found that for some applications certain element combinations are preferred. For some applications the following has to be true: % Ti/TCE<% Ceq<% Ti*TCI. In an embodiment, TCE is 4. In another embodiment. TCE is 6. In another embodiment, TCE is 8. In another embodiment, TCE is 10. In another embodiment, TCE is 11. In another embodiment, TCE is 12. In an embodiment, TCI is 0.5. In another embodiment, TCI is 1. In another embodiment, TCI is 3. In another embodiment, TCI is 4. In another embodiment, TCI is 6. All the values disclosed in the different embodiments can be combined in any combination provided they are not mutually exclusive, for example: % Ti/10<% Ceq<% Ti*3.

The inventor has found that for some applications certain element combinations are preferred. In an embodiment, % Ti+% Mo+% Cr+% Nb>(% V+% W)/0.6. In another embodiment, % Ti+% Mo+% Cr+% Nb>(% V+% W)/0.8. In another embodiment, % Ti+% Mo+% Cr+% Nb>(% V+% W), % Ti+% Mo+% Cr+% Nb>(% V+% W)/1.2. In another embodiment, % Ti+% Mo+% Cr+% Nb>(% V+% W)/1.4. In another embodiment, % Ti+% Mo+% Cr+% Nb>(% V+% W)/1.6. In another embodiment, % Ti+% Mo+% Cr+% Nb>(% V+% W)/2.

It has been found that for some of the steels of the present invention to assure homogeneous toughness in large cross sections, the following has to be true: HTLC*% N≤% Ni+% Mn≤(% C−% N)*ATLS. In an embodiment, HTLC is 10. In another embodiment, HTLC is 20. In another embodiment, HTLC is 30. In another embodiment, HTLC is 40. In another embodiment, HTLC is 50 and even in some embodiments HTLC is 70. In an embodiment, ATLS is 5. In another embodiment, ATLS is 6. In another embodiment, ATLS is 7. In another embodiment, ATLS is 8. In another embodiment, ATLS is 9. In another embodiment, ATLS is 12, and even in some embodiments, ATLS is 19. All the values disclosed in the different embodiments can be combined in any combination provided they are not mutually exclusive, for example: 20*% N≤% Ni+% Mn≤(% C−% N)*7.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

The inventor has found that for some applications a certain relation between % $Mo_{eq}$, % Mn and % Ni content is preferred, and different levels are desirable for different applications. In different embodiments, (% $Mo_{eq}$)/(% Mn+% Ni) is 0.3% by weight or more, 0.5% by weight or more, 0.7% by weight or more, 0.8% by weight or more, 0.9% by weight or more, 1.6% by weight or more and even 2.5% by weight or more For some applications and excessive value of (% $Mo_{eq}$)/(% Mn+% Ni) can be detrimental. In different embodiments. (% $Mo_{eq}$)/(% Mn+% Ni) is 21% by weight or less, 16% by weight or less, 12% by weight or less, 10% by weight or less, 8% by weight or less, and even 4.9% by weight or less. All the upper and lower limit disclosed in the different embodiments can be combined in any combination provided they are not mutually exclusive, for example (% $Mo_{eq}$)(% Mn+% Ni)=0.7-10% by weight or (% $Mo_{eq}$)/(% Mn+% Ni)=0.7-4.9% by weight.

The inventor has found that for some applications certain element combinations are preferred. In different embodiments, % Ti>(% Mo+% Cr)/4, % Ti>(% Mo+% Cr)/5, % Ti>(% Mo+% Cr)/5.5. % Ti>(% Mo+% Cr)/6, % Ti>(% Mo+% Cr)/7, % Ti>(% Mo+% Cr)/8 and even % Ti>(% Mo+% Cr)/11.

The inventor has found that for some applications certain element combinations are preferred. In different embodiments, % Ti<(% Mo+% Cr+% V+% Si+% W)/7, % Ti<(% Mo+% Cr+% V+% Si+% W)/5, % Ti<(% Mo+% Cr+% V+% Si+% W)/4, % Ti<(% Mo+% Cr+% V+% Si+% W)/3, % Ti<(% Mo+% Cr+% V+% Si+% W)/2, % Ti<(% Mo+% Cr+% V+% Si+% W)/1 and even % Ti<(% Mo+% Cr+% V+% Si+% W)/0.5.

For some applications the inventor has found some limitations, depending on the % Ceq content in the steel. In an embodiment, when % Ceq=0.15-0.55% by weight, then % Ni+% Mn=0.3-1.9% by weight; in an embodiment, when % Ceq=0.15-0.55% by weight, then % Cr≤1.9% by weight; in an embodiment, when % Ceq=0.15-0.55% by weight, then % $Mo_{eq}$≥0.6% by weight; in an embodiment, when % Ceq=0.15-0.55% by weight, then the steel has a microstructure which is characterized by a thermal diffusivity at room temperature of at least 13 $mm^2/s$; in an embodiment, when % Ceq=0.55-1.49% by weight (not including the lower limit), then % Ti≥0.12% by weight; in an embodiment, when % Ceq=0.55-1.49% by weight (not including the lower limit), then % Cr≥2.1% by weight; in an embodiment, when % Ceq=0.55-1.49% by weight (not including the lower limit), then % Mn+% Si=0.04-3.9% by weight.

In different embodiments, the microstructure of the steel is characterized by a thermal diffusivity at room temperature which is at least 8 $mm^2/s$, at least 9.6 $mm^2/s$, at least 10.6 $mm^2/s$, at least 11.2 $mm^2/s$, at least 12.1 $mm^2/s$, and even at least 13 $mm^2/s$. The inventor has found that in some applications wherein the microstructure has a particularly low content of scattering atomic arrangement defects, the microstructure of the steel is characterized by higher thermal diffusivity values at room temperature, in different embodiments, the microstructure is characterized by a thermal diffusivity at room temperature which is at least 13.6 $mm^2/s$, at least 14.6 $mm^2/s$, at least 15.2 $mm^2/s$, at least 16.2 $mm^2/s$, at least 16.6 $mm^2/s$, at least 17.01 $mm^2/s$, and even at least 18 $mm^2/s$. In an embodiment, the thermal diffusivity is measured at room temperature by means of the Flash Method. In an embodiment, the thermal diffusivity is measured at room temperature according to ASTM-E1461-13. In an embodiment, the thermal diffusivity can alternatively be measured at room temperature according to ASTM-E2585-09(2015).

In an embodiment, the steel presents a microstructure comprising at least 26% balnite, at least 46% balnite, at least 62% bainite, at least 76% bainite, at least 82% bainite and even at least 92% bainite. In an embodiment, the above disclosed percentages of bainite are by volume.

For some applications, a steel having a microstructure comprising high temperature bainite is preferred. In this document high temperature bainite refers to any microstructure formed at temperatures above the temperature corresponding to the bainite nose in the TTT diagram but below the temperature where the ferritic/perlitic transformation ends, but it excludes lower bainite as referred in the literature, which can occasionally form in small amounts also in isothermal treatments at temperatures above the one of the bainitic nose. In an embodiment, high temperature bainite is at least 20%. In another embodiment, high temperature bainite is at least 31%. In another embodiment, high temperature bainite is at least 41%. In another embodiment, high temperature bainite is at least a 51%. In another embodiment, high temperature bainite is at least 66%. In another embodiment, high temperature balnite is at least a 76%. In another embodiment, high temperature bainite is at least 86%. In another embodiment, high temperature bainite is at least 91%. In another embodiment, high temperature balnite is at least 96%. In an embodiment, high temperature bainite is 100%. In an embodiment, all the bainite is high temperature bainite. In some applications, the percentage of high temperature bainite should be limited. In an embodiment, high temperature bainite is less than 98%. In another embodiment, high temperature balnite is less than 89%. In another embodiment, of high temperature bainite is less than 79%. In another embodiment, of high temperature bainite is less than 69%. In another embodiment, high temperature balnite is less than 59%. In another embodiment, high temperature bainite is less than 49%. In an embodiment, the above disclosed percentages of high temperature bainite are by volume. All the embodiments disclosed above can be combined in any combination, provided that they are not mutually exclusive, for example, a steel wherein the high temperature bainite is at least a 20% by volume.

It has been found with surprise, that in the steels of the present invention, for some applications, the microstructures that are reported as undesirable in the literature are for those applications very advantageous. In this sense, for some applications, the microstructures resulting from the decomposition of austenite at high temperatures are preferred. In fact, the range of preferred microstructures for those applications is rather concrete resulting in narrow process windows. In different embodiments, the microstructure should be composed at least by 26% or more of HTSM microstructure, at least by 52% or more of HTSM microstructure, at least by 66% or more of HTSM microstructure, at least by 76% or more of HTSM microstructure, at least by 86% or more of HTSM microstructure, at least by 92% or more of HTSM microstructure, at least by 96% or more of HTSM microstructure and even in some embodiments, the microstructure should be completely composed of HTSM microstructure. In different embodiments, the amount of LTSM should be 48% or less, 24% or less, 18% or less, 8% or less, 4% or less and even in some embodiments, the amount of LTSM should be inappreciable. In different embodiments, the amount of UHTSM should be 48% or less, 24% or less, 14% or less, 8% or less, 3% or less and even in some embodiments, the amount of UHTSM should be inappreciable. In an embodiment, the above disclosed percentages are by volume. In an embodiment. HTSM microstructure is a microstructure with a transformation temperature between (Ac1+Ac3)/2+20° C. and (Bs+Bf)/2. Bs and Bf refer to the bainite start and bainite finish transformation temperatures respectively. In another embodiment, HTSM microstructure is a microstructure with a transformation temperature between (Ac1+Ac3)/2 and (Bs+Bf)/2. In another embodiment, HTSM microstructure is a microstructure with a transformation temperature between Ac1-20K and (Bs+Bf)/2. In another embodiment, HTSM microstructure is a microstructure with a transformation temperature between Ac1-20K and (Bs+Bf)/2+10K. In an embodiment, the microstructure associated with a transformation temperature is extracted from a Constant Temperature Transformation (TTT) diagram where the austenitization temperature is Ae3+5K. In another embodiment, the microstructure associated with a transformation temperature is extracted from a TTT diagram where the austenitization temperature is Ae3+20K. In another embodiment, the microstructure associated with a transformation temperature is extracted from a TTT diagram where the austenitization temperature is Ae3+50K. In another embodiment, the microstructure associated with a transformation temperature is extracted from a TTT diagram where the austenitization temperature is Ae3+100K. In another embodiment, the microstructure associated with a transformation temperature is extracted from TTT diagram where the austenitization temperature is Ae1+10K. In an embodiment, the austenitization time at the austenitization temperature to construct the TTT diagram is 30 minutes. In another embodiment, the austenitization time at the austenitization temperature to construct the TTT diagram is 1 hour. In an embodiment, the microstructure associated with a transformation temperature is extracted from a Continuous Cooling Transformation (CCT) diagram where the austenitization temperature is Ae3+5K and the cooling rate is 5K/min. In another embodiment, the microstructure associated with a transformation temperature is extracted from a CCT diagram where the austenitization temperature is Ae3+5K and the cooling rate is 3K/min. In another embodiment, the microstructure associated with a transformation temperature is extracted from a CCT diagram where the austenitization temperature is Ae3+20K and the cooling rate is 5K/min. In another embodiment, the microstructure associated with a transformation temperature is extracted from a CCT diagram where the austenitization temperature is Ae3+20K and the cooling rate is 3K/min. In another embodiment, the microstructure associated with a transformation temperature is extracted from a CCT diagram where the austenitization temperature is Ae3+100K and the cooling rate is 5K/min. In another embodiment, the microstructure associated with a transformation temperature is extracted from a CCT diagram where the austenitization temperature is Ae3+100K and the cooling rate is 3K/min. In an embodiment, the austenitization time at the austenitization temperature to construct the CCT diagram is 30 minutes. In another embodiment, the austenitization time at the austenitization temperature to construct the CCT diagram is 1 hour. In an embodiment, LTSM microstructure is a microstructure with a transformation temperature below Bf. In another embodiment, LTSM microstructure is a microstructure with a transformation temperature below Bf−20K. In another embodiment, LTSM microstructure is a microstructure with a transformation temperature below Ms. Ms refers to the martensite start transformation temperature. In another embodiment, LTSM microstructure is a microstructure with a transformation temperature below Ms−10K. In an embodiment, UHTSM microstructure is a microstructure with a transformation temperature above Ac1−20K, in another embodiment, UHTSM microstructure is a microstructure with a transformation temperature above Ac1. In another embodiment, UHTSM microstructure is a microstructure with a transformation temperature above Ac1+10K. In another embodiment, UHTSM microstructure is a microstructure with a transformation temperature above Ac1+20K. In another embodiment, UHTSM microstructure is a microstructure with a transformation temperature above (Ac1+Ac3)/2. In another embodiment, UHTSM microstructure is a microstructure with a transformation temperature above (Ac1+Ac3)/2+20K. All the above disclosed embodiments can be combined in any combination provided that they are not mutually exclusive.

For some applications, more interesting than controlling the microstructure is to control the cooling rates applied after the last at least partial austenization of the material. The material might undergo several heat treatments involving at least partial austenization, but it has been found that for some applications the cooling rate applied in the last one should be purposefully adjusted, that does not mean that for some of those applications the intentional monitoring of other preceding heat treatments cooling raters can also be advantageous. In different embodiments, the last heat treatment involving at least partial austenization of the material involves a mean cooling rate between the austenitization temperature and RET of 19K/min or less, a mean cooling rate between the austenitization temperature and RET of 9K/min or less, a mean cooling rate between the austenitization temperature and RET of 6K/min or less, a mean cooling rate between the austenitization temperature and RET of 4.9K/min or less, a mean cooling rate between the austenitization temperature and RET of 3.9K/min or less, a mean cooling rate between the austenitization temperature and RET of 2.9K/min or less and even the last heat treatment involving at least partial austenization of the material involves a mean cooling rate between the austenitization temperature and RET of 0.9K/min or less. In an embodiment, any isothermal holding is discounted when measuring the mean cooling rate. In different embodiments, an isothermal holding is any portion of the cooling diagram where the cooling rate is 2 times slower than the mean, 3 times slower than the mean, 5 times slower than the mean, 10 times slower than the mean and even 15 times slower than the mean. In some applications there is also a desirable lower limit for this portion of the cooling. In an embodiment, the last heat treatment involving at least partial austenization of the material involves a mean cooling rate between the austenitization temperature and RET of 0.06K/min or more. In another embodiment, the last heat treatment involving at least partial austenization of the material involves a mean cooling rate between the austenitization temperature and RET of 0.2K/min or more. In another embodiment, the last heat treatment involving at least partial austenization of the material involves a mean cooling rate between the austenitization temperature and RET of 0.6K/min or more. In another embodiment, the last heat treatment involving at least partial austenization of the material involves a mean cooling rate between the austenitization temperature and RET of 1.1K/min or more. In another embodiment, the last heat treatment involving at least partial austenization of the material involves a mean cooling rate between the austenitization temperature and RET of 2.2K/min or more. In another embodiment, the last heat treatment involving at least partial austenization of the material involves a mean cooling rate between the austenitization temperature and RET of 3.3K/min or more and even in some embodiments, the last heat treatment involving at least partial austenization of the material involves a mean cooling rate between the austenitization temperature and RET of 4.4K/min or more. In an embodiment, the mean cooling rate between RET2 and RET3 is at least a 20% slower than between austenitization and RET. In another embodiment, the mean cooling rate between RET2 and RET3 is at least a 52% slower than between austenitization and RET. In another embodiment, the mean cooling rate between RET2 and RET3 is at least a 76% slower than between austenitization and RET. In another embodiment, the mean cooling rate between RET2 and RET3 is at least half as fast as between austenitization and RET. In another embodiment, the mean cooling rate between RET2 and RET3 is at least a fourth as fast as between austenitization and RET. In an embodiment, the mean cooling rate between RET2 and RET3 is no more than 5 times slower than between austenitization and RET. In another embodiment, the mean cooling rate between RET2 and RET3 is no more than 3 times slower than between austenitization and RET. In another embodiment, the mean cooling rate between RET2 and RET3 is no more than 2 times slower than between austenitization and RET. In an embodiment, the last heat treatment involving at least partial austenization of the material involves a mean cooling rate between RET2 and RET3 of 13K/min or less. In another embodiment, the last heat treatment involving at least partial austenization of the material involves a mean cooling rate between RET2 and RET3 of 8K/min or less. In another embodiment, the last heat treatment involving at least partial austenization of the material involves a mean cooling rate between RET2 and RET3 of 4.4K/min or less. In another embodiment, the last heat treatment involving at least partial austenization of the material involves a mean cooling rate between RET2 and RET3 of 3.9K/min or less. In another embodiment, the last heat treatment involving at least partial austenization of the material involves a mean cooling rate between RET2 and RET3 of 2.9K/min or less. In some applications the cooling rate should not be excessively low. In an embodiment, the last heat treatment involving at least partial austenization of the material involves a mean cooling rate between RET2 and RET3 of 0.05K/min or more. In another embodiment, the last heat treatment involving at least partial austenization of the material involves a mean cooling rate between RET2 and RET3 of 0.5K/min or more. In another embodiment, the last heat treatment involving at least partial austenization of the material involves a mean cooling rate between RET2 and RET3 of 1.1K/min or more. In an embodiment, any isothermal holding is discounted when measuring the mean cooling rate in the same terms as described above in this paragraph. In an embodiment, the last heat treatment involving at least partial austenization of the material involves a mean cooling rate between RET2 and RET3 of no less than 0.04K/min. In another embodiment, the last heat treatment involving at least partial austenization of the material involves a mean cooling rate between RET2 and RET3 of no less than 0.4K/min. In another embodiment, the last heat treatment involving at least partial austenization of the material involves a mean cooling rate between RET2 and RET3 of no less than 1.1K/min. Definition of the RET, RET2 and RET3 temperatures might be different for different applications. In an embodiment, RET refers to (Ac3+Bs)/2. In another embodiment, RET refers to Ac3−20K. In another embodiment, RET refers to Ac3−50K. In another embodiment, RET refers to (Ac3+Ac1)/2−70K in another embodiment, RET refers to (Ac3+Ac1)/2−130K. In another embodiment, RET refers to B+150K. In another embodiment, RET refers to Bs+80K. In another embodiment, RET refers to 89+20K. In another embodiment, RET, refers to 7300° C. In another embodiment, RET, refers to 730° C. In another embodiment, RET, refers to 680° C. In another embodiment, RET, refers to 660° C. In another embodiment, RET refers to 600° C. In another embodiment, RET, refers to 560° C. In another embodiment, RET2 refers to (Ac3+Be)/2. In another embodiment, RET2 refers to (Ac3+Bs)/2−20K. In another embodiment, RET2 refers to (Ac3+Bs)/2−80K. In another embodiment, RET2 refers to Ac3−40K. In another embodiment, RET2 refers to Ac3−150K. In another embodiment, RET2 refers to (Ac3+Ac1)/2−130K. In another embodiment, RET2 refers to (Ac3+Ac1)/2−150K. In another embodiment, RET2 refers to Bs+100K. In another embodiment, RET2 refers to Bs+120K. In another embodiment, RET2 refers to Bs+50K. In another embodiment, RET2, refers to 640° C. In another embodiment, RET2 refers to 610° C. In another embodiment, RET2 refers to 580° C. in another embodiment, RET2, refers to 520° C. In an embodiment, RET3 refers to (Bf+Bs)/2. In another embodiment, RET3 refers to (Bf+Bs)/2−20K. In another embodiment, RET3 refers to (Bf+Ms)/2. In another embodiment, RET3 refers to (Bf+Ms)/2+20K. In another embodiment, RET3 refers to (Bf+Ms)/2−20K. In another embodiment, RET3 refers to Ms. In another embodiment, RETS refers to (Mf+Ms)/2. In another embodiment, RET3 refers to 480° C. In another embodiment, RET3 refers to 440° C. In another embodiment, RET3 refers to 380° C. In another embodiment, RET3 refers to 320° C. In another embodiment, RET3 refers to 250° C. All the above disclosed embodiments can be combined in any combination provided that they are not mutually exclusive.

In some applications it is challenging to attain an optically pleasant microstructure which at the same time provides a good combination of mechanical properties for some steels of the present invention. It has been found with great surprise that this can be more easily obtained by making an interruption in the cooling process which involves a temperature increase, provided the temperatures, cooling/heating rates and permanence times are well chosen. In an embodiment, the treatment comprises a step in which the cooling from RET (as previously described) is interrupted at RIT. In an embodiment, the temperature is furthermore hold somewhat constant around RIT for a period of tRIT. In an embodiment, the heat treatment further comprises a step in which temperature is raised from RIT to HIT. In an embodiment, the heating rate from RIT to HIT is controlled. In an embodiment, the temperature is further kept somewhat constant around HIT for a period of tHIT. In an embodiment, the temperature is further lowered from HIT to RIT2. In an embodiment, the temperature is lowered from HIT to RIT2 in a controlled way. In an embodiment, RIT is 698° C. or less. In another embodiment, RIT is 598° C. or less. In another embodiment, RIT is 498° C. or less. In another embodiment, RIT is 448° C. or less. In another embodiment, RIT is 398° C. or less. In an embodiment, RIT should not be less than 150° C. In another embodiment, RIT should not be less than 250° C. In another embodiment, RIT should not be less than 350° C. In another embodiment, RIT should not be less than 450° C. In another embodiment, RIT should not be less than 502° C. In an embodiment, tRIT is 12 minutes or more. In another embodiment, tRIT is 31 minutes or more. In another embodiment, tRIT is 62 minutes or more. In another embodiment, tRIT is 92 minutes or more. In another embodiment, tRIT is 6 hours or more. In another embodiment, tRIT is 12 hours or more. In an embodiment, tRIT should not be more than 47 hours. In another embodiment tRIT should not be more than 19 hours. In another embodiment, tRIT should not be more than 9 hours. In another embodiment, tRIT should not be more than 110 minutes. In another embodiment, tRIT should not be more than 50 minutes. In an embodiment, the cooling rate between RET to RIT should not exceed 19K/min. In another embodiment, the cooling rate between RET to RIT should not exceed 13K/min. In another embodiment, the cooling rate between RET to RIT should not exceed 7.9K/min. In another embodiment, the cooling rate between RET to RIT should not exceed 4.4K/min. In another embodiment, the cooling rate between RET to RIT should not exceed 3.9K/min. In another embodiment, the cooling rate between RET to RIT should not exceed 2.9K/min. In some applications the cooling rate should not be excessively low. In an embodiment, the cooling rate between RET to RIT should exceed 0.05K/min. In another embodiment, the cooling rate between RET to RIT should exceed 0.5K/min. In another embodiment, the cooling rate between RET to RIT should exceed 1.1K/min. In another embodiment, the cooling rate between RET to RIT should exceed 2.1K/min. In an embodiment, HIT is 401° C. or more. In another embodiment, HIT is 451° C. or more. In another embodiment, HIT is 502° C. or more. In another embodiment, HIT is 552° C. or more. In another embodiment, HIT is 602° C. or more. In another embodiment, HIT is 632° C. or more. In another embodiment, HIT is 652° C. or more. In another embodiment, HIT is 682° C. or more. In another embodiment, HIT is 702° C. or more. In an embodiment, HIT is 890° C. or less. In another embodiment, HIT is 790° C. or less. In another embodiment, HIT is 740° C. or less. In another embodiment, HIT is 690° C. or less. In another embodiment, HIT is 640° C. or less. In an embodiment, the heating rate between RIT to HIT should not exceed 19K/min. In another embodiment, the heating rate between RIT to HIT should not exceed 13K/min. In another embodiment, the heating rate between RIT to HIT should not exceed 7.9K/min. In another embodiment, the heating rate between RIT to HIT should not exceed 4.4K/min. In another embodiment, the heating rate between RIT to HIT should not exceed 3.9K/min. In another embodiment, the heating rate between RIT to HIT should not exceed 2.9K/min. In some applications the heating rate should not be excessively low. In an embodiment, the heating rate between RIT to HIT should exceed 0.05K/min. In another embodiment, the heating rate between RIT to HIT should exceed 0.5K/min. In another embodiment, the heating rate between RIT to HIT should exceed 1.1K/min. In another embodiment, the heating rate between RIT to HIT should exceed 2.1K/min. In an embodiment, tHIT is 12 minutes or more. In another embodiment, tHIT is 31 minutes or more. In another embodiment, tHIT is 62 minutes or more. In another embodiment, tHIT is 92 minutes or more. In another embodiment, tHIT is 8 hours or more. In another embodiment, tHIT is 12 hours or more. In an embodiment, tHIT should not be more than 47 hours. In another embodiment, tHIT should not be more than 19 hours. In another embodiment, tHIT should not be more than 9 hours. In another embodiment, tHIT should not be more than 110 minutes. In another embodiment, tHIT should not be more than 50 minutes. In an embodiment, RIT2 is 598° C. or less. In another embodiment, RIT2 is 498° C. or less. In another embodiment, RIT2 is 398° C. or less. In another embodiment, RIT2 is 298° C. or less. In another embodiment, RIT2 is 198° C. or less. In an embodiment, RIT2 should not be less than 50° C. In another embodiment, RIT2 should not be less than 102° C. In another embodiment, RIT2 should not be lees than 150° C. In another embodiment, RIT2 should not be less than 350° C. In another embodiment, RIT2 should not be less than 502° C. In some applications the cooling can continue until the extraction from the furnace or even an undercooling might be interesting for some applications. In an embodiment, RIT2 does not have a lower limit. In some applications what is important is the difference of temperature between HIT and RIT 2. In an embodiment, HIT-RIT2 should be 52° C. or more. In another embodiment, HIT-RIT2 should be 102° C. or more. In another embodiment, HIT-RIT2 should be 152° C. or more. In another embodiment, HIT-RIT2 should be 252° C. or more. In another embodiment. HIT-RIT2 should be 352° C. or more. In an embodiment, the cooling rate between HIT to RIT2 should not exceed 13K/min. In another embodiment, the cooling rate between HIT to RIT2 should not exceed 7.9K/min. In another embodiment, the cooling rate between HIT to RIT2 should not exceed 4.4K/min. In another embodiment, the cooling rate between HIT to RIT2 should not exceed 3.9K/min. In another embodiment, the cooling rate between HIT to RIT2 should not exceed 2.9K/min. In some applications the cooling rate should not be excessively low. In an embodiment, the cooling rate between HIT to RIT2 should exceed 0.05K/min. In another embodiment, the cooling rate between HIT to RIT2 should exceed 0.5K/min. In another embodiment, the cooling rate between HIT to RIT2 should exceed 1.1K/min. In another embodiment, the cooling rate between HIT to RIT2 should exceed 2.1K/min. All the above disclosed embodiments can be combined in any combination provided that they are not mutually exclusive.

In some applications, where wear resistance is important but simultaneously a high level of resilience or fracture toughness are also required, morphology of primary carbides can be of primordial importance.

Also, many primary carbides tend to become larger the slower the cooling rate from the melting temperature, and thus are very small for powder metallurgical steels and very large for big cross sections of castings or conventionally melted and then forged blocks. This has often a strong influence in toughness related properties. To make matters worse in most alloyed tool steels segregation takes place during dendritic solidification, generally leading to enriched interdendritic liquid where the primary carbide precipitation usually takes place and thus primary carbides tend to form in those areas and are not uniformly distributed but rather aligned surrounding the dendrites. This leads again to strong reduction of toughness related properties. This is also one of the main reasons why primary carbide containing tool steels are normally forged or rolled to break those primary carbide alignments. The inventor has found that provided the right conditions, it is possible to have a uniform primary carbide distribution even in alloyed tool steels with dendritic solidification and interdendritic liquid enrichment. Moreover, it is possible to do so with carbides that have a preferable morphology and a sufficient degree of coherence to the matrix.

In some applications it has been found that sufficient but not excessive niobium content tends to control the shape and distribution of titanium-rich primary carbides. In different embodiments, % Nb is 0.05% by weight or larger, 0.11% by weight or larger, 0.21% by weight or larger and even 0.35% by weight or larger. In different embodiments, % Nb is 1.4% by weight or smaller, 0.9% by weight or smaller, 0.45% by weight or smaller, 0.19% by weight or smaller and even 0.09% by weight or smaller. In a set of embodiments, the niobium effect is only provided when chromium is present in the right amount. In an embodiment, % Cr>5*% Nb. In another embodiment, % Cr>10*% Nb. In another embodiment, % Cr>15*% Nb. In another embodiment, % Cr>20*% Nb. In an embodiment, % Cr<50*(% Nb+% Ti). In another embodiment, % Cr<30*(% Nb+% Ti). In another embodiment, % Cr<20*(% Nb+% Ti). In another embodiment, % Cr<10*(% Nb+% Ti). In another embodiment, % Cr<5*(% Nb+% Ti). In an embodiment, the aforementioned in this paragraph is specially reinforced when % Nb<% Ti/1.2. In another embodiment, the aforementioned in this paragraph is specially reinforced when % Nb<% Ti/1.5. In another embodiment, the aforementioned in this paragraph is specially reinforced when % Nb<% Ti/2. In another embodiment, the aforementioned in this paragraph is specially reinforced when % Nb<% Ti/2.5. In another embodiment, the aforementioned in this paragraph is specially reinforced when % Nb<% Ti/3.5.

In some applications it has been found that boron can be used to control the primary carbide morphology. In different embodiments, a % B of 0.01% by weight or more, 0.11% by weight or more, 0.51% by weight or more, 0.76% by weight or more and even 1.02% by weight or more is used. In some applications it has been found that the boron effect on the spherical microstructure of primary carbides is reinforced for powder metal. In an embodiment, the steel with the aforementioned boron additions is atomized to obtain steel powder. In different embodiments, the powder has a mean particle size (D50) of 512 microns or less, 212 microns or less and even 99 microns or less. In an embodiment, the powder is consolidated into a form or ingot. In an embodiment, the powder has a mean particle size (D50) of 55 microns or more. In an embodiment, the consolidation process involves powder forging in a can. In an embodiment, the consolidation process involves HIP. In an embodiment, D50, refers to a particle size at which 50% of the sample's volume is comprised of smaller particles in the cumulative distribution of particle size. In an embodiment, particle size is measured by laser diffraction according to ISO 13320-2009.

In some applications, it is important to be able to repair by welding, and some of those applications require high toughness in the repaired area. It has been found that for some of the steels of the present invention to be weldable with high resilience, the following has to be true: PTC1*(% Ti/% Ceq)>% Cr>PMS1*(% Mn+% Si). In an embodiment, PTC1 is 50. In another embodiment, PTC1 is 30. In another embodiment, PTC1 is 20. In another embodiment, PTC1 is 15 and even in some embodiments, PTC1 is 10. In an embodiment, PMS1 is 1. In another embodiment, PMS1 is 2.3. In another embodiment, PMS1 is 3. In another embodiment, PMS1 is 3.5 and even in some embodiments, PMS1 is 5. In some embodiments, on top it has to be true that % Mo>% Ti. In some embodiments, on top it has to be true that % Mo<3*(% Ti+% Ceq). In some embodiments, it has to be true that 2.5*(% Mo+% Ti)>(% Cr−2*% Ceq).

The inventor has found that for some applications a certain relation between % B and % Ti content is preferred, and different levels are desirable for different applications. In different embodiments, % B>% Ti/3, % B>% Ti/4, % B>% Ti/4.5, % B>% Ti/5, % B>% Ti/5.5, % B>% Ti/6 and even % B>% Ti/10 is preferred.

The inventor has found that for some applications a certain relation between % B and % Ti content is preferred, and different levels are desirable for different applications. In different embodiments, 1.5*% Ti>% B, 2*% Ti>% B, 0.7*% Ti>% B, 0.5*% Ti>% B, and even 0.4*% Ti>% B is preferred.

In an embodiment, the steel comprises primary carbides. In different embodiments, the steel comprises more than 2.1% primary carbides, more than 3.6% primary carbides, more than 5.2% primary carbides, more than 6.1% primary carbides, more than 8.2% primary carbides and even more than 11% primary carbides. In an embodiment, the above disclosed percentages of primary carbides are by volume. In an embodiment, the primary carbides comprise also primary borides, nitrides and mixtures thereof.

The inventor has found that for some applications, a steel wherein at least part of the primary carbides have a certain size is preferred. In an embodiment, at least part of the primary carbides refers to at least a 51% of all primary carbides. In another embodiment, at least part of the primary carbides refers to at least a 66% of all primary carbides. In another embodiment, at least part of the primary carbides refers to at least a 76% of all primary carbides. In another embodiment, at least part of the primary carbides refers to at least an 81% of all primary carbides. In another embodiment, at least part of the primary carbides refers to at least an 86% of all primary carbides. In another embodiment, at least part of the primary carbides refers to at least a 91% of all primary carbides and even in some embodiments, at least part of the primary carbides refers to refers to at least a 96% of all primary carbides. In different embodiments, certain size refers to 49 microns of less, 39 microns or less, 29 microns or less, 19 microns or less, 14 microns or less, and even 9 microns or less. The above disclosed embodiments, can be combined in any combination, for example a steel wherein at least an 81% of all primary carbides have a size of 19 microns or less or a steel wherein at least an 81% of all primary carbides have a size of 49 microns or less.

The inventor has found that for some applications a certain relation between % Ti, % Ceq and % $Mo_{eq}$ content is preferred, and different levels are desirable for different applications wherein the following has to be true: % Ti/FCT<% Ceq<FCD*% Ti+% $Mo_{eq}$. In an embodiment, FCT is 1.5. In another embodiment, FCT is 1.8. In another embodiment, FCT is 2. In another embodiment, FCT is 2.2. In another embodiment, FCT is 2.5. In another embodiment, FCT is 3. In an embodiment, FCD is 1.5. In another embodiment, FCD is 2. In another embodiment, FCD is 2.5. In another embodiment, FCD is 3. In another embodiment, FCD is 3.5. All the above disclosed embodiments can be combined in any combination provided they are not mutually exclusive, for example % Ti/2<% Ceq<2*Ti+% Moeq.

In this invention, when a significant amount of primary carbides is desired, very often the morphology of those carbides plays a noticeable role (not limited to size, aspect ratio, roughness and roundness of the carbide) but often the desirable morphology is itself linked to some properties of the carbides (like fracture toughness, elastic modulus, hardness, . . . ) and properties of the interface of the carbide with the matrix surrounding it.

In an embodiment, the microstructure of the steel comprises martensite and/or tempered martensite. In an embodiment, the microstructure comprises more than 34% martensite and/or tempered martensite. In another embodiment, the microstructure comprises more than 46% martensite and/or tempered martensite. In another embodiment, the microstructure comprises more than 48% martensite and/or tempered martensite. In another embodiment, the microstructure comprises more than 56% martensite and/or tempered martensite. In another embodiment, the microstructure comprises more than 66% martensite and/or tempered martensite. In another embodiment, the microstructure comprises more than 78% martensite and/or tempered martensite and even in some embodiments, the microstructure comprises more than 86% martensite and/or tempered martensite. For some applications the maximum content should be limited. In an embodiment, the microstructure comprises less than 99% martensite and/or tempered martensite. In another embodiment, the microstructure comprises less than 84% martensite and/or tempered martensite. In another embodiment, the microstructure comprises less than 74% martensite and/or tempered martensite. In another embodiment, the microstructure comprises less than 54% martensite and/or tempered martensite and even in some embodiments, the microstructure comprises less than 49% martensite and/or tempered martensite. In an embodiment, the percentages of martensite and/or tempered martensite disclosed above are by volume. All the above disclosed embodiments can be combined in any combination provided they are not mutually exclusive, for example a microstructure comprising more than 56% and less than 99% by volume martensite and/or tempered martensite. In an embodiment, the microstructure of the steel further comprises retained austenite, ferrite, bainite and/or primary carbides.

All the upper and lower limits disclosed in the different embodiments can be combined in any combination provided they are not mutually exclusive.

A preferred embodiment of the invention is a steel, in particular a tool steel, having the following composition, all percentages being in weight percentage (% wt):

| | | | |
|---|---|---|---|
| % $C_{eq}$ = 0.15-1.49 | % C = 0.15-1.49 | % N = 0-0.49 | % B = 0-0.49 |
| % Cr = 0-14 | % Ni = 0-4.9 | % Si = 0-1.9 | % Mn = 0-2.8 |
| % Al = 0-0.9 | % Mo = 0-3.9 | % W = 0-4.9 | % Ti = 0-4.9 |
| % Ta = 0-0.4 | % Zr = 0-0.9 | % Hf = 0-0.3 | % V = 0-1.4 |
| % Nb = 0-1.4 | % Cu = 0-1.9 | % Co = 0-2.9 | % $Mo_{eq}$ = 0.26-3.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Pm = 0-0.3 | % Eu = 0-0.3 | % Tb = 0-0.3 | % Dy = 0-0.3 |
| % Ho = 0-0.3 | % Er = 0-0.3 | % Tm = 0-0.3 | % Yb = 0-0.3 |
| % Lu = 0-0.3 | % Cs = 0-0.3 | | |

the rest consisting of iron and trace elements, wherein

% Ceq=% C+0.86% N+1.2°% B, and

% $Mo_{eq}$=% Mo+½*% W,

With the proviso that:

When % Ceq=0.15-0.55, then % Ni+% Mn=0.3-1.9; and

When % Ceq=0.15-0.55, then % Cr≤1.9; and

When % Ceq=0.15-0.55, then % $Mo_{eq}$≥0.6; and

When % Ceq=0.15-0.55, then the steel presents a microstructure which is characterized by a thermal diffusivity at room temperature of at least 13 $mm^2/s$; and When % Ceq=0.55-1.49 (not including the lower limit), then % Ti≥0.12; and When % Ceq=0.55-1.49 (not including the lower limit), then % Cr≥2.1; and When % Ceq=0.55-1.49 (not including the lower limit), then % Mn+% Si=0.04-3.9.

Any embodiment disclosed in preceding paragraphs (including any lower and upper limit for the content of any element and/or their sum) can also be applied to this preferred embodiment, provided that they are not mutually exclusive.

As has been seen in the preceding paragraphs, there are almost innumerous possible combinations of alloying elements specific contents for different applications within the present invention, the preceding paragraph presenting one such possibility, as an example. One possibility to further elaborate preferred embodiments is to reduce the scope of the invention to particular applications. An example could be concentrating on applications for plastic injection molding, or sheet shaping/cutting applications, or applications requiring extreme wear resistance on the tool steel amongst others. Another possibility is to reduce the scope of the invention based on particular microstructural traits of the material. An example could be separating tool steels of the present invention comprising a significant amount of primary carbides from those having at most a marginal amount of primary carbides. In the following paragraphs some of these possibilities will be explored with the intend of making the invention even more easily replicable for a concrete application.

When looking into applications benefiting from good mechanical properties, especially compressive yield strength at a level around 1000 MPa, with good toughness related properties and good capacity to evacuate heat from the component being manufactured in an homogeneous way (avoiding hot spots), like is often the case in large plastic injection molding dies, the scope of the present invention might, for example, be reduced in the following way:

In an embodiment, the invention refers to a steel, in particular a hot work and/or plastic injection moulding tool steel, having the following composition, all percentages being in weight percentage (% wt):

| | | | |
|---|---|---|---|
| % $C_{eq}$ = 0.15-0.59 | % C = 0.15-0.59 | % N = 0-0.3 | % B = 0-0.2 |
| % Cr = 0-1.9 | % Ni = 0-1.4 | % Si = 0-0.49 | % Mn = 0-1.4 |
| % Al = 0-0.5 | % Mo = 0-2.9 | % W = 0-2.9 | % Ti = 0-0.9 |
| % Ta = 0-0.3 | % Zr = 0-0.9 | % Hf = 0-0.3 | % V = 0-0.4 |
| % Nb = 0-0.3 | % Cu = 0-1.9 | % Co = 0-2 | % $Mo_{eq}$ = 0.6-2.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Cs = 0-0.3 | % Eu = 0-0.3 | | |

the rest consisting of iron and trace elements, wherein $$\% Ceq = \% C + 0.86 * \% N + 1.2 * \% B, \text{ and}$$

$$\% Mo_{eq} = \% Mo + \tfrac{1}{2} * \% W.$$

Trace elements refers to several elements, unless context clearly indicates otherwise. Including but not limited to, H, He, Xe, F, Ne, Na, P, S, Cl, Ar, K, Br, Kr, Sr, Tc, Ru, Rh, Pd, Ag, I, Ba, Re, Os, Ir, Pt, Au, Hg, Tl, Po, At, Rn, Fr, Ra, Ac, Pa, U, Np, Pu, Am, Cm, Bk, Cf, Es, Fm, Md, No, Lr, Rf, db, Sg, Bh, Hs, Pm, Tb, Dy, Ho, Er, Tm, Yb, Lu, O, Li, Be, Mg, Ca, Rb, Zn, Cd, Ga, In, Ge, Sn, Pb, Bi, Sb, As, Se, Te, Th, Do, Rg, Cn, Nh, Fl, Mc, Lv, Ts, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments, the sum of all trace elements in the steel is below 2.0% by weight by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% $C_{eq}$). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % $C_{eq}$ should not be too high. In different embodiments, % $C_{eq}$ is 0.55% by weight or less, 0.54% by weight or less, 0.49% by weight or less, 0.44% by weight or less and even 0.42% by weight or less. Some applications, like sometimes applications requiring a rather good polishing ability in the tool steel or good weldability it is often interesting to keep even lower levels of % $C_{eq}$. In different embodiments, % $C_{eq}$ is 0.39% by weight or less, 0.34% by weight or less, 0.29% by weight or less and even 0.19% by weight or less. In contrast, in some applications higher contents of % $C_{eq}$ are preferred. In different embodiments, % $C_{eq}$ is above 0.18% by weight, above 0.21% by weight, above 0.26% by weight and even above 0.31% by weight.

Different applications require different levels of carbon (% C). For some applications, % C should not be too high. In different embodiments, % C is 0.55% by weight or less, 0.53% by weight or less, 0.48% by weight or less, 0.43% by weight or less and even 0.41% by weight or less. Some applications, like sometimes applications requiring a rather good polishing ability in the tool steel or good weldability it is often interesting to keep even lower levels of % C. In different embodiments, % C is 0.38% by weight or less, 0.33% by weight or less, 0.28% by weight or less and even 0.18% by weight or less. In contrast, in some applications higher contents of % C are preferred. In different embodiments, % C is above 0.19% by weight, above 0.22% by weight, above 0.26% by weight, above 0.27% by weight and even above 0.32% by weight.

It has been found that for some applications the presence of nitrogen (% N) is desirable while yet for other applications it is rather an impurity. In different embodiments, % N is 0.002% by weight or higher, 0.01% by weight or higher and even 0.12% by weight or higher. In contrast, in some applications an excessively high content of % N is rather detrimental. In different embodiments, % N is less than 0.28% by weight, less than 0.18% by weight, less than 0.09% by weight, less than 0.009% by weight, less than 0.0059% by weight, less than 0.0019% by weight, and even less than 0.00095% by weight. Obviously, there are cases where the desired nominal content is 0% by weight or nominal absence of the element as occurs with all optional elements for certain applications.

It has surprisingly been found that for some applications, a strict control on the level of % N leads to a marked improvement of the mechanical properties increasing both strength and toughness related properties. In an embodiment, % N is between 2 ppm and 190 ppm by weight. In different embodiments, the lower limit for the controlled % N content is 11 ppm by weight, 16 ppm by weight, 21 ppm by weight, 32 ppm by weight, 140 ppm by weight and even 96 ppm by weight. In different embodiments, the upper limit for the controlled % N content is 68 ppm by weight, 48 ppm by weight and even 33 ppm by weight. In an embodiment, the upper limit for the controlled % N content is 19 ppm. In an embodiment, % N refers to total % N present. In an embodiment, % N refers only to free nitrogen. In an embodiment. % N refers to the nitrogen in solid solution at room temperature. In an embodiment, % N refers to the maximum nitrogen in solid solution during austenitization. In an embodiment, very special care is taken during the degassing of the material to assure the specially low % N levels specified in some of the embodiments in this application. In an embodiment, vacuum degassing is applied to the melt. In an embodiment, the vacuum degassing is performed with a vacuum level reaching $9*10^{-2}$ mbars at some point in the vacuum degassing process. In an embodiment, the vacuum degassing is performed with a vacuum level reaching $9*10^{-3}$ mbars at some point in the vacuum degassing process. In an embodiment, the vacuum degassing is performed with a vacuum level reaching $9*10^{-4}$ mbars at some point in the vacuum degassing process. In an embodiment, the melt is vacuum degassed during 31 minutes or more. In another embodiment, the melt is vacuum degassed during 46 minutes or more. In another embodiment, the melt is vacuum degassed during 61 minutes or more. In another embodiment, the melt is vacuum degassed during 91 minutes or more. In another embodiment, the melt is vacuum degassed during 121 minutes or more. This special care in keeping a low % N would be considered madness for such kind of alloys which normally address a very price sensitive market, but the inventor has found with great surprise that this extra cost can be compensated by the increase in properties.

In some applications it has been found that some alloying elements, affect the quantity of desirable % N, to better describe this effect, the concept of an equivalent nitrogen (% Neq) will be introduced:

$$\% Neq = \% N - \% Ti/3.4 - (\% Zr + \% Nb)/6.5 - (\% Hf + \% Ta)/12.7 - (\% AC + \% LA)/11.$$

Where % AC refers to the sum of actinides (% Ac+% Ti+% Pa+% U+% Np+% Pu+% Am+% Cm+% Bk+% Cf+% Es+% Fm+% Md+% No+% Lr).

And where % LA refers to the sum of lanthanides (% La+% Ce+% Pr+% Nd+% Pm+% Sm+% Eu+% Gd+% Tb+% Dy+% Ho+% Er+% Tm+% Yb+% Lu).

In an embodiment, % Neq is between 0.2 ppm and 140 ppm by weight. In different embodiments, the lower limit for the controlled % Neq content is 1.2 ppm by weight, 6 ppm by weight, 11 ppm by weight and even 22 ppm by weight. In different embodiments, the upper limit for the controlled % Neq content is 89 ppm by weight, 78 ppm by weight, 58 ppm by weight, 48 ppm by weight and even 28 ppm by weight. In another embodiment, the upper limit for the controlled % Neq content is 19 ppm by weight. In another embodiment, the upper limit for the controlled % Neq content is 9 ppm by weight.

In some applications it has been found that the % Neq has a combined effect with % Mn, % Ni and in some cases % Si. For such applications and to make understanding easier, the NMN parameter has been developed, where:

$$NMN = \% Mn + 1.7 * \% Ni - 20 * \% Neq;$$

In an embodiment, NMN is between 0.125 and 1.8. In different embodiments, the upper limit for the controlled NMN parameter is 1.4, 0.94, 0.74, 0.68 and even 0.49. In different embodiments, the lower limit for the controlled NMN parameter is 0.22, 0.32, 0.41 and even 0.52. In an embodiment, when NMN is 0.34 or larger, then % Si has to be 0.28% by weight or lower. In an embodiment, when NMN is 0.44 or larger, then % Si has to be 0.18% by weight or lower. In an embodiment, when NMN is 0.51 or larger, then % Si has to be 0.14% by weight or lower. In an embodiment, when NMN is 0.54 or larger, then % Si has to be 0.09% by weight or lower.

It has been found that for some applications the presence of boron (% B) is desirable while yet for other applications it is rather an impurity. In different embodiments, % B is above 1 ppm by weight, above 11 ppm by weight, above 31 ppm by weight, above 40 ppm by weight, 0.002% by weight or higher, 0.0032% by weight or higher, 0.01% by weight or higher and even 0.12% by weight or higher. In contrast, in some applications an excessively high content of % B is rather detrimental. In different embodiments, % B is less than 0.18% by weight, less than 0.09% by weight, less than 0.035% by weight, less than 0.009% by weight, less than 0.0058% by weight, less than 0.002% by weight and even less than 0.0004% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is 0.001% by weight or higher, 0.006% by weight or higher, 0.01% by weight or higher, 0.03% by weight or higher, 0.09% by weight or higher, 0.11% by weight or higher and even 0.16% by weight or higher. In contrast, in some applications an excessively high content of % Nb is rather detrimental. In different embodiments, % Nb is less than 0.29% by weight, less than 0.124% by weight, less than 0.19% by weight, less than 0.14% by weight, less than 0.09% by weight and even less than 0.01% by weight. Obviously, there are cases where the desired nominal content is 0% by weight or nominal absence of the element as occurs with all optional elements for certain applications.

It has been found that for some applications the presence of chromium (% Cr) is desirable while yet for other applications it is rather an impurity. For example in some systems % Cr increases the concentration of atomic placement defects on carbides, when properly manufactured. This can be an advantage in some applications and a disadvantage in others. In different embodiments. % Cr is 0.001% by weight or higher, 0.01% by weight or higher, 0.12% by weight or higher, 0.63% by weight or higher, 0.84% by weight or higher, and even 1.16% by weight or higher. In contrast, in some applications an excessively high content of % Cr is rather detrimental. In different embodiments, % Cr is 1.9% by weight or less, less than 1.8% by weight, less than 1.4% by weight, less than 0.9% by weight, less than 0.56% by weight, less than 0.12% by weight, less than 0.09% by weight, less than 0.04% by weight and even less than 0.02% by weight. Obviously, there are cases where the desired nominal content is 0% by weight or nominal absence of the element as occurs with all optional elements for certain applications.

It has been found that for some applications the presence of nickel (% Ni) is desirable while yet for other applications it is rather an impurity. For example % Ni can increase toughness but also decrease it depending on final microstructure. It has been found that % Ni sometimes affects both the ferritic and bainitic hardenability but in a different way depending on concentration of other elements and processing. In different embodiments, % Ni is 0.001% by weight or higher, 0.09% by weight or higher, 0.12% by weight or higher, 0.22% by weight or higher, 0.32% by weight or higher, 0.36% by weight or higher, 0.41% by weight or higher, 0.58% by weight or higher, 0.69% by weight or higher and even 0.81% by weight or higher. In contrast, in some applications an excessively high content of % Ni is rather detrimental. In different embodiments, % Ni is less than 1.2% by weight, less than 0.9% by weight, less than 0.8% by weight, less than 0.44% by weight, lees than 0.38% by weight, less than 0.24% by weight, and even less than 0.14% by weight. Obviously, there are cases where the desired nominal content is 0% by weight or nominal absence of the element as occurs with all optional elements for certain applications.

It has been found that for some applications the presence of silicon (% Si) is desirable while yet for other applications it is rather an impurity. In different embodiments, % Si is 0.001% by weight or higher, 0.02% by weight or higher, 0.16% by weight or higher, 0.22% by weight or higher and even 0.31% by weight or higher. In contrast, in some applications an excessively high content of % Si is rather detrimental. In different embodiments, % Si is less than 0.44% by weight, less than 0.28% by weight, less than 0.14% by weight, less than 0.09% by weight less than 0.08% by weight and even less than 0.04% by weight. Obviously, there are cases where the desired nominal content is 0% by weight or nominal absence of the element as occurs with all optional elements for certain applications.

It has been found that for some applications the presence of manganese (% Mn) is desirable while yet for other applications it is rather an impurity. For example % Mn can increase toughness but also decrease it depending on final microstructure. It has been found that % Mn sometimes affects both the ferritic and bainitic hardenability but in a different way depending on concentration of other elements and processing. In some applications it has surprisingly found that % Mn strongly affects the toughness in a positive way for microstructures containing bainite and pro-eutectoid carbides. In different embodiments, % Mn is 0.001% by weight or higher, 0.03% by weight or higher, 0.23% by weight or higher, 0.36% by weight or higher, 0.46% by weight or higher, 0.56% by weight or higher, 0.64% by weight or higher, 0.81% by weight or higher and even 1.16% by weight or higher. In contrast, in some applications an excessively high content of % Mn is rather detrimental. In different embodiments, % Mn is less than 0.9% by weight, less than 0.74% by weight, less than 0.54% by weight, less than 0.44% by weight, less than 0.3% by weight, less than 0.19% by weight and even less than 0.09% by weight. Obviously, there are cases where the desired nominal content is 0% by weight or nominal absence of the element as occurs with all optional elements for certain applications.

It has been found that for some applications the presence of molybdenum (% Mo) is desirable while yet for other applications should be limited. In different embodiments, % Mo is 0.01% by weight or higher, 0.24% by weight or higher, 0.67% by weight or higher, 0.84% by weight or higher, 1.12% by weight or higher, 1.62% by weight or higher, and even 1.82% by weight or higher. In contrast, in some applications an excessively high content of % Mo is rather detrimental. In different embodiments, % Mo is less than 2.6% by weight, less than 2.2% by weight, less than 1.9% by weight, less than 1.78% by weight, less than 1.3% by weight, less than 0.98% by weight, less than 0.8% by weight, and even less than 0.44% by weight. Obviously, there are cases where the desired nominal content is 0% by weight or nominal absence of the element as occurs with all optional elements for certain applications.

It has been found that in some applications the steels benefit from having a higher content of equivalent molybdenum (% $Mo_{eq}$, being % $Mo_{eq}$=% $Mo_{eq}$+½*% W). In different embodiments, % $Mo_{eq}$ is 0.02% by weight or higher, 0.44% by weight or higher, 0.72% by weight or higher, 0.87% by weight or higher, 1.04% by weight or higher, 1.32% by weight or higher, 1.82% by weight or higher, and even 2.02% by weight or higher. In contrast, in some applications an excessively high content of % $Mo_{eq}$ is rather detrimental. In different embodiments, % $Mo_{eq}$ is less than 2.4% by weight, less than 1.9% by weight, less than 1.7% by weight, less than 1.4% by weight, less than 1.19% by weight, less than 1.14% by weight, less than 1.1% by weight, less than 0.78% by weight, less than 0.6% by weight, and even less than 0.24% by weight.

It has been found that for some applications the presence of tungsten (% W) is desirable while yet for other applications it is rather an impurity. In different embodiments, % W is 0.003% by weight or higher, 0.02% by weight or higher, 0.22% by weight or higher, 0.24% by weight or higher, 0.61% by weight or higher, 0.89% by weight or higher, 1.14% by weight or higher, and even 1.62% by weight or higher. In contrast, in some applications an excessively high content of % W is rather detrimental. In different embodiments, % W is less than 2.8% by weight, less than 2.4% by weight, less than 1.9% by weight, less than 1.3% by weight, less than 0.8% by weight, less than 0.41% by weight and even less than 0.09% by weight. Obviously, there are cases where the desired nominal content is 0% by weight or nominal absence of the element as occurs with all optional elements for certain applications.

It has been found that for some applications the presence of titanium (% Ti) is desirable while yet for other applications it is rather an impurity. In different embodiments, % Ti is 0.001% by weight or higher, 0.006% by weight or higher, 0.01% by weight or higher, 0.03% by weight or higher, 0.16% by weight or higher, 0.29% by weight or higher and even 0.61% by weight or higher. In contrast. In some applications an excessively high content of % Ti is rather detrimental. In different embodiments, % Ti is less than 0.9% by weight, less than 0.8% by weight, less than 0.39% by weight, less than 0.09% by weight and even less than 0.01% by weight. Obviously, there are cases where the desired nominal content is 0% by weight or nominal absence of the element as occurs with all optional elements for certain applications.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.04% by weight or higher, 0.12% by weight or higher, and even 0.26% by weight or higher. In contrast, in some applications an excessively high content of % Zr is rather detrimental. In different embodiments, % Zr is less than 0.7% by weight, less than 0.43% by weight, less than 0.16% by weight, less than 0.02% by weight, and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.01% by weight or higher, 0.18% by weight or higher, 0.42% by weight or higher, 0.62% by weight or higher, and even 0.81% by weight or higher. In contrast, in some applications an excessively high content of % Co is rather detrimental. In different embodiments, % Co is less than 1.9% by weight, less than 1.3% by weight, less than 0.8% by weight, less than 0.4% by weight, and even less than 0.12% by weight. Obviously, there are cases where the desired nominal content is 0% by weight or nominal absence of the element as occurs with all optional elements for certain applications.

It has been found that for some applications the presence of vanadium (% V) is desirable while yet for other applications it is rather an impurity. In different embodiments, % V is 0.002% by weight or higher, 0.007% by weight or higher, 0.01% by weight or higher, 0.02% by weight or higher, 0.09% by weight or higher, 0.16% by weight or higher, and even by weight 0.21% by weight or higher. In contrast, in some applications an excessively high content of % V is rather detrimental. In different embodiments, % V is less than 0.34% by weight, less than 028% by weight, less than 0.19% by weight, less than 0.12% by weight, less than 0.08% by weight, less than 0.02% by weight, and even less than 0.001% by weight. Obviously, there are cases where the desired nominal content is 0% by weight or nominal absence of the element as occurs with all optional elements for certain applications.

It has been found that for some applications the presence of copper (% Cu) is desirable while yet for other applications it is rather an impurity. In different embodiments, % Cu is 0.0001% by weight or higher, 0.003% by weight or higher, 0.02% by weight or higher, 0.04% by weight or higher, 0.09% by weight or higher, 0.12% by weight or higher, 0.36% by weight or higher, and even 0.73% by weight or higher. In contrast, in some applications an excessively high content of % Cu is rather detrimental, in different embodiments, % Cu is less than 1.4% by weight, less than 1.2% by weight, less than 0.6% by weight, less than 0.28% by weight, less than 0.01% by weight, less than 0.002% by weight, and even less than 0.001% by weight. Obviously, there are cases where the desired nominal content is 0% by weight or nominal absence of the element as occurs with all optional elements for certain applications.

The inventor has found that the sum of % Al+% Ti+% Ta+% Zr+% Hf+% V+% Nb+% Cu+% La+% Ce+% Nd+% Gd+% Sm+% Y+% Pr+% Sc+% Eu+% Cs can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Eu+% Cs is 1.9% by weight or less, 1.4% by weight or less, 0.9% by weight or less 0.4% by weight or less and even 0.1% by weight or less. In different embodiments, % Al+% Ti+% Ta+% Zr+% Hf+% V+% Nb+% Cu+% La+% Ce+% Nd+% Gd+% Sm+% Y+% Pr+% Sc+% Eu+% Cs is 0.002% by weight or more, 0.11% by weight or more, 0.41% by weight or more, 0.71% by weight or more and even 1.01% by weight or more.

The inventor has found that the sum of % Al+% Ta+% Hf+% V+% Nb+% Cu+% La+% Ce+% Nd+% Gd+% Sm+% Y+% Pr+% Sc+% Eu+% Cs can be of importance for some applications, and different levels are desirable for different embodiments. In different embodiments, % Al+% Ta+% Hf+% V+% Nb+% Cu+% La+% Ce+% Nd+% Gd+% Sm+% Y+% Pr+% Sc+% Eu+% Cs is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Eu+% Cs is 0.002% by weight or more, 0.02% by weight or more, 0.12% by weight or more and even 0.21% by weight or more.

The inventor has found that the sum of % Ni+% Mn+% Si can be of importance for some applications, and different levels are desirable for different embodiments. In different embodiments, % Ni+% Mn+% Si is 0.04% by weight or more, above 0.04% by weight, above 0.11% by weight, above 0.16% by weight, above 0.21% by weight, above 0.41% by weight, above 0.51% by weight and even above 0.66% by weight. For some applications and excessive value of the sum of these elements can be detrimental. In different embodiments, % Ni+% Mn+% Si is 1.9% by weight or less, below 1.9% by weight, below 1.4% by weight, below 0.9% by weight, below 0.78% by weight, below 0.58% by weight and even below 0.47% by weight. All the upper and lower limits disclosed in the different embodiments can be combined in any combination provided they are not mutually exclusive, for example % Ni+% Mn+% Si=0.04-1.9% by weight.

The inventor has found that the sum of % Ni+% Mn can be of importance for some embodiments and different levels are desirable for different applications. In different embodiments, % Ni+% Mn is 0.04% by weight or more, 0.12% by weight or more, 0.21% by weight or more, 0.3% by weight or more, 0.41% by weight or more, 0.42% by weight or more, 0.51% by weight or more and even 0.66% by weight or more. For some applications and excessive value of the sum of these elements can be detrimental. In different embodiments, % Ni+% Mn is 1.9% by weight or less, 1.4% by weight or less, 1.2% by weight or less, 0.9% by weight or less, 0.78% by weight or less and even 0.58% by weight or less. All the upper and lower limit disclosed in the different embodiments can be combined in any combination provided they are not mutually exclusive, for example % Ni+% Mn=0.3-1.9% by weight.

It has been found that for some of the steels of the present invention to assure homogeneous toughness in large cross sections, the following has to be true: HTLC*% N≤% Ni+% Mn≤(% C−% N)*ATLS. In an embodiment, HTLC is 10. In another embodiment, HTLC is 20. In another embodiment, HTLC is 30. In another embodiment, HTLC is 40. In another embodiment, HTLC is 50 and even in some embodiments, HTLC is 70. In an embodiment, ATLS is 5. In another embodiment, ATLS is 6. In another embodiment, ATLS is 7. In another embodiment, ATLS is 8. In another embodiment, ATLS is 9. In another embodiment, ATLS is 12, and even in some embodiments, ATLS is 19. All the above disclosed embodiments can be combined in any combination provided they are not mutually exclusive, for example: 20*% N≤% Ni+% Mn≤(% C−% N)*7.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is preferred. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

The inventor has found that for some applications a certain relation between % $Mo_{eq}$, % Mn and % Ni content is preferred, and different levels are desirable for different applications. In different embodiments, (% $Mo_{eq}$)/(% Mn+% Ni) is 0.3% by weight or more, 0.5% by weight or more, 0.7% by weight or more, 0.8% by weight or more, 0.9% by weight or more, 1.8% by weight or more and even 2.5% by weight or more. For some applications and excessive value of (% $Mo_{eq}$)/(% Mn+% Ni) can be detrimental. In different embodiments, (% $Mo_{eq}$)(% Mn+% Ni) is 21% by weight or less, 16% by weight or less, 12% by weight or less, 10% by weight or less, 8% by weight or less, and even 4.9% by weight or less. All the upper and lower limit disclosed in the different embodiments can be combined in any combination provided they are not mutually exclusive, for example (% $Mo_{eq}$)(% Mn+% Ni)=0.7-10% by weight or (% $Mo_{eq}$)/(% Mn+% Ni)=0.7-4.9% by weight.

In different embodiments, the microstructure of the steel is characterized by a thermal diffusivity at room temperature which is at least 8 $mm^2/s$, at least 9.6 $mm^2/s$, at least 10.6 $mm^2/s$, at least 11.2 $mm^2/s$, at least 12.1 $mm^2/s$, and even at least 13 $mm^2/s$. The inventor has found that in some applications wherein the microstructure has a particularly low content of scattering atomic arrangement defects, the microstructure of the steel is characterized by higher thermal diffusivity values at room temperature, in different embodiments, the microstructure is characterized by a thermal diffusivity at room temperature which is at least 13.6 $mm^2/s$, at least 14.6 $mm^2/s$, at least 15.2 $mm^2/s$, at least 16.2 $mm^2/s$, at least 16.6 $mm^2/s$, at least 17.01 $mm^2/s$, and even at least 18 $mm^2/s$. In an embodiment, the thermal diffusivity is measured at room temperature by means of the Flash Method. In an embodiment, the thermal diffusivity is measured at room temperature according to ASTM-E1481-13. In an embodiment, the thermal diffusivity can alternatively be measured at room temperature according to ASTM-E2585-09(2015).

In an embodiment, the steel presents a microstructure comprising at least 26% bainite, at least 46% balnite, at least 62% bainite, at least 76% bainite, at least 82% bainite and even at least 92% bainite. In an embodiment, the above disclosed percentages of bainite are by volume.

For some applications, a steel having a microstructure comprising high temperature bainite is preferred. In this document high temperature bainite refers to any microstructure formed at temperatures above the temperature corresponding to the bainite nose in the TTT diagram but below the temperature where the ferritic/perlitic transformation ends, but it excludes lower balnite as referred in the literature, which can occasionally form in small amounts also in isothermal treatments at temperatures above the one of the bainitic nose. In an embodiment, high temperature bainite is at least 20%. In another embodiment, high temperature bainite is at least 31%. In another embodiment, high temperature bainite is at least 41%. In another embodiment, high temperature bainite is at least a 51%. In another embodiment, high temperature bainite is at least 66%. In another embodiment, high temperature balnite is at least a 76%. In another embodiment, high temperature bainite is at least 86%. In another embodiment, high temperature balnite is at least 91%. In another embodiment, high temperature bainite is at least 96%. In an embodiment, high temperature bainite is 100%. In an embodiment, all the balnite is high temperature balnite. In some applications, the percentage of high temperature bainite should be limited. In an embodiment, high temperature bainite is les than 96%. In another embodiment, high temperature bainite is less than 89%. In another embodiment, of high temperature bainite is less than 79%. In another embodiment, of high temperature bainite is less than 69%. In another embodiment, high temperature bainite is less than 59%. In another embodiment, high temperature bainite is less than 49%. In an embodiment, the above disclosed percentages of high temperature bainite are by volume. All the embodiments disclosed above can be combined in any combination, provided that they are not mutually exclusive, for example, a steel wherein the high temperature bainite is at least a 20% by volume.

It has been found with surprise, that in the steels of the present invention, for some applications, the microstructures that are reported as undesirable in the literature are for those applications very advantageous. In this sense, for some applications, the microstructures resulting from the decomposition of austenite at high temperatures are preferred. In fact, the range of preferred microstructures for those applications is rather concrete resulting in narrow process windows. In different embodiments, the microstructure should be composed at least by 26% or more of HTSM microstructure, at least by 52% or more of HTSM microstructure, at least by 86% or more of HTSM microstructure, at least by 76% or more of HTSM microstructure, at least by 86% or more of HTSM microstructure, at least by 92% or more of HTSM microstructure, at least by 96% or more of HTSM microstructure and even in some embodiments, the microstructure should be completely composed of HTSM microstructure. In different embodiments, the amount of LTSM should be 48% or less, 24% or less, 18% or less, 8% or less, 4% or less and even in some embodiments, the amount of LTSM should be inappreciable. In different embodiments, the amount of UHTSM should be 48% or less, 24% or less, 14% or less, 8% or less, 3% or less and even in some embodiments, the amount of UHTSM should be inappreciable. In an embodiment, the above disclosed percentages are by volume. In an embodiment, HTSM microstructure is a microstructure with a transformation temperature between (Ac1+Ac3)/2+20° C. and (Bs+Bf)/2. Bs and Bf refer to the balnite start and bainite finish transformation temperatures respectively. In another embodiment, HTSM microstructure is a microstructure with a transformation temperature between (Ac1+Ac3)/2 and (Bs+Bf)/2. In another embodiment, HTSM microstructure is a microstructure with a transformation temperature between Ac1−20K and (Bs+Bf)/2. In another embodiment, HTSM microstructure is a microstructure with a transformation temperature between Ac1−20K and (Bs+Bf)/2+10K. In an embodiment, the microstructure associated with a transformation temperature is extracted from a Constant Temperature Transformation (TTT) diagram where the austenitization temperature is Ae3+5K. In another embodiment, the microstructure associated with a transformation temperature is extracted from a TTT diagram where the austenitization temperature is Ae3+20K. In another embodiment, the microstructure associated with a transformation temperature is extracted from a TTT diagram where the austenitization temperature is Ae3+50K. In another embodiment, the microstructure associated with a transformation temperature is extracted from a TTT diagram where the austenitization temperature is Ae3+100K in another embodiment, the microstructure associated with a transformation temperature is extracted from TTT diagram where the austenitization temperature is Ae1+10K in another embodiment, the austenitization time at the austenitization temperature to construct the TTT diagram is 30 minutes. In an embodiment, the austenitization time at the austenitization temperature to construct the TTT diagram is 1 hour. In an embodiment, the microstructure associated with a transformation temperature is extracted from a Continuous Cooling Transformation (CCT) diagram where the austenitization temperature is Ae3+5K and the cooling rate is 5K/min. In another embodiment, the microstructure associated with a transformation temperature is extracted from a CCT diagram where the austenitization temperature is Ae3+5K and the cooling rate is 3K/min. In another embodiment, the microstructure associated with a transformation temperature is extracted from a CCT diagram where the austenitization temperature is Ae3+20K and the cooling rate is 5K/min. In another embodiment, the microstructure associated with a transformation temperature is extracted from a CCT diagram where the austenitization temperature is Ae3+20K and the cooling rate is 3K/min. In another embodiment, the microstructure associated with a transformation temperature is extracted from a CCT diagram where the austenitization temperature is Ae3+100K and the cooling rate is 5K/min. In another embodiment, the microstructure associated with a transformation temperature is extracted from a CCT diagram where the austenitization temperature is Ae3+100K and the cooling rate is 3K/min. In an embodiment, the austenitization time at the austenitization temperature to construct the CCT diagram is 30 minutes. In another embodiment, the austenitization time at the austenitization temperature to construct the CCT diagram is 1 hour. In an embodiment, LTSM microstructure is a microstructure with a transformation temperature below Bf. In another embodiment, LTSM microstructure is a microstructure with a transformation temperature below Bf−20K. In another embodiment, LTSM microstructure is a microstructure with a transformation temperature below Ms. Ms refers to the martensite start transformation temperature. In another embodiment, LTSM microstructure is a microstructure with a transformation temperature below Ms−10K. In an embodiment, UHTSM microstructure is a microstructure with a transformation temperature above Ac1−20K. In another embodiment, UHTSM microstructure is a microstructure with a transformation temperature above Ac. In another embodiment, UHTSM microstructure is a microstructure with a transformation temperature above Ac1+10K. In another embodiment, UHTSM microstructure is a microstructure with a transformation temperature above Ac1+20K. In another embodiment, UHTSM microstructure is a microstructure with a transformation temperature above (Ac1+Ac3)/2. In another embodiment, UHTSM microstructure is a microstructure with a transformation temperature above (Ac1+Ac3)/2+20K. All the above embodiments can be combined in any combination provided that they are not mutually exclusive.

For some applications, more interesting than controlling the microstructure is to control the cooling rates applied after the last at least partial austenization of the material. The material might undergo several heat treatments involving at least partial austenization, but it has been found that for some applications the cooling rate applied in the last one should be purposefully adjusted, that does not mean that for some of those applications the intentional monitoring of other preceding heat treatments cooling raters can also be advantageous. In different embodiments, the last heat treatment involving at least partial austenization of the material involves a mean cooling rate between the austenitization temperature and RET of 19K/min or less, a mean cooling rate between the austenitization temperature and RET of 9K/min or less, a mean cooling rate between the austenitization temperature and RET of 6K/min or less, a mean cooling rate between the austenitization temperature and RET of 4.9K/min or less, a mean cooling rate between the austenitization temperature and RET of 3.9K/min or less, a mean cooling rate between the austenitization temperature and RET of 2.9K/min or less and even in some embodiments, the last heat treatment involving at least partial austenization of the material involves a mean cooling rate between the austenitization temperature and RET of 0.9K/min or less. In an embodiment, any isothermal holding is discounted when measuring the mean cooling rate. In an embodiment, an isothermal holding is any portion of the cooling diagram where the cooling rate is 2 times slower than the mean, 3 times slower than the mean. In another embodiment, an isothermal holding is any portion of the cooling diagram where the cooling rate is 5 times slower than the mean. In another embodiment, an isothermal holding is any portion of the cooling diagram where the cooling rate is 10 times slower than the mean and even in some embodiments, an isothermal holding is any portion of the cooling diagram where the cooling rate is 15 times slower than the mean. In some applications there is also a desirable lower limit for this portion of the cooling. In an embodiment, the last heat treatment involving at least partial austenization of the material involves a mean cooling rate between the austenitization temperature and RET of 0.06K/min or more. In another embodiment, the last heat treatment involving at least partial austenization of the material involves a mean cooling rate between the austenitization temperature and RET of 0.2K/min or more. In another embodiment, the last heat treatment involving at least partial austenization of the material involves a mean cooling rate between the austenitization temperature and RET of 0.6K/min or more. In another embodiment, the last heat treatment involving at least partial austenization of the material involves a mean cooling rate between the austenitization temperature and RET of 1.1K/min or more. In another embodiment, the last heat treatment involving at least partial austenization of the material involves a mean cooling rate between the austenitization temperature and RET of 2.2K/min or more. In another embodiment, the last heat treatment involving at least partial austenization of the material involves a mean cooling rate between the austenitization temperature and RET of 3.3K/min or more and even in some embodiments, the last heat treatment involving at least partial austenization of the material involves a mean cooling rate between the austenitization temperature and RET of 4.4K/min or more. In an embodiment, the mean cooling rate between RET2 and RET3 is at least a 20% slower than between austenitization and RET. In another embodiment, the mean cooling rate between RET2 and RET3 is at least a 52% slower than between austenitization and RET. In another embodiment, the mean cooling rate between RET2 and RETS is at least a 76% slower than between austenitization and RET. In another embodiment, the mean cooling rate between RET2 and RET3 is at least half as fast as between austenitization and RET. In another embodiment, the mean cooling rate between RET2 and RET3 is at least a fourth as fast as between austenitization and RET. In an embodiment, the mean cooling rate between RET2 and RET3 is no more than 5 times slower than between austenitization and RET. In another embodiment, the mean cooling rate between RET2 and RET3 is no more than 3 times slower than between austenitization and RET. In another embodiment, the mean cooling rate between RET2 and RET3 is no more than 2 times slower than between austenitization and RET. In an embodiment, the last heat treatment involving at least partial austenization of the material involves a mean cooling rate between RET2 and RET3 of 13K/min or less. In another embodiment, the last heat treatment involving at least partial austenization of the material involves a mean cooling rate between RET2 and RET3 of 8K/min or less. In another embodiment, the last heat treatment involving at least partial austenization of the material involves a mean cooling rate between RET2 and RET3 of 4.4K/min or less. In another embodiment, the last heat treatment involving at least partial austenization of the material involves a mean cooling rate between RET2 and RET3 of 3.9K/min or less and even in some embodiments, the last heat treatment involving at least partial austenization of the material involves a mean cooling rate between RET2 and RET3 of 2.9K/min or less. In some applications the cooling rate should not be excessively low. In an embodiment, the last heat treatment involving at least partial austenization of the material involves a mean cooling rate between RET2 and RET3 of 0.05K/min or more. In another embodiment, the last heat treatment involving at least partial austenization of the material involves a mean cooling rate between RET2 and RET3 of 0.5K/min or more. In another embodiment, the last heat treatment involving at least partial austenization of the material involves a mean cooling rate between RET2 and RET3 of 1.1K/min or more. In an embodiment, any isothermal holding is discounted when measuring the mean cooling rate in the same terms as described above in this paragraph. In an embodiment, the last heat treatment involving at least partial austenization of the material involves a mean cooling rate between RET2 and RET3 of no less than 0.04K/min. In another embodiment, the last heat treatment involving at least partial austenization of the material involves a mean cooling rate between RET2 and RET3 of no less than 0.4K/min. In another embodiment, the last heat treatment involving at least partial austenization of the material involves a mean cooling rate between RET2 and RET3 of no less than 1.1K/min. Definition of the RET, RET2 and RET3 temperatures might be different for different applications. In an embodiment, RET refers to (Ac3+Bs)/2. In another embodiment, RET refers to Ac3−20K. In another embodiment, RET refers to Ac3−50K in another embodiment, RET refers to (Ac3+Ac1)/2−70K. In another embodiment, RET refers to (Ac3+Ac1)/2−130K. In another embodiment, RET refers to Bs+150K. In another embodiment, RET refers to Bs+80K. In another embodiment, RET refers to Bs+20K. In another embodiment, RET, refers to 7300° C. In another embodiment, RET refers to 730° C. In another embodiment, RET refers to 680° C. In another embodiment, RET, refers to 660° C. In another embodiment, RET refers to 600° C. In another embodiment, RET refers to 560° C. In another embodiment, RET2 refers to (Ac3+Bs)/2. In another embodiment, RET2 refers to (Ac3+Bs)/2−20K. In another embodiment, RET2 refers to (Ac3+Bs)/2−80K. In another embodiment, RET2 refers to Ac3−40K. In another embodiment, RET2 refers to Ac3−150K in another embodiment, RET2 refers to (Ac3+Ac1)/2−130K. In another embodiment, RET2 refers to (Ac3+Ac1)/2−150K. In another embodiment, RET2 refers to Bs+100K. In another embodiment, RET2 refers to Bs+120K. In another embodiment, RET2 refers to Bs+50K. In another embodiment, RET2, refers to 640° C. In another embodiment, RET2, refers to 610° C. In another embodiment, RET2, refers to 580° C. In another embodiment, RET2, refers to 520° C. In an embodiment, RET3 refers to (Bf+Bs)/2. In another embodiment, RET3 refers to (Bf+Bs)/2−20K. In another embodiment, RET3 refers to (Bf+Ms)/2. In another embodiment, RET3 refers to (Bf+Ms)/2+20K. In another embodiment, RET3 refers to (Bf+Ms)/2−20K. In another embodiment, RET3 refers to Ms. In another embodiment, RET3 refers to (Mf+Ms)/2. In another embodiment, RET3 refers to 480° C. In another embodiment, RET3 refers to 440° C. In another embodiment, RET3 refers to 380° C. In another embodiment, RET3 refers to 320° C. In another embodiment, RET3 refers to 250° C. All the above disclosed embodiments can be combined in any combination provided that they are not mutually exclusive.

In some applications it is challenging to attain an optically pleasant microstructure which at the same time provides a good combination of mechanical properties for some steels of the present invention. It has been found with great surprise that this can be more easily obtained by making an interruption in the cooling process which involves a temperature increase, provided the temperatures, cooling/heating rates and permanence times are well chosen. In an embodiment, the treatment comprises a step in which the cooling from RET (as previously described) is interrupted at RIT. In an embodiment, the temperature is furthermore hold somewhat constant around RIT for a period of tRIT. In an embodiment, the heat treatment further comprises a step in which temperature is raised from RIT to HIT. In an embodiment, the heating rate from RIT to HIT is controlled. In an embodiment, the temperature is further kept somewhat constant around HIT for a period of tHIT. In an embodiment, the temperature is further lowered from HIT to RIT2. In an embodiment, the temperature is lowered from HIT to RIT2 in a controlled way. In an embodiment, RIT is 698° C. or less. In another embodiment, RIT is 598° C. or less. In another embodiment, RIT is 498° C. or less. In another embodiment, RIT is 448° C. or less. In another embodiment, RIT is 398° C. or less. In an embodiment, RIT should not be less than 150° C. In another embodiment, RIT should not be less than 250° C. In another embodiment, RIT should not be less than 350° C. In another embodiment, RIT should not be less than 450° C. In another embodiment, RIT should not be less than 502° C. In an embodiment, tRIT is 12 minutes or more. In another embodiment, tRIT is 31 minutes or more. In another embodiment, tRIT is 62 minutes or more. In another embodiment, tRIT is 92 minutes or more. In another embodiment, tRIT is 6 hours or more. In another embodiment, tRIT is 12 hours or more. In an embodiment, tRIT should not be more than 47 hours. In another embodiment, tRIT should not be more than 19 hours. In another embodiment, tRIT should not be more than 9 hours. In an embodiment, tRIT should not be more than 110 minutes. In another embodiment, tRIT should not be more than 50 minutes. In an embodiment, the cooling rate between RET to RIT should not exceed 19K/min. In another embodiment, the cooling rate between RET to RIT should not exceed 13K/min. In another embodiment, the cooling rate between RET to RIT should not exceed 7.9K/min. In another embodiment, the cooling rate between RET to RIT should not exceed 4.4K/min. In another embodiment, the cooling rate between RET to RIT should not exceed 3.9K/min. In another embodiment, the cooling rate between RET to RIT should not exceed 2.9K/min. In some applications the cooling rate should not be excessively low. In an embodiment, the cooling rate between RET to RIT should exceed 0.05K/min. In another embodiment, the cooling rate between RET to RIT should exceed 0.5K/min. In another embodiment, the cooling rate between RET to RIT should exceed 1.1K/min. In an embodiment, the cooling rate between RET to RIT should exceed 2.1K/min. In an embodiment, HIT is 401° C. or more. In another embodiment, HIT is 451° C. or more. In another embodiment, HIT is 502° C. or more. In another embodiment, HIT is 552° C. or more. In another embodiment, HIT is 602° C. or more. In another embodiment, HIT is 632° C. or more. In another embodiment, HIT is 652° C. or more. In another embodiment, HIT is 682° C. or more. In another embodiment, HIT is 702° C. or more. In an embodiment, HIT is 890° C. or less. In another embodiment, HIT is 790° C. or less. In another embodiment, HIT is 740° C. or less. In another embodiment, HIT is 690° C. or less. In another embodiment, HIT is 640° C. or less. In an embodiment, the heating rate between RIT to HIT should not exceed 19K/min. In another embodiment, the heating rate between RIT to HIT should not exceed 13K/min. In another embodiment, the heating rate between RIT to HIT should not exceed 7.9K/min. In another embodiment, the heating rate between RIT to HIT should not exceed 4.4K/min. In another embodiment, the heating rate between RIT to HIT should not exceed 3.9K/min. In another embodiment, the heating rate between RIT to HIT should not exceed 2.9K/min. In some applications the heating rate should not be excessively low. In an embodiment, the heating rate between RIT to HIT should exceed 0.05K/min. In another embodiment, the heating rate between RIT to HIT should exceed 0.5K/min. In another embodiment, the heating rate between RIT to HIT should exceed 1.1K/min. In another embodiment, the heating rate between RIT to HIT should exceed 2.1K/min. In an embodiment, tHIT is 12 minutes or more. In another embodiment, tHIT is 31 minutes or more. In another embodiment, tHIT is 62 minutes or more. In another embodiment, tHIT is 92 minutes or more. In another embodiment, tHIT is 6 hours or more. In another embodiment, tHIT is 12 hours or more. In an embodiment, tHIT should not be more than 47 hours. In another embodiment, tHIT should not be more than 19 hours. In another embodiment, tHIT should not be more than 9 hours. In another embodiment, tHIT should not be more than 110 minutes. In another embodiment, tHIT should not be more than 50 minutes. In an embodiment, RIT2 is 598° C. or less. In another embodiment, RIT2 is 498° C. or less. In another embodiment, RIT2 is 398° C. or less. In another embodiment, RIT2 is 298° C. or less. In another embodiment, RIT2 is 198° C. or less. In an embodiment, RIT2 should not be less than 50° C. In another embodiment, RIT2 should not be less than 102° C. In another embodiment, RIT2 should not be less than 150° C. In another embodiment, RIT2 should not be less than 350° C. In another embodiment, RIT2 should not be less than 502° C. In some applications the cooling can continue until the extraction from the furnace or even an undercooling might be interesting for some applications. In an embodiment, RIT2 does not have a lower limit. In some applications what is important is the difference of temperature between HIT and RIT2. In an embodiment, HIT-RIT2 should be 52° C. or more. In another embodiment, HIT-RIT2 should be 102° C. or more. In another embodiment, HIT-RIT2 should be 152° C. or more. In another embodiment, HIT-RIT2 should be 252° C. or more. In another embodiment, HIT-RIT2 should be 352° C. or more. In an embodiment, the cooling rate between HIT to RIT2 should not exceed 13K/min. In another embodiment, the cooling rate between HIT to RIT2 should not exceed 7.9K/min. In another embodiment, the cooling rate between HIT to RIT2 should not exceed 4.4K/min. In another embodiment, the cooling rate between HIT to RIT2 should not exceed 3.9K/min. In another embodiment, the cooling rate between HIT to RIT2 should not exceed 2.9K/min. In some applications the cooling rate should not be excessively low. In an embodiment, the cooling rate between HIT to RIT2 should exceed 0.05K/min. In another embodiment, the cooling rate between HIT to RIT2 should exceed 0.5K/min. In another embodiment, the cooling rate between HIT to RIT2 should exceed 1.1K/min. In another embodiment, the cooling rate between HIT to RIT2 should exceed 2.1K/min. All the above disclosed embodiments can be combined in any combination provided that they are not mutually exclusive.

All the upper and lower limits disclosed in the different embodiments can be combined in any combination provided they are not mutually exclusive.

A preferred embodiment of the hot work and/or plastic injection moulding tool steel disclosed in preceding paragraphs is a steel having the following composition, all percentages being in weight percentage (% wt):

| | | | |
|---|---|---|---|
| % $C_{eq}$ = 0.15-0.55 | % C = 0.15-0.55 | % N = 0-0.3 | % B = 0-0.2 |
| % Cr = 0-1.9 | % Ni = 0-1.4 | % Si = 0-0.49 | % Mn = 0-1.4 |
| % Al = 0-0.5 | % Mo = 0-2.9 | % W = 0-2.9 | % Ti = 0-0.9 |
| % Ta = 0-0.3 | % Zr = 0-0.9 | % Hf = 0-0.3 | % V = 0-0.4 |
| % Nb = 0-0.3 | % Cu = 0-1.9 | % Co = 0-2 | % $Mo_{eq}$ = 0.6-2.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Cs = 0-0.3 | % Eu = 0-0.3 | | |

the rest consisting of iron and trace elements, wherein $$\% Ceq = \% C + 0.86 * \% N + 1.2 * \% B, \text{ and}$$

$$\% Mo_{eq} = \% Mo + \tfrac{1}{2} * \% W,$$

wherein % Ni+% Mn=0.3-1.9, wherein the steel presents a microstructure which is characterized by a thermal diffusivity at room temperature of at least 13 $mm^2/s$ measured according to international standard ASTM-E1461-13 by means of the Flash Method and wherein the microstructure comprises at least 76% by volume bainite.

Any embodiment disclosed in preceding paragraphs for the hot work and/or plastic injection moulding tool steel (including any lower and upper limit for the content of any element and/or their sum) can also be applied to this preferred embodiment, provided that they are not mutually exclusive.

In an embodiment, the invention refers to a steel, in particular a hot work and/or plastic injection moulding tool steel, having the following composition, all percentages being in weight percentage (% wt):

| | | | |
|---|---|---|---|
| % $C_{eq}$ = 0.21-0.34 | % C = 0.21-0.34 | % N = 0-0.1 | % B = 0-0.09 |
| % Cr = 0-1.4 | % Ni = 0-0.9 | % Si = 0-0.28 | % Mn = 0-0.98 |
| % Al = 0-0.1 | % Mo = 0-2.4 | % W = 0-1.9 | % Ti = 0-0.1 |
| % Ta = 0-0.1 | % Zr = 0-0.2 | % Hf = 0-0.1 | % V = 0-0.2 |
| % Nb = 0-0.1 | % Cu = 0-0.5 | % Co = 0-0.5 | % $Mo_{eq}$ = 1.1-2.4 |
| % La = 0-0.1 | % Ce = 0-0.1 | % Nd = 0-0.1 | % Gd = 0-0.1 |
| % Sm = 0-0.1 | % Y = 0-0.1 | % Pr = 0-0.1 | % Sc = 0-0.1 |
| % Cs = 0-0.1 | % Eu = 0-0.1 | | |

the rest consisting of iron and trace elements, wherein $$\% Ceq = \% C + 0.86 * \% N + 1.2 * \% B, \text{ and}$$

$$\% Mo_{eq} = \% Mo + \tfrac{1}{2} * \% W, \text{ and}$$

Trace elements refers to several elements, unless context clearly indicates otherwise, including but not limited to, H, He, Xe, F, Ne, Na, P, S, Cl, Ar, K, Br, Kr, Sr, Tc, Ru, Rh, Pd, Ag, I, Be, Re, Os, Ir, Pt, Au, Hg, Tl, Po, At, Rn, Fr, Ra, Ac, Pa, U, Np, Pu, Am, Cm, Bk, Cf, Es, Fm, Md, No, Lr, Rf, db, Sg, Bh, Hs, Pm, Tb, Dy, Ho, Er, Tm, Yb, Lu, O, Li, Be, Mg, Ca, Rb, Zn, Cd, Ga, In, Go, Sn, Pb, Bi, Sb, As, Se, Te, Th, Ds, Rg, Cn, Nh, Fl, Mc, Lv, Ts, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments, the sum of all trace elements in the steel is below 2.0% by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% Ceq). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % Ceq should not be too high. In different embodiments, % Ceq is 0.33% by weight or less, 0.32% by weight or less, 0.31% by weight or less, 0.29% by weight or less and even 0.28% by weight or less. Some applications, like sometimes applications requiring a rather good polishing ability in the tool steel or good weldability it is often interesting to keep even lower levels of % Ceq. In different embodiments, % Ceq is 0.27% by weight or less, 0.26% by weight or less, and even 0.25% by weight or less. In contrast, in some applications higher contents of % Ceq are preferred. In different embodiments, % Ceq is above 0.23% by weight, above 0.24% by weight, above 0.26% by weight, above 0.27% by weight and even above 0.31% by weight.

Different applications require different levels of carbon (% C). For some applications, % C should not be too high. In different embodiments, % C is 0.32% by weight or less, 0.31% by weight or less, 0.29% by weight or less, 0.28% by weight or less and even 0.27% by weight or less. Some applications, like sometimes applications requiring a rather good polishing ability in the tool steel or good weldability it is often interesting to keep even lower levels of % C. In different embodiments, % C is 0.26% by weight or less, 0.25% by weight or less, and even 0.24% by weight or less. In contrast, in some applications higher contents of % C are preferred. In different embodiments, % C is above 0.22% by weight, above 0.24% by weight, above 0.26% by weight, above 0.28% and even above 0.32% by weight.

It has been found that for some applications the presence of nitrogen (% N) is desirable while yet for other applications it is rather an impurity. In different embodiments. % N is 0.002% by weight or higher, 0.01% by weight or higher and even 0.09% by weight or higher. In contrast, in some applications an excessively high content of % N is rather detrimental. In different embodiments, % N is les than 0.09% by weight, less than 0.04% by weight, less than 0.01% by weight, less than 0.009% by weight, less than 0.0059% by weight, less than 0.0019% by weight, and even less than 0.00095% by weight. Obviously, there are cases where the desired nominal content is 0% by weight or nominal absence of the element as occurs with all optional elements for certain applications.

It has surprisingly been found that for some applications, a strict control on the level of % N leads to a marked improvement of the mechanical properties increasing both strength and toughness related properties. In an embodiment, % N is between 2 ppm and 190 ppm by weight. In different embodiments, the lower limit for the controlled % N content is 11 ppm by weight, 16 ppm by weight, 21 ppm by weight, 32 ppm by weight, 140 ppm by weight, and even 96 ppm by weight. In different embodiments, the upper limit for the controlled % N content is 68 ppm by weight, 48 ppm and even 33 ppm. In an embodiment, the upper limit for the controlled % N content is 19 ppm. In an embodiment, % N refers to total % N present. In another embodiment, % N refers only to free nitrogen. In another embodiment, % N refers to the nitrogen in sold solution at room temperature. In another embodiment, % N refers to the maximum nitrogen in solid solution during austenitization. In an embodiment, very special care is taken during the degassing of the material to assure the specially low % N levels specified in some of the embodiments in this application. In an embodiment, vacuum degassing is applied to the melt. In an embodiment, the vacuum degassing is performed with a vacuum level reaching $9*10^{-2}$ mbars at some point in the vacuum degassing process. In another embodiment, the vacuum degassing is performed with a vacuum level reaching $9*10^{-3}$ mbars at some point in the vacuum degassing process. In another embodiment, the vacuum degassing is performed with a vacuum level reaching $9*10^{-4}$ mbars at some point in the vacuum degassing process. In an embodiment, the melt is vacuum degassed during 31 minutes or more. In another embodiment, the melt is vacuum degassed during 46 minutes or more. In another embodiment, the melt is vacuum degassed during 61 minutes or more. In another embodiment, the melt is vacuum degassed during 91 minutes or more. In another embodiment, the melt is vacuum degassed during 121 minutes or more. This special care in keeping a low % N would be considered madness for such kind of alloys which normally address a very price sensitive market, but the inventor has found with great surprise that this extra cost can be compensated by the increase in properties.

In some applications it has been found that some alloying elements, affect the quantity of desirable % N, to better describe this effect, the concept of an equivalent nitrogen (% Neq) will be introduced:

$$\%\ Neq = \%\ N - \%\ Ti/3.4 - (\%\ Zr + \%\ Nb)/6.5 - (\%\ Hf + \%\ Ta)/12.7 - (\%\ AC + \%\ LA)/11.$$

Where % AC refers to the sum of actinides (% Ac+% Ti+% Pa+% U+% Np+% Pu+% Am+% Cm+% Bk+% Cf+% Es+% Fm+% Md+% No+% Lr).

And where % LA refers to the sum of lanthanides (% La+% Ce+% Pr+% Nd+% Pm+% Sm+% Eu+% Gd+% Tb+% Dy+% Ho+% Er+% Tm+% Yb+% Lu).

In an embodiment, % Neq is between 0.2 ppm and 140 ppm by weight. In different embodiments, the lower limit for the controlled % Neq content is 1.2 ppm by weight, 6 ppm by weight, 11 ppm by weight and even 22 ppm by weight. In different embodiments, the upper limit for the controlled % Neq content is 89 ppm by weight, 78 ppm by weight, 58 ppm by weight, 48 ppm by weight and even 28 ppm by weight. In an embodiment, the upper limit for the controlled % Neq content is 19 ppm. In an embodiment, the upper limit for the controlled % Neq content is 9 ppm.

In some applications it has been found that the % Neq has a combined effect with % Mn, % Ni and in some cases % Si. For such applications and to make understanding easier, the NMN parameter has been developed, where:

$$NMN = \%\ Mn + 1.7*\%\ Ni - 20*\%\ Neq;$$

In an embodiment, NMN is between 0.125 and 1.8. In an embodiment, the upper limit for the controlled NMN parameter is 1.4. In another embodiment, the upper limit for the controlled NMN parameter is 0.94. In another embodiment, the upper limit for the controlled NMN parameter is 0.74. In another embodiment, the upper limit for the controlled NMN parameter is 0.68. In another embodiment, the upper limit for the controlled NMN parameter is 0.49. In an embodiment, the lower limit for the controlled NMN parameter is 0.22. In another embodiment, the lower limit for the controlled NMN parameter is 0.32. In another embodiment, the lower limit for the controlled NMN parameter is 0.41. In another embodiment, the lower limit for the controlled NMN parameter is 0.52. In an embodiment, when NMN is 0.34 or larger, then % Si has to be 0.28% by weight or lower. In an embodiment, when NMN is 0.44 or larger, then % Si has to be 0.18% by weight or lower. In an embodiment, when NMN is 0.51 or larger, then % Si has to be 0.14% by weight or lower. In an embodiment, when NMN is 0.54 or larger, then % Si has to be 0.09% by weight or lower.

It has been found that for some applications the presence of boron (% B) is desirable while yet for other applications it is rather an impurity. In different embodiments, % B is above 1 ppm by weight, above 11 ppm by weight above 21 ppm by weight, above 31 ppm by weight, above 40 ppm by weight, 0.002% by weight or higher, 0.0032% by weight or higher, 0.009% by weight or higher and even 0.01% by weight or higher. In contrast, in some applications an excessively high content of % B is rather detrimental. In different embodiments, % B is less than 0.07% by weight, less than 0.065% by weight, less than 0.035% by weight, less than 0.009% by weight, less than 0.0058% by weight, less than 0.002% by weight and even less than 0.0004% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is 0.0001% by weight or higher, 0.001% by weight or higher, 0.004% by weight or higher, 0.03% by weight or higher and even 0.06% by weight or higher. In contrast, in some applications an excessively high content of % Nb is rather detrimental. In different embodiments, % Nb is less than 0.08% by weight, less than 0.02% by weight, less than 0.009% by weight, and even less than 0.001% by weight. Obviously, there are cases where the desired nominal content is 0% by weight or nominal absence of the element as occurs with all optional elements for certain applications.

It has been found that for some applications the presence of chromium (% Cr) is desirable while yet for other applications it is rather an impurity. For example in some systems % Cr increases the concentration of atomic placement defects on carbides, when property manufactured. This can be an advantage in some applications and a disadvantage in others. In different embodiments, % Cr is 0.001% by weight or higher, 0.01% by weight or higher, 0.12% by weight or higher, 0.63% by weight or higher, 0.84% by weight or higher, and even 1.16% by weight or higher. In contrast, in some applications an excessively high content of % Cr is rather detrimental. In different embodiments, % Cr is less than 1.2% by weight, less than 1.1% by weight, less than 0.9% by weight, les than 0.12% by weight, less than 0.09% by weight, less than 0.04% by weight and even less than 0.02% by weight. Obviously, there are cases where the desired nominal content is 0% by weight or nominal absence of the element as occurs with all optional elements for certain applications.

It has been found that for some applications the presence of nickel (% Ni) is desirable while yet for other applications it is rather an impurity. For example % Ni can increase toughness but also decrease it depending on final microstructure. It has been found that % Ni sometimes affects both the ferritic and bainitic hardenability but in a different way depending on concentration of other elements and processing. In different embodiments, % Ni is 0.001% by weight or higher, 0.12% by weight or higher, 0.22% by weight or higher, 0.32% by weight or higher, 0.36% by weight or higher, 0.41% by weight or higher, 0.58% by weight or higher, 0.61% by weight or higher and even 0.68% by weight or higher. In contrast, in some applications an excessively high content of % Ni is rather detrimental. In different embodiments, % Ni is less than 0.84% by weight, less than 0.8% by weight, lees than 0.49% by weight, less than 0.44% by weight, less than 024% by weight, and even less than 0.14% by weight. Obviously, there are cases where the desired nominal content is 0% by weight or nominal absence of the element as occurs with all optional elements for certain applications.

It has been found that for some applications the presence of silicon (% Si) is desirable while yet for other applications it is rather an impurity. In different embodiments, % Si is 0.001% by weight or higher, 0.02% by weight or higher, 0.09% by weight or higher, 0.12% by weight or higher and even 0.16% by weight or higher. In contrast, in some applications an excessively high content of % Si is rather detrimental. In different embodiments, % Si is less than 0.24% by weight, less than 0.19% by weight, less than 0.14% by weight, less than 0.09% by weight and even less than 0.04% by weight. Obviously, there are cases where the desired nominal content is 0% by weight or nominal absence of the element as occurs with all optional elements for certain applications.

It has been found that for some applications the presence of manganese (% Mn) is desirable while yet for other applications it is rather an impurity. For example % Mn can increase toughness but also decrease it depending on final microstructure. It has been found that % Mn sometimes affects both the ferritic and bainitic hardenability but in a different way depending on concentration of other elements and processing. In some applications it has surprisingly found that % Mn strongly affects the toughness in a positive way for microstructures containing bainite and pro-eutectoid carbides. In different embodiments, % Mn is 0.001% by weight or higher, 0.03% by weight or higher, 0.23% by weight or higher, 0.36% by weight or higher, 0.46% by weight or higher, 0.56% by weight or higher, 0.64% by weight or higher, 0.71% by weight or higher, and even 0.81% by weight or higher. In contrast, in some applications an excessively high content of % Mn is rather detrimental. In different embodiments, % Mn is less than 0.9% by weight, less than 0.74% by weight, less than 0.54% by weight, less than 0.44% by weight, less than 0.19% by weight and even less than 0.09% by weight. Obviously, there are cases where the desired nominal content is 0% by weight or nominal absence of the element as occurs with all optional elements for certain applications.

It has been found that for some applications the presence of molybdenum (% Mo) is desirable while yet for other applications should be limited. In different embodiments, % Mo is 0.01% by weight or higher, 0.24% by weight or higher, 0.67% by weight or higher, 0.84% by weight or higher, 1.12% by weight or higher, 1.62% by weight or higher, and even 1.82% by weight or higher. In contrast, in some applications an excessively high content of % Mo is rather detrimental. In different embodiments, % Mo is less than 2.2% by weight, less than 1.9% by weight, less than 1.3% by weight, less than 0.98% by weight, less than 0.8% by weight, and even less than 0.44% by weight. Obviously, there are cases where the desired nominal content is 0% by weight or nominal absence of the element as occurs with all optional elements for certain applications.

It has been found that in some applications the steels benefit from having a higher content of equivalent molybdenum (% $Mo_{eq}$, being % $Mo_{eq}$=% Mo+½*% W). In different embodiments, % $Mo_{eq}$ is 0.02% by weight or higher, 0.44% by weight or higher, 0.87% by weight or higher, 1.04% by weight or higher, 1.22% by weight or higher, 1.32% by weight or higher, 1.53% by weight or higher, 1.82% by weight or higher, and even 2.02% by weight or higher. In contrast, in some applications an excessively high content of % $Mo_{eq}$ is rather detrimental. In different embodiments, % $Mo_{eq}$ is less than 2.2% by weight, less than 1.9% by weight, less than 1.7% by weight, less than 1.4% by weight, less than 1.19% by weight, less than 1.14% by weight, less than 1.1% by weight, less than 0.78% by weight, less than 0.6% by weight, and even less than 0.24% by weight.

It has been found that for some applications the presence of tungsten (% W) is desirable while yet for other applications it is rather an impurity. In different embodiments, % W is 0.003% by weight or higher, 0.02% by weight or higher, 0.22% by weight or higher, 0.61% by weight or higher, 0.89% by weight or higher, 1.14% by weight or higher, and even 1.62% by weight or higher. In contrast, in some applications an excessively high content of % W is rather detrimental. In different embodiments, % W is less than 1.8% by weight, less than 1.4% by weight, less than 1.3% by weight, less than 0.8% by weight, less than 0.41% by weight and even less than 0.09% by weight. Obviously, there are cases where the desired nominal content is 0% by weight or nominal absence of the element as occurs with all optional elements for certain applications.

It has been found that for some applications the presence of titanium (% Ti) is desirable while yet for other applications it is rather an impurity. In different embodiments, % Ti is 0.001% by weight or higher, 0.006% by weight or higher, 0.009% by weight or higher, 0.01% by weight or higher, 0.03% by weight or higher, and even 0.09% by weight or higher. In contrast, in some applications an excessively high content of % Ti is rather detrimental. In different embodiments, % Ti is less than 0.09% by weight, less than 0.08% by weight, less than 0.01% by weight, and even less than 0.002% by weight. Obviously, there are cases where the desired nominal content is 0% by weight or nominal absence of the element as occurs with all optional elements for certain applications.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.04% by weight or higher, 0.09% by weight or higher, and even 0.12% by weight or higher. In contrast, in some applications an excessively high content of % Zr is rather detrimental. In different embodiments, % Zr is less 0.18% by weight, less than 0.16% by weight, less than 0.14% by weight, less than 0.02% by weight, and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.001% by weight or higher, 0.01% by weight or higher, 0.09% by weight or higher, 0.2% by weight or higher, and even 0.26% by weight or higher. In contrast, in some applications an excessively high content of % Co is rather detrimental. In different embodiments, % Co is less than 0.4% by weight, less than 0.36% by weight, less than 0.31% by weight, less than 0.19% by weight, and even less than 0.12% by weight. Obviously, there are cases where the desired nominal content is 0% by weight or nominal absence of the element as occurs with all optional elements for certain applications.

It has been found that for some applications the presence of vanadium (% V) is desirable while yet for other applications it is rather an impurity. In different embodiments, % V is 0.002% by weight or higher, 0.007% by weight or higher, 0.01% by weight or higher, 0.02% by weight or higher, 0.09% by weight or higher, 0.11% by weight or higher, and even 0.16% by weight or higher. In contrast, in some applications an excessively high content of % V is rather detrimental. In different embodiments, % V is less than 0.18% by weight, less than 0.16% by weight, less than 0.14% by weight, less than 0.12% by weight, less than 0.08% by weight, less than 0.02% by weight, and even less than 0.001% by weight. Obviously, there are cases where the desired nominal content is 0% by weight or nominal absence of the element as occurs with all optional elements for certain applications.

It has been found that for some applications the presence of copper (% Cu) is desirable while yet for other applications it is rather an impurity. In different embodiments, % Cu is 0.0001% by weight or higher, 0.003% by weight or higher, 0.02% by weight or higher, 0.04% by weight or higher, 0.12% by weight or higher, 0.16% by weight or higher, and even 0.21% by weight or higher. In contrast, in some applications an excessively high content of % Cu is rather detrimental. In different embodiments, % Cu is less than 0.48% by weight, less than 0.43% by weight, less than 0.39% by weight, less than 0.28% by weight, less than 0.01% by weight, less than 0.002% by weight, and even less than 0.001% by weight. Obviously, there are cases where the desired nominal content is 0% by weight or nominal absence of the element as occurs with all optional elements for certain applications.

The inventor has found that the sum of % Al+% Ti+% Ta+% Zr+% Hf+% V+% Nb+% Cu+% La+% Ce+% Nd+% Gd+% Sm+% Y+% Pr+% Sc+% Eu+% Cs can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Eu+% Cs is 1.9% by weight or less, 1.4% by weight or less, 0.9% by weight or less, 0.4% by weight or less and even 0.1% by weight or less. In different embodiments. % Al+% Ti+% Ta+% Zr+% Hf+% V+% Nb+% Cu+% La+% Ce+% Nd+% Gd+% Sm+% Y+% Pr+% Sc+% Eu+% Cs is 0.002% by weight or more, 0.11% by weight or more, 0.41% by weight or more, 0.71% by weight or more and even 1.01% by weight or more.

The inventor has found that the sum of % Al+% Ta+% Hf+% V+% Nb+% Cu+% La+% Ce+% Nd+% Gd+% Sm+% Y+% Pr+% Sc+% Eu+% Ce can be of importance for some embodiments and different levels are desirable for different applications. In different embodiments, % Al+% Ta+% Hf+% V+% Nb+% Cu+% La+% Ce+% Nd+% Gd+% Sm+% Y+% Pr+% Sc+% Eu+% Cs is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Eu+% Cs is 0.002% by weight or more, 0.02% by weight or more, 0.12% by weight or more and even 0.21% by weight or more.

The inventor has found that the sum of % Ni+% Mn+% Si can be of importance for some applications, and different levels are desirable for different embodiments. In different embodiments, % Ni+% Mn+% Si is 0.04% by weight or more, above 0.04% by weight, above 0.11% by weight, above 0.16% by weight, above 0.21% by weight, above 0.41% by weight, above 0.51% by weight and even above 0.66% by weight. For some applications and excessive value of the sum of these elements can be detrimental. In different embodiments. % Ni+% Mn+% Si is below 1.9% by weight, 1.4% by weight or less, below 1.4% by weight, below 0.9% by weight, below 0.78% by weight, below 0.58% by weight and even below 0.47% by weight. All the upper and lower limits disclosed in the different embodiments can be combined in any combination provided they are not mutually exclusive, for example % Ni+% Mn+% Si=0.04-1.4% by weight.

The inventor has found that the sum of % Ni+% Mn can be of importance for some embodiments and different levels are desirable for different applications. In different embodiments, % Ni+% Mn is 0.04% by weight or more, 0.12% by weight or more, 0.21% by weight or more, 0.3% by weight or more, 0.42% by weight or more, 0.51% by weight or more and even 0.66% by weight or more. For some applications and excessive value of the sum of these elements can be detrimental. In different embodiments, % Ni+% Mn is 1.76% by weight or less, 1.4% by weight or less, 1.2% by weight or less, 0.9% by weight or less, 0.78% by weight or less and even 0.58% by weight or less. All the upper and lower limits disclosed in the different embodiments can be combined in any combination provided they are not mutually exclusive, for example % Ni+% Mn=0.42-12% by weight.

It has been found that for some of the steels of the present invention to assure homogeneous toughness in large cross sections, the following has to be true: HTLC*% N≤% Ni+% Mn≤(% C−% N)*ATLS. In an embodiment, HTLC is 10. In another embodiment, HTLC is 20. In another embodiment, HTLC is 30. In another embodiment, HTLC is 40. In another embodiment, HTLC is 50 and even in some embodiments, HTLC is 70. In an embodiment, ATLS is 5. In another embodiment, ATLS is 6. In another embodiment, ATLS is 7. In another embodiment, ATLS is 8. In another embodiment, ATLS is 9. In another embodiment, ATLS is 12, and even in some embodiments, ATLS is 19. All the above disclosed embodiments can be combined in any combination provided they are not mutually exclusive, for example: 20*% N≤% Ni+% Mn≤(% C−% N)*7.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

The inventor has found that for some applications a certain relation between % $Mo_{eq}$, % Mn and % Ni content is preferred, and different levels are desirable for different applications. In different embodiments, (% $Mo_{eq}$)/(% Mn+% Ni) is 0.3% by weight or more, 0.5% by weight or more, 0.7% by weight or more, 0.8% by weight or more, 0.9% by weight or more, 1.6% by weight or more and even 2.5% by weight or more. For some applications and excessive value of (% $Mo_{eq}$)/(% Mn+% Ni) can be detrimental. In different embodiments, (% $Mo_{eq}$)/(% Mn+% Ni) is 21% by weight or less, 16% by weight or less, 12% by weight or less, 10% by weight or less, 8% by weight or less, and even 4.9% by weight or less. Al the upper and lower limits disclosed in the different embodiments can be combined in any combination provided they are not mutually exclusive, for example (% $Mo_{eq}$)/(% Mn+% Ni)=0.7-4.9% by weight.

In different embodiments, the microstructure of the steel is characterized by a thermal diffusivity at room temperature which is at least 8 $mm^2/s$, at least 9.6 $mm^2/s$, at least 10.6 $mm^2/s$, at least 11.2 $mm^2/s$, at least 12.1 $mm^2/s$, and even at least 13 $mm^2/s$. The inventor has found that in some applications wherein the microstructure has a particularly low content of scattering atomic arrangement defects, the microstructure of the steel is characterized by higher thermal diffusivity values at room temperature, in different embodiments, the microstructure is characterized by a thermal diffusivity at room temperature which is at least 13.6 $mm^2/s$, at least 14.6 $mm^2/s$, at least 15.2 $mm^2/s$, at least 16.2 $mm^2/s$, at least 16.6 $mm^2/s$, at least 17.01 $mm^2/s$, and even at least 18 $mm^2/s$. In an embodiment, the thermal diffusivity is measured at room temperature by means of the Flash Method. In an embodiment, the thermal diffusivity is measured at room temperature according to ASTM-E1461-13. In an embodiment, the thermal diffusivity can alternatively be measured at room temperature according to ASTM-E2585-09(2015).

In an embodiment, the steel presents a microstructure comprising at least 26% balnite, at least 46% bainite, at least 62% bainite, at least 76% bainite, at least 82% balnite and even at least 92% bainite. In an embodiment, the above disclosed percentages of bainite are by volume.

For some applications, a steel having a microstructure comprising high temperature bainite is preferred. In this document high temperature bainite refers to any microstructure formed at temperatures above the temperature corresponding to the balnite nose in the TTT diagram but below the temperature where the ferritic/perlitic transformation ends, but it excludes lower balnite as referred in the literature, which can occasionally form in small amounts also in isothermal treatments at temperatures above the one of the bainitic nose. In an embodiment, high temperature bainite is at least 20%. In another embodiment, high temperature bainite is at least 31%. In another embodiment, high temperature bainite is at least 41%. In another embodiment, high temperature bainite is at least a 51%. In another embodiment, high temperature bainite is at least 66%. In another embodiment, high temperature balnite is at least a 76%. In another embodiment, high temperature bainite is at least 86%. In another embodiment, high temperature bainite is at least 91%. In another embodiment, high temperature bainite is at least 96%. In an embodiment, high temperature bainite is 100%. In an embodiment, all the bainite is high temperature bainite. In some applications, the percentage of high temperature bainite should be limited. In an embodiment, high temperature bainite is less than 98%. In another embodiment, high temperature balnite is less than 89%. In another embodiment, of high temperature bainite is less than 79%. In another embodiment, of high temperature bainite is less than 69%. In another embodiment, high temperature bainite is less than 59%. In another embodiment, high temperature balnite is less than 49%. In an embodiment, the above disclosed percentages of high temperature bainite are by volume. All the embodiments disclosed above can be combined in any combination, provided that they are not mutually exclusive, for example, a steel wherein the high temperature bainite is at least a 20% by volume.

It has been found with surprise, that in the steels of the present invention, for some applications, the microstructures that are reported as undesirable in the literature are for those applications very advantageous. In this sense, for some applications, the microstructures resulting from the decomposition of austenite at high temperatures are preferred. In fact, the range of preferred microstructures for those applications is rather concrete resulting in narrow process windows. In different embodiments, the microstructure should be composed at least by 26% or more of HTSM microstructure, at least by 52% or more of HTSM microstructure, at least by 66% or more of HTSM microstructure, at least by 76% or more of HTSM microstructure, at least by 86% or more of HTSM microstructure, at least by 92% or more of HTSM microstructure, at least by 96% or more of HTSM microstructure and even in some embodiments, the microstructure should be completely composed of HTSM microstructure. In different embodiments, the amount of LTSM should be 48% or less, 24% or less, 18% or less, 8% or less, 4% or less and even in some embodiments, the amount of LTSM should be inappreciable. In different embodiments, the amount of UHTSM should be 48% or less, 24% or less, 14% or les, 8% or less, 3% or less and even in some embodiments, the amount of UHTSM should be inappreciable. In an embodiment, the above disclosed percentages are by volume. In an embodiment, HTSM microstructure is a microstructure with a transformation temperature between (Ac1+Ac3)/2+20° C. and (Bs+Bf)/2. Bs and Bf refer to the bainite start and bainite finish transformation temperatures respectively. In another embodiment, HTSM microstructure is a microstructure with a transformation temperature between (Ac1+Ac3)/2 and (Bs+Bf)/2. In another embodiment, HTSM microstructure is a microstructure with a transformation temperature between Ac1−20K and (Bs+Bf)/2. In another embodiment, HTSM microstructure is a microstructure with a transformation temperature between Ac1−20K and (Bs+Bf)/2+10K in an embodiment, the microstructure associated with a transformation temperature is extracted from a Constant Temperature Transformation (TTT) diagram where the austenitization temperature is Ae3+5K. In another embodiment, the microstructure associated with a transformation temperature is extracted from a TTT diagram where the austenitization temperature is Ae3+20K. In another embodiment, the microstructure associated with a transformation temperature is extracted from a TTT diagram where the austenitization temperature is Ae3+50K. In another embodiment, the microstructure associated with a transformation temperature is extracted from a TTT diagram where the austenitization temperature is Ae3+100K. In another embodiment, the microstructure associated with a transformation temperature is extracted from TTT diagram where the austenitization temperature is Ae1+10K. In another embodiment, the austenitization time at the austenitization temperature to construct the TTT diagram is 30 minutes. In an embodiment, the austenitization time at the austenitization temperature to construct the TTT diagram is 1 hour. In an embodiment, the microstructure associated with a transformation temperature is extracted from a Continuous Cooling Transformation (CCT) diagram where the austenitization temperature is Ae3+5K and the cooling rate is 5K/min. In another embodiment, the microstructure associated with a transformation temperature is extracted from a CCT diagram where the austenitization temperature is Ae3+5K and the cooling rate is 3K/min. In another embodiment, the microstructure associated with a transformation temperature is extracted from a CCT diagram where the austenitization temperature is Ae3+20K and the cooling rate is 5K/min. In another embodiment, the microstructure associated with a transformation temperature is extracted from a CCT diagram where the austenitization temperature is Ae3+20K and the cooling rate is 3K/min. In another embodiment, the microstructure associated with a transformation temperature is extracted from a CCT diagram where the austenitization temperature is Ae3+100K and the cooling rate is 5K/min. In an embodiment, the microstructure associated with a transformation temperature is extracted from a CCT diagram where the austenitization temperature is Ae3+100K and the cooling rate is 3K/min. In an embodiment, the austenitization time at the austenitization temperature to construct the CCT diagram is 30 minutes. In an embodiment, the austenitization time at the austenitization temperature to construct the CCT diagram is 1 hour. In an embodiment, LTSM microstructure is a microstructure with a transformation temperature below Bf. In an embodiment, LTSM microstructure is a microstructure with a transformation temperature below Bf−20K. In an embodiment, LTSM microstructure is a microstructure with a transformation temperature below Ms. Ms refers to the martensite start transformation temperature. In another embodiment, LTSM microstructure is a microstructure with a transformation temperature below Ms−10K. In an embodiment, UHTSM microstructure is a microstructure with a transformation temperature above Ac1−20K. In another embodiment, UHTSM microstructure is a microstructure with a transformation temperature above Ac1. In another embodiment, UHTSM microstructure is a microstructure with a transformation temperature above Ac1+10K. In another embodiment, UHTSM microstructure is a microstructure with a transformation temperature above Ac1+20K. In another embodiment, UHTSM microstructure is a microstructure with a transformation temperature above (Ac1+Ac3)/2. In another embodiment, UHTSM microstructure is a microstructure with a transformation temperature above (Ac1+Ac3)/2+20K. All the above disclosed embodiments can be combined in any combination provided that they are not mutually exclusive.

For some applications, more interesting than controlling the microstructure is to control the cooling rates applied after the last at least partial austenization of the material. The material might undergo several heat treatments involving at least partial austenization, but it has been found that for some applications the cooling rate applied in the last one should be purposefully adjusted, that does not mean that for some of those applications the intentional monitoring of other preceding heat treatments cooling raters can also be advantageous. In different embodiments the last heat treatment involving at least partial austenization of the material involves a mean cooling rate between the austenitization temperature and RET of preferably 19K/min or less, a mean cooling rate between the austenitization temperature and RET of 9K/min or less, a mean cooling rate between the austenitization temperature and RET of 6K/min or less, a mean cooling rate between the austenitization temperature and RET of 4.9K/min or less, a mean cooling rate between the austenitization temperature and RET of 3.9K/min or less, a mean cooling rate between the austenitization temperature and RET of 2.9K/min or less and even the last heat treatment involving at least partial austenization of the material involves a mean cooling rate between the austenitization temperature and RET of 0.9K/min or less. In an embodiment, any isothermal holding is discounted when measuring the mean cooling rate. In different embodiments, an isothermal holding is any portion of the cooling diagram where the cooling rate is preferably 2 times slower than the mean, 3 times slower than the mean, 5 times slower than the mean, 10 times slower than the mean and even 15 times slower than the mean. In some applications there is also a desirable lower limit for this portion of the cooling. In an embodiment, the last heat treatment involving at least partial austenization of the material involves a mean cooling rate between the austenitization temperature and RET of 0.06K/min or more. In another embodiment, the last heat treatment involving at least partial austenization of the material involves a mean cooling rate between the austenitization temperature and RET of 0.2K/min or more. In another embodiment, the last heat treatment involving at least partial austenization of the material involves a mean cooling rate between the austenitization temperature and RET of 0.6K/min or more. In another embodiment, the last heat treatment involving at least partial austenization of the material involves a mean cooling rate between the austenitization temperature and RET of 1.1K/min or more. In another embodiment, the last heat treatment involving at least partial austenization of the material involves a mean cooling rate between the austenitization temperature and RET of 2.2K/min or more. In another embodiment, the last heat treatment involving at least partial austenization of the material involves a mean cooling rate between the austenitization temperature and RET of 3.3K/min or more and even in some embodiments, the last heat treatment involving at least partial austenization of the material involves a mean cooling rate between the austenitization temperature and RET of 4.4K/min or more. In an embodiment, the mean cooling rate between RET2 and RET3 is at least a 20% slower than between austenitization and RET. In another embodiment, the mean cooling rate between RET2 and RET3 is at least a 52% slower than between austenitization and RET. In another embodiment, the mean cooling rate between RET2 and RET3 is at least a 76% slower than between austenitization and RET. In another embodiment, the mean cooling rats between RET2 and RET3 is at least half as fast as between austenitization and RET. In another embodiment, the mean cooling rate between RET2 and RET3 is at least a fourth as fast as between austenitization and RET. In an embodiment, the mean cooling rate between RET2 and RET3 is no more than 5 times slower than between austenitization and RET. In another embodiment, the mean cooling rate between RET2 and RET3 is no more than 3 times slower than between austenitization and RET. In another embodiment, the mean cooling rate between RET2 and RET3 is no more than 2 times slower than between austenitization and RET. In an embodiment, the last heat treatment involving at least partial austenization of the material involves a mean cooling rate between RET2 and RET3 of 13K/min or less. In another embodiment, the last heat treatment involving at least partial austenization of the material involves a mean cooling rate between RET2 and RET3 of 8K/min or less. In another embodiment, the last heat treatment involving at least partial austenization of the material involves a mean cooling rate between RET2 and RET3 of 4.4K/min or less. In another embodiment, the last heat treatment involving at least partial austenization of the material involves a mean cooling rate between RET2 and RET3 of 3.9K/min or less. In another embodiment, the last heat treatment involving at least partial austenization of the material involves a mean cooling rate between RET2 and RET3 of 2.9K/min or les. In some applications the cooling rate should not be excessively low. In an embodiment, the last heat treatment involving at least partial austenization of the material involves a mean cooling rate between RET2 and RET3 of 0.05K/min or more. In another embodiment, the last heat treatment involving at least partial austenization of the material involves a mean cooling rate between RET2 and RET3 of 0.5K/min or more. In another embodiment, the last heat treatment involving at least partial austenization of the material involves a mean cooling rate between RET2 and RET3 of 1.1K/min or more. In an embodiment, any isothermal holding is discounted when measuring the mean cooling rate in the same terms as described above in this paragraph. In an embodiment, the last heat treatment involving at least partial austenization of the material involves a mean cooling rate between RET2 and RET3 of no less than 0.04K/min. In another embodiment, the last heat treatment involving at least partial austenization of the material involves a mean cooling rate between RET2 and RET3 of no less than 0.4K/min. In another embodiment, the last heat treatment involving at least partial austenization of the material involves a mean cooling rate between RET2 and RET3 of no less than 1.1K/min. Definition of the RET, RET2 and RET3 temperatures might be different for different applications. In an embodiment, RET refers to (Ac3+Bs)/2. In another embodiment, RET refers to Ac3−20K. In another embodiment, RET refers to Ac3−50K. In another embodiment. RET refers to (Ac3+Ac1)/2−70K. In another embodiment, RET refers to (Ac3+Ac1)/2−130K. In another embodiment, RET refers to Bs+150K. In another embodiment, RET refers to Bs+80K. In another embodiment, RET refers to Bs+20K in another embodiment, RET refers to 7300° C. In another embodiment, RET, refers to 730° C. In another embodiment, RET refers to 680° C. In another embodiment, RET refers to 660° C. In another embodiment, RET refers to 600° C. In another embodiment, RET, refers to 560° C. In another embodiment, RET2 refers to (Ac3+Bs)/2. In another embodiment, RET2 refers to (Ac3+Bs)/2−20K. In another embodiment, RET2 refers to (Ac3+Bs)/2−80K. In another embodiment, RET2 refers to Ac3−40K. In another embodiment, RET2 refers to Ac3−150K. In another embodiment, RET2 refers to (Ac3+Ac1)/2-130K. In another embodiment, RET2 refers to (Ac3+Ac1)/2−150K. In another embodiment, RET2 refers to Bs+100K. In another embodiment, RET2 refers to Bs+120K. In another embodiment, RET2 refers to Bs+50K. In another embodiment, RET2 refers to 640° C. In another embodiment, RET2, refers to 610° C. In another embodiment, RET2 refers to 580° C. In another embodiment, RET2, refers to 520° C. In another embodiment, RET3 refers to (Bf+Bs)/2. In another embodiment, RET3 refers to (Bf+Bs)/2−20K in another embodiment, RET3 refers to (Bf+Ms)/2. In another embodiment, RET3 refers to (Bf+Ms)/2+20K. In another embodiment, RET3 refers to (Bf+Ms)/2−20K. In another embodiment, RET3 refers to Ms. In another embodiment, RET3 refers to (Mf+Ms)/2. In another embodiment, RET3 refers to 480° C. In another embodiment, RET3 refers to 440° C. In another embodiment, RET3 refers to 380° C. In another embodiment, RET3 refers to 320° C. In another embodiment, RET3 refers to 250° C. All the above disclosed embodiments can be combined in any combination provided that they are not mutually exclusive.

In some applications it is challenging to attain an optically pleasant microstructure which at the same time provides a good combination of mechanical properties for some steels of the present invention. It has been found with great surprise that this can be more easily obtained by making an interruption in the cooling process which involves a temperature increase, provided the temperatures, cooling/heating rates and permanence times are well chosen. In an embodiment, the treatment comprises a step in which the cooling from RET (as previously described) is interrupted at RIT. In an embodiment, the temperature is furthermore hold somewhat constant around RIT for a period of tRIT. In an embodiment, the heat treatment further comprises a step in which temperature is raised from RIT to HIT. In an embodiment, the heating rate from RIT to HIT is controlled. In an embodiment, the temperature is further kept somewhat constant around HIT for a period of tHIT. In an embodiment, the temperature is further lowered from HIT to RIT2. In an embodiment, the temperature is lowered from HIT to RIT2 in a controlled way. In an embodiment, RIT is 698° C. or less. In another embodiment, RIT is 598° C. or less. In another embodiment, RIT is 498° C. or less. In another embodiment, RIT is 448° C. or less. In another embodiment, RIT is 398° C. or less. In an embodiment, RIT should not be less than 150° C. In another embodiment, RIT should not be less than 250° C. In another embodiment, RIT should not be less than 350° C. In another embodiment, RIT should not be less than 450° C. In another embodiment, RIT should not be less than 502° C. In an embodiment, tRIT is 12 minutes or more. In another embodiment, tRIT is 31 minutes or more. In another embodiment, tRIT is 62 minutes or more. In another embodiment, tRIT is 92 minutes or more. In another embodiment, tRIT is 6 hours or more. In another embodiment, tRIT is 12 hours or more. In an embodiment, tRIT should not be more than 47 hours. In another embodiment, tRIT should not be more than 19 hours. In another embodiment, tRIT should not be more than 9 hours. In another embodiment, tRIT should not be more than 110 minutes. In another embodiment, tRIT should not be more than 50 minutes. In an embodiment, the cooling rate between RET to RIT should not exceed 19K/min. In another embodiment, the cooling rate between RET to RIT should not exceed 13K/min. In another embodiment, the cooling rate between RET to RIT should not exceed 7.9K/min. In another embodiment, the cooling rate between RET to RIT should not exceed 4.4K/min. In another embodiment, the cooling rate between RET to RIT should not exceed 3.9K/min. In another embodiment, the cooling rate between RET to RIT should not exceed 2.9K/min. In some applications the cooling rate should not be excessively low. In an embodiment, the cooling rate between RET to RIT should exceed 0.05K/min. In another embodiment, the cooling rate between RET to RIT should exceed 0.5K/min. In another embodiment, the cooling rate between RET to RIT should exceed 1.1K/min. In another embodiment, the cooling rate between RET to RIT should exceed 2.1K/min. In an embodiment, HIT is 401° C. or more. In another embodiment, HIT is 451° C. or more. In another embodiment, HIT is 502° C. or more. In another embodiment, HIT is 552° C. or more. In another embodiment, HIT is 602° C. or more. In another embodiment, HIT is 632° C. or more. In another embodiment, HIT is 652° C. or more. In another embodiment, HIT is 682° C. or more, in another embodiment, HIT is 702 or more. In an embodiment, HIT is 890° C. or less. In another embodiment, HIT is 790° C. or less. In another embodiment, HIT is 740° C. or less. In another embodiment, HIT is 690° C. or less. In another embodiment. HIT is 640° C. or less. In an embodiment, the heating rate between RIT to HIT should not exceed 19K/min. In another embodiment, the heating rate between RIT to HIT should not exceed 13K/min. In another embodiment, the heating rate between RIT to HIT should not exceed 7.9K/min. In another embodiment, the heating rate between RIT to HIT should not exceed 4.4K/min. In another embodiment, the heating rate between RIT to HIT should not exceed 3.9K/min. In another embodiment, the heating rate between RIT to HIT should not exceed 2.9K/min. In some applications the heating rate should not be excessively low. In an embodiment, the heating rate between RIT to HIT should exceed 0.05K/min. In another embodiment, the heating rate between RIT to HIT should exceed 0.5K/min. In another embodiment, the heating rate between RIT to HIT should exceed 1.1K/min. In another embodiment, the heating rate between RIT to HIT should exceed 2.1K/min. In an embodiment, tHIT is 12 minutes or more. In another embodiment, tHIT is 31 minutes or more. In another embodiment, tHIT is 62 minutes or more. In another embodiment, tHIT is 92 minutes or more. In another embodiment, tHIT is 6 hours or more. In another embodiment, tHIT is 12 hours or more. In an embodiment, tHIT should not be more than 47 hours. In another embodiment, tHIT should not be more than 19 hours. In another embodiment, tHIT should not be more than 9 hours. In another embodiment, tHIT should not be more than 110 minutes. In another embodiment, tHIT should not be more than 50 minutes. In an embodiment, RIT2 is 598° C. or less. In another embodiment, RIT2 is 496° C. or less. In another embodiment, RIT2 is 398° C. or less. In another embodiment, RIT2 is 298° C. or less. In another embodiment, RIT2 is 198° C. or less. In an embodiment, RIT2 should not be less than 50° C. In another embodiment, RIT2 should not be less than 102° C. In another embodiment, RIT2 should not be less than 150° C. In another embodiment, RIT2 should not be less than 350° C. In another embodiment, RIT2 should not be less than 502° C. In some applications the cooling can continue until the extraction from the furnace or even an undercooling might be interesting for some applications. In an embodiment, RIT2 does not have a lower limit. In some applications what is important is the difference of temperature between HIT and RIT2. In an embodiment, HIT-RIT2 should be 52° C. or more. In another embodiment, HIT-RIT2 should be 102° C. or more. In another embodiment, HIT-RIT2 should be 152° C. or more. In another embodiment, HIT-RIT2 should be 252° C. or more. In another embodiment, HIT-RIT2 should be 352° C. or more. In an embodiment, the cooling rate between HIT to RIT2 should not exceed 13K/min. In another embodiment, the cooling rate between HIT to RIT2 should not exceed 7.9K/min. In another embodiment, the cooling rate between HIT to RIT2 should not exceed 4.4K/min. In another embodiment, the cooling rate between HIT to RIT2 should not exceed 3.9K/min. In another embodiment, the cooling rate between HIT to RIT2 should not exceed 2.9K/min. In some applications the cooling rate should not be excessively low. In an embodiment, the cooling rate between HIT to RIT2 should exceed 0.05K/min. In another embodiment, the cooling rate between HIT to RIT2 should exceed 0.5K/min. In another embodiment, the cooling rate between HIT to RIT2 should exceed 1.1K/min. In another embodiment, the cooling rate between HIT to RIT2 should exceed 2.1K/min. All the above disclosed embodiments can be combined in any combination provided that they are not mutually exclusive.

All the upper and lower limits disclosed in the different embodiments can be combined in any combination provided they are not mutually exclusive.

A preferred embodiment of the hot work and/or plastic injection moulding tool steel disclosed in preceding paragraphs is a steel having the following composition, all percentages being in weight percentage (% wt):

| | | | |
|---|---|---|---|
| % $C_{eq}$ = 0.21-0.34 | % C = 0.21-0.34 | % N = 0-0.1 | % B = 0-0.09 |
| % Cr = 0-1.4 | % Ni = 0-0.9 | % Si = 0-0.28 | % Mn = 0-0.98 |
| % Al = 0-0.1 | % Mo = 0-2.4 | % W = 0-1.9 | % Ti = 0-0.1 |
| % Ta = 0-0.1 | % Zr = 0-0.2 | % Hf = 0-0.1 | % V = 0-0.2 |
| % Nb = 0-0.1 | % Cu = 0-0.5 | % Co = 0-0.5 | % $Mo_{eq}$ = 1.1-2.4 |
| % La = 0-0.1 | % Ce = 0-0.1 | % Nd = 0-0.1 | % Gd = 0-0.1 |
| % Sm = 0-0.1 | % Y = 0-0.1 | % Pr = 0-0.1 | % Sc = 0-0.1 |
| % Cs = 0-0.1 | % Eu = 0-0.1 | | |

the rest consisting of iron and trace elements, wherein

% Ceq=% C+0.86*% N+1.2*% B, and

% $Mo_{eq}$=% Mo+½*% W, and wherein

% Ni+% Mn=0.42-1.2, and

% B>21 ppm, and (% $Mo_{eq}$)/(% Mn+% Ni)=0.7-4.9 wherein the steel presents a microstructure which is characterized by a thermal diffusivity at room temperature of at least 13 $mm^2/s$ measured according to international standard ASTM-E1461-13 by means of the Flash Method and wherein the microstructure comprises at least 76% by volume balnite.

Any embodiment disclosed in preceding paragraphs for the hot work and/or plastic injection moulding tool steels (including any lower and upper Emit for the content of any element and/or their sum) can also be applied to this preferred embodiment, provided that they are not mutually exclusive.

In an embodiment, the invention refers to a steel, in particular a cold work tool steel, having the following composition, all percentages being in weight percentage (% wt):

| | | | |
|---|---|---|---|
| % $C_{eq}$ = 0.51-1.49 | % C = 0.51-1.49 | % N = 0-0.49 | % B = 0-0.49 |
| % Cr = 2.1-14 | % Ni = 0-4.9 | % Si = 0.01-1.9 | % Al = 0-0.9 |
| % Mn = 0.01-2.8 | % Ti = 0.12-4.9 | % Mo = 0-3.9 | % W = 0-4.9 |
| % $Mo_{eq}$ = 0.26-3.9 | % Ta = 0-0.4 | % Zr = 0-0.9 | % Hf = 0-0.3 |
| % V = 0-1.4 | % Nb = 0-1.4 | % Cu = 0-1.9 | % Co = 0-2.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Pm = 0-0.3 | % Eu = 0-0.3 | | |

the rest consisting of iron and trace elements, wherein

% Ceq=% C+0.86*% N+1.2*% B, and

% $Mo_{eq}$=% Mo+½*% W,

Trace elements refers to several elements, unless context clearly indicates otherwise, including but not limited to, H, He, Xe, F, Ne, Na, P, S, Cl, Ar, K, Br, Kr, Sr, Tc, Ru, Rh, Pd, Ag, I, Ba, Re, Os, Ir, Pt, Au, Hg, Tl, Po, At, Rn, Fr, Ra, Ac, Pa, U, Np, Pu, Am, Cm, Bk, Cf, Es, Fm, Md, No, Lr, Rf, db, Sg, Bh, Hs, Cs, Tb, Dy, Ho, Er, Tm, Yb, Lu, O, U, Be, Mg, Ca, Rb, Zn, Cd, Ga, In, Ge, Sn, Pb, B, Sb, As, Se, Te, Th, Ds, Rg, Cn, Nh, Fl, Mc, Lv, Ti, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments, the sum of all trace elements in the steel is below 2.0% by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% Ceq). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % Ceq should not be too high. In different embodiments, % Ceq is 1.29% by weight or less, 1.16% by weight or less, 0.94% by weight or less, 0.88% by weight or less and even 0.84% by weight or less. Some applications, like sometimes applications requiring a rather good polishing ability in the tool steel or good weldability it is often interesting to keep even lower levels of % Ceq. In different embodiments, % Ceq is 0.82% by weight or less, 0.78% by weight or less, and even 0.74% by weight or less. In contrast, in some applications higher contents of % Ceq are preferred. In different embodiments, % Ceq is above 0.57% by weight, above 0.62% by weight, above 0.68% by weight and even above 0.73% by weight. For some applications, if abundant primary carbides are desirable, then the % Ceq content should be higher, in different embodiments, % Ceq is 0.81% by weight or more, 0.91% by weight or more, 1.01% by weight or more, 1.12% by weight or more and even 1.26% by weight or more.

Different applications require different levels of carbon (% C). For some applications, % C should not be too high.

In different embodiments, % C is 1.29% by weight or less, 1.16% by weight or less, 0.94% by weight or less, 0.88% by weight or less and even 0.84% by weight or less. Some applications, like sometimes applications requiring a rather good polishing ability in the tool steel or good weldability it is often interesting to keep even lower levels of % C. In different embodiments, % C is 0.82% by weight or less, 0.78% by weight or less, and even 0.74% by weight or less. In contrast, in some applications higher contents of % C are preferred. In different embodiments, % C is above 0.56% by weight, above 0.61% by weight, above 0.67% by weight and even above 0.71% by weight. For some applications, if abundant primary carbides are desirable, then the % C content should be higher, in different embodiments, % C is 0.91% by weight or more, 1.01% by weight or more, 1.11% by weight or more, 1.22% by weight or more and even 1.36% by weight or more.

It has been found that for some applications the presence of nitrogen (% N) is desirable while yet for other applications it is rather an impurity. In different embodiments, % N is 0.002% by weight or higher, 0.01% by weight or higher, 0.06% by weight or higher and even 0.09% by weight or higher. In contrast, in some applications an excessively high content of % N is rather detrimental. In different embodiments, % N is less than 0.44% by weight, less than 0.1% by weight, less than 0.01% by weight, less than 0.006% by weight, and even less than 0.002% by weight. Obviously, there are cases where the desired nominal content is 0% by weight or nominal absence of the element as occurs with all optional elements for certain applications.

It has been found that for some applications the presence of boron (% B) is desirable while yet for other applications it is rather an impurity. In different embodiments, % B is above 1 ppm by weight, above 11 ppm by weight, 26 ppm by weight, above 32 ppm by weight and even 42 ppm by weight or higher. In some applications if primary borides or carbo-nitro borides are desirable, then the % B content should be higher, in different embodiments, % B is 0.01% by weight or higher, 0.02% by weight or higher, 0.04% by weight or higher, 0.1% by weight or higher, 0.26% by weight or higher and even 0.36% by weight or higher. In contrast, in some applications an excessively high content of % B is rather detrimental. In different embodiments, % B is less than 0.43% by weight, less than 0.38% by weight, less than 0.21% by weight, less than 0.035% by weight and even les than 0.002% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is above 0.001% by weight, above 0.04% by weight, above 0.11% by weight, above 0.21% by weight, above 0.31% by weight above 0.41% by weight, above 0.51% by weight, and even above 0.71% by weight. In contrast, in some applications an excessively high content of % Nb is rather detrimental. In different embodiments, % Nb is less than 0.9% by weight, less than 0.49% by weight, less than 0.39% by weight, less than 0.29% by weight and even less than 0.19% by weight. Obviously, there are cases where the desired nominal content is 0% by weight or nominal absence of the element as occurs with all optional elements for certain applications.

It has been found that in some applications the steels benefit from having a higher content of chromium (% Cr). In different embodiments. % Cr is 2.3% by weight or higher, 3.1% by weight or higher, 3.8% by weight or higher, 4.2% by weight or higher, 5.1% by weight or higher, 6.1% by weight or higher, 7.8% by weight or higher and even 8.6% by weight or higher. In contrast, in some applications the presence of % Cr is rather detrimental. In different embodiments. % Cr is less than 12.6% by weight, less than 9.9% by weight, less than 9.4% by weight, less than 7.6% by weight, less than 6.2% by weight, less than 4.4% by weight and even less than 3.8% by weight.

It has been found that for some applications the presence of nickel (% Ni) is desirable while yet for other applications it is rather an impurity. In different embodiments, % Ni is 0.001% by weight or higher, 0.01% by weight or higher, 0.12% by weight or higher, 0.24% by weight or higher, 0.42% by weight or higher, 0.84% by weight or higher, 1.1% by weight or higher, 1.6% by weight or higher, and even 2.1% by weight or higher. In contrast, in some applications an excessively high content of % Ni is rather detrimental. In different embodiments, % Ni is less than 4.8% by weight, less than 3.9% by weight, less than 2.9% by weight, less than 1.9% by weight, less than 1.4% by weight, less than 0.9% by weight, less than 0.4% by weight and even less than 0.09% by weight. Obviously, there are cases where the desired nominal content is 0% by weight or nominal absence of the element as occurs with all optional elements for certain applications.

It has been found that in some applications the steels benefit from having a higher content of silicon (% Si). In different embodiments, % Si is 0.02% by weight or higher, 0.21% by weight or higher, 0.38% by weight or higher, 0.52% by weight or higher, 0.82% by weight or higher and even 1.01% by weight or higher. In contrast, in some applications an excessively high content of % Si is rather detrimental. In different embodiments, % Si is less than 1.7% by weight, less than 0.89% by weight, less than 0.49% by weight, less than 0.19% by weight and even less than 0.09% by weight.

It has been found that in some applications the steels benefit from having a higher content of aluminium (% Al). In different embodiments, % Al is 0.06% by weight or higher, 0.16% by weight or higher, 0.21% by weight or higher, 0.42% by weight or higher, 0.51% by weight or higher and even 0.61% by weight or higher. In contrast, in some applications an excessively high content of % Al is rather detrimental. In different embodiments, % Al is less than 0.84% by weight, less than 0.64% by weight, less than 0.49% by weight, less than 0.29% by weight and even less than 0.09% by weight. Obviously, there are cases where the desired nominal content is 0% by weight or nominal absence of the element as occurs with all optional elements for certain applications.

It has been found in some applications the steels benefit from having a higher content of manganese (% Mn). In different embodiments, % Mn is 0.08% by weight or higher, 0.12% by weight or higher, 0.23% by weight or higher, 0.44% by weight or higher, 0.71% by weight or higher, and even 1.2% by weight or higher. In contrast, in some applications an excessively high content of % Mn is rather detrimental. In different embodiments, % Mn is less than 1.9% by weight, less than 1.6% by weight, less than 0.9% by weight, less than 0.4% by weight, less than 0.19% by weight and even less than 0.09% by weight.

It has been found that for some applications the presence of molybdenum (% Mo) is desirable while yet for other applications should be limited. In different embodiments, % Mo is 0.002% by weight or higher, 0.24% by weight or higher, 0.67% by weight or higher, 1.12% by weight or higher, 1.62% by weight or higher, and even 2.1% by weight or higher. In contrast, in some applications an excessively high content of % Mo is rather detrimental. In different embodiments, % Mo is less 3.6% by weight, less than 2.8% by weight, less than 2.49% by weight, less than 1.9% by weight, less than 1.3% by weight, less than 0.8% by weight, and even less than 0.44% by weight. Obviously, there are cases where the desired nominal content is 0% by weight or nominal absence of the element as occurs with all optional elements for certain applications.

It has been found that in some applications the steels benefit from having a higher content of equivalent molybdenum (% $Mo_{eq}$, being % $Mo_{eq}$=% Mo+½*% W). In different embodiments, % $Mo_{eq}$ is 0.38% by weight or higher, 0.84% by weight or higher, 1.16% by weight or higher, 1.61% by weight or higher, 1.82% by weight or higher, 2.1% by weight or higher and even 2.6% by weight or higher. In contrast, in some applications an excessively high content of % $Mo_{eq}$ is rather detrimental. In different embodiments, % $Mo_{eq}$ is less than 3.4% by weight, less than 2.9% by weight, less than 2.6% by weight, less than 2.4% by weight, less than 1.8% by weight, less than 1.6% by weight, less than 1.4% by weight, less than 1.19% by weight, less than 1.14% by weight, less than 0.7% by weight, and even less than 0.4% by weight.

It has been found that for some applications the presence of tungsten (% W) is desirable while yet for other applications it is rather an impurity. In different embodiments, % W is 0.003% by weight or higher, 0.02% by weight or higher, 0.22% by weight or higher, 0.61% by weight or higher, 0.89% by weight or higher, 1.14% by weight or higher, 1.62% by weight or higher, 2.1% by weight or higher and even 2.6% by weight or higher. In contrast, in some applications an excessively high content of % W is rather detrimental. In different embodiments, % W is less than 4.8% by weight, less than 3.6% by weight, less than 2.9% by weight, less than 2.4% by weight, less than 1.2% by weight, less than 0.61% by weight, less than 0.43% by weight, less than 0.19% and even less than 0.09% by weight. Obviously, there are cases where the desired nominal content is 0% by weight or nominal absence of the element as occurs with all optional elements for certain applications.

It has been found that in some applications the steels benefit from having a higher content of vanadium (% V). In different embodiments, % V is 0.01% by weight or higher, 0.12% by weight or higher, 0.26% by weight or higher, 0.31% by weight or higher, 0.51% by weight or higher, 0.71% by weight or higher, 0.91% by weight or higher and even 1.1% by weight or higher. In contrast, in some applications an excessively high content of % V is rather detrimental. In different embodiments, % V is less than 1.24% by weight, less than 0.98% by weight, less than 0.49% by weight, less than 0.24% by weight and even less than 0.19% by weight. Obviously, there are cases where the desired nominal content is 0% by weight or nominal absence of the element as occurs with all optional elements for certain applications.

It has been found that in some applications the steels benefit from having a higher content of titanium (% Ti). In different embodiments, % Ti is 0.16% by weight or higher, 0.26% by weight or higher, 0.31% by weight or higher, 0.41% by weight or higher, 0.62% by weight or higher and even 0.72% by weight or higher. For some applications, when abundant primary carbides are desirable, the % Ti content should be higher, in different embodiments, % Ti is 0.89% by weight or higher, 1.21% by weight or higher, 1.51% by weight or higher, 2.1% by weight or higher, 2.6% by weight or higher and even 3.1% by weight or higher. In contrast, in some applications an excessively high content of % Ti is rather detrimental. In different embodiments, % Ti is less than 4.6% by weight, less than 4.1% by weight, less than 3.6% by weight, less than 2.8% by weight, less than 1.9% by weight, less than 1.4% by weight, less than 1.2% by weight and even less than 0.9% by weight.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.12% by weight or higher, and even 0.16% by weight or higher. In contrast, in some applications an excessively high content of % Zr is rather detrimental. In different embodiments, % Zr is less than 0.7% by weight, less than 0.42% by weight, less than 0.21% by weight, less than 0.12% by weight, less than 0.04% by weight and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.01% by weight or higher, 0.11% by weight or higher, 0.21% by weight or higher, 1.1% by weight or higher, and even 2.1% by weight or higher. In contrast, in some applications an excessively high content of % Co is rather detrimental. In different embodiments, % Co is less than 2.6% by weight, less than 2.4% by weight, less than 1.1% by weight, less than 0.4% by weight, and even less than 0.12% by weight. Obviously, there are cases where the desired nominal content is 0% by weight or nominal absence of the element as occurs with all optional elements for certain applications.

The inventor has found that the sum of % Mn+% Si can be of importance for some applications, and different levels are desirable for different embodiments. In different embodiments, % Mn+% Si is 0.03% by weight or more, 0.04% by weight or more, 0.12% by weight or more, 0.31% by weight or more and even 0.62% by weight or more. For some applications and excessive value of the sum of these elements can be detrimental. In different embodiments, % Mn+% Si is 3.9% by weight or less, 3.41% by weight or less, 2.89% by weight or less, 1.9% by weight or less, 1.42% by weight or less and even below 0.92% by weight or less. All the upper and lower limit disclosed in the different embodiments can be combined in any combination provided they are not mutually exclusive, for example % Mn+% Si=0.04-3.9% by weight.

The inventor has found that the sum of % Al+% Ti+% Ta+% Zr+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 1.9% by weight or less, 1.4% by weight or less, 0.9% by weight or less and even 0.4% by weight or less. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 0.16% by weight or more, 0.41% by weight or more, 0.71% by weight or more, 1.01% by weight or more and even 2.61% by weight or more.

The inventor has found that the sum of % Al+% Ta+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ta+% Hf+% V+% Nb+% Cu+% La+% Ce+% Nd+% Gd+% Sm+% Y+% Pr+% Sc+% Eu+% Pm is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Eu+% Pm is 0.002% by weight or more, 0.02% by weight or more, 0.12% by weight or more and even 0.21% by weight or more.

The inventor has found that for some applications certain element combinations are preferred. In an embodiment, % Ti>(% Mo+% Cr)/4. In another embodiment, % Ti>(% Mo+% Cr)/5. In another embodiment, % Ti>(% Mo+% Cr)/5.5. In another embodiment, % Ti>(% Mo+% Cr)/6. In another embodiment, % Ti>(% Mo+% Cr)/7. In another embodiment, % Ti>(% Mo+% Cr)/8 and even in some embodiments, % Ti>(% Mo+% Cr)/11. The inventor has found that for some applications certain element combinations are preferred. In an embodiment. % Ti<(% Mo+% Cr+% V+% Si+% W)/7. In another embodiment, % Ti<(% Mo+% Cr+% V+% Si+% W)/5. In another embodiment, % Ti<(% Mo+% Cr+% V+% Si+% W)/4. In another embodiment, % Ti<(% Mo+% Cr+% V+% Si+% W)/3. In another embodiment, % Ti<(% Mo+% Cr+% V+% Si+% W)/2. In another embodiment, % Ti<(% Mo+% Cr+% V+% Si+% W)/1. In another embodiment, % Ti<(% Mo+% Cr+% V+% Si+% W)/0.5.

The inventor has found that for some applications certain element combinations are preferred. In an embodiment, % Ti+% V+% W+% Nb>4. In another embodiment. % Ti+% V+% W+% Nb>6. In another embodiment, % Ti+% V+% W+% Nb>7. In another embodiment, % Ti+% V+% W+% Nb>8. In another embodiment, % Ti+% V+% W+% Nb>10. In another embodiment, % Ti+% V+% W+% Nb>11.

The inventor has found that for some applications certain element combinations are preferred. For some applications the following has to be true: % Ti/TCE<% Ceq<% Ti*TCI. In an embodiment, TCE is 4. In another embodiment, TCE is 6. In another embodiment, TCE is 8. In another embodiment, TCE is 10. In another embodiment, TCE is 11. In another embodiment. TCE is 12. In an embodiment, TCI is 0.5. In another embodiment, TCI is 1. In another embodiment, TCI is 3. In another embodiment, TO is 4. In another embodiment, TCI is 6. All the values disclosed in the different embodiments can be combined in any combination provided they are not mutually exclusive, for example: % Ti/10<% Ceq<% Ti*3.

The inventor has found that for some applications certain element combinations are preferred. In an embodiment, % Ti+% Mo+% Cr+% Nb>(% V+% W)/0.6. In another embodiment, % Ti+% Mo+% Cr+% Nb>(% V+% W)/0.8. In another embodiment. % Ti+% Mo+% Cr+% Nb>(% V+% W). In another embodiment, % Ti+% Mo+% Cr+% Nb>(% V+% W)/1.2. In another embodiment, % Ti+% Mo+% Cr+% Nb>(% V+% W)/1.4. In another embodiment, % Ti+% Mo+% Cr+% Nb>(% V+% W)/1.6. In another embodiment, % Ti+% Mo+% Cr+% Nb>(% V+% W)/2.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is preferred. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

In some applications, where wear resistance is important but simultaneously a high level of resilience or fracture toughness are also required, morphology of primary carbides can be of primordial importance. Also, many primary carbides tend to become larger the slower the cooling rate from the melting temperature, and thus are very small for powder metallurgical steels and very large for big cross sections of castings or conventionally melted and then forged blocks. This has often a strong influence in toughness related properties. To make matters worse in most alloyed tool steels segregation takes place during dendritic solidification, generally leading to enriched interdendritic liquid where the primary carbide precipitation usually takes place and thus primary carbides tend to form in those areas and are not uniformly distributed but rather aligned surrounding the dendrites. This leads again to strong reduction of toughness related properties. This is also one of the main reasons why primary carbide containing tool steels are normally forged or rolled to break those primary carbide alignments. The inventor has found that provided the right conditions, it is possible to have a uniform primary carbide distribution even in alloyed tool steels with dendritic solidification and interdendritic liquid enrichment. Moreover, it is possible to do so with carbides that have a preferable morphology and a sufficient degree of coherence to the matrix.

In some applications it has been found that sufficient but not excessive niobium content tends to control the shape and distribution of titanium-rich primary carbides. In different embodiments, % Nb is 0.05% by weight or larger, 0.11% by weight or larger, 0.21% by weight or larger and even 0.35% by weight or larger. In different embodiments, % Nb is 1.4% by weight or smaller, 0.9% by weight or smaller, 0.45% by weight or smaller, 0.19% by weight or smaller and even 0.09% by weight or smaller. In a set of embodiments, the niobium effect is only provided when chromium is present in the right amount. In an embodiment, % Cr>5*% Nb. In another embodiment, % Cr>10*% Nb. In another embodiment, % Cr>15*% Nb. In another embodiment, % Cr>20*% Nb. In an embodiment, % Cr<50*(% Nb+% Ti). In another embodiment, % Cr<3*(% Nb+% Ti). In another embodiment, % Cr<20*(% Nb+% Ti). In another embodiment, % Cr<10*(% Nb+% Ti). In another embodiment, % Cr<5*(% Nb+% Ti). In an embodiment, the aforementioned in this paragraph is specially reinforced when % Nb<% Ti/1.2. In another embodiment, the aforementioned in this paragraph is specially reinforced when % Nb<% Ti/1.5. In another embodiment, the aforementioned in this paragraph is specially reinforced when % Nb<% Ti/2. In another embodiment, the aforementioned in this paragraph is specially reinforced when % Nb<% Ti/2.5. In another embodiment, the aforementioned in this paragraph is specially reinforced when % Nb<% Ti/3.5.

In some applications it has been found that boron can be used to control the primary carbide morphology. In different embodiments, a % B of 0.01% by weight or more is used, 0.11% by weight or more, 0.51% by weight or more, 0.76% by weight or more and even 1.02% by weight or more is used. In some applications it has been found that the boron effect on the spherical microstructure of primary carbides is reinforced for powder metal. In an embodiment, the steel with the aforementioned boron additions is atomized to obtain steel powder. In different embodiments, the powder has a mean particle size (D50) of 512 microns or less, 212 microns or less and even 99 microns or less. In an embodiment, the powder is consolidated into a form or ingot. In an embodiment, the powder has a mean particle size (D50) of 55 microns or more. In an embodiment, the consolidation process involves powder forging in a can. In an embodiment, the consolidation process involves HIP. In an embodiment, D50, refers to a particle size at which 50% of the sample's volume is comprised of smaller particles in the cumulative distribution of particle size. In an embodiment, particle size is measured by laser diffraction according to ISO 13320-2009.

In some applications, it is important to be able to repair by welding, and some of those applications require high toughness in the repaired area. It has been found that for some of the steels of the present invention to be weldable with high resilience, the following has to be true: PTC1*(% Ti/% Ceq)>% Cr>PMS1*(% Mn+% Si). In an embodiment, PTC1 is 50. In another embodiment PTC1 is 30. In another embodiment, PTC1 is 20. In another embodiment, PTC1 is 15 and even in some embodiments, PTC1 is 10. In an embodiment, PMS1 is 1. In another embodiment, PMS1 is 2.3. In another embodiment, PMS1 is 3. In another embodiment, PMS1 is 3.5 and even in some embodiments, PMS1 is 5. In some embodiments, on top it has to be true that % Mo>% Ti. In some embodiments, on top it has to be true that % Mo<3*(% Ti+% Ceq). In some embodiments, it has to be true that 2.5*(% Mo+% Ti)>(% Cr−2*% Ceq).

The inventor has found that for some applications a certain relation between % B and % Ti content is preferred, and different levels are desirable for different applications. In different embodiments, % B>% Ti/3, % B>% Ti/4, % B>% Ti/4.5, % B>% Ti/5, % B>% Ti/5.5, % B>% Ti/6 and even % B>% Ti/10 is preferred.

The inventor has found that for some applications a certain relation between % B and % Ti content is preferred, and different levels are desirable for different applications. In different embodiments, 1.5*% Ti>% B, 2*% Ti>% B, 0.7*% T>% B, 0.5*% Ti>% B, and even 0.4*% Ti>% B is preferred.

In an embodiment, the steel comprises primary carbides. In different embodiments, the steel comprises more than 2.1% primary carbides, more than 3.6% primary carbides, more than 5.2% primary carbides, more than 6.1% primary carbides, more than 8.2% primary carbides and even more than 11% primary carbides. In an embodiment, the above disclosed percentages of primary carbides are by volume, in an embodiment, the primary carbides comprise also primary borides, nitrides and mixtures thereof.

The inventor has found that for some applications, a steel wherein at least part of the primary carbides have a certain size is preferred. In an embodiment, at least part of the primary carbides refers to at least a 51% of all primary carbides. In another embodiment, at least part of the primary carbides refers to at least a 66% of all primary carbides. In another embodiment, at least part of the primary carbides refers to at least a 76% of all primary carbides. In another embodiment, at least part of the primary carbides refers to at least an 81% of all primary carbides. In another embodiment, at least part of the primary carbides refers to at least an 86% of all primary carbides. In another embodiment, at least part of the primary carbides refers to at least a 91% of all primary carbides and even in some embodiments, at least part of the primary carbides refers to refers to at least a 96% of all primary carbide. In different embodiments, certain size refers to 49 microns of less, 39 microns or lese, 29 microns or less, 19 microns or less, 14 microns or less, and even 9 microns or less. The above disclosed embodiments can be combined in any combination, for example a steel wherein at least an 81% of all primary carbides have a size of 19 microns or less or a steel wherein at least an 81% of all primary carbides have a size of 49 microns or less.

The inventor has found that for some applications a certain relation between % Ti, % Ceq and % $Mo_{eq}$ content is preferred, and different levels are desirable for different applications wherein the following has to be true: % Ti/FCT<% Ceq<FCD*% Ti+% $Mo_{eq}$. In an embodiment, FCT is 1.5. In another embodiment, FCT is 1.8. In another embodiment, FCT is 2. In another embodiment, FCT is 2.2. In another embodiment, FCT is 2.5. In another embodiment, FCT is 3. In an embodiment, FCD is 1.5. In another embodiment, FCD is 2. In another embodiment, FCD is 2.5. In another embodiment, FCD is 3. In another embodiment, FCD is 3.5. All the above disclosed embodiments can be combined in any combination provided they are not mutually exclusive, for example % Ti/2<% Ceq<2° Ti+% Moeq.

In an embodiment, the microstructure of the steel comprises martensite and/or tempered martensite. In an embodiment, the microstructure comprises more than 34% martensite and/or tempered martensite. In another embodiment, the microstructure comprises more than 46% martensite and/or tempered martensite. In another embodiment, the microstructure comprises more than 48% martensite and/or tempered martensite. In another embodiment, the microstructure comprises more than 56% martensite and/or tempered martensite. In another embodiment, the microstructure comprises more than 66% martensite and/or tempered martensite. In another embodiment, the microstructure comprises more than 78% martensite and/or tempered martensite and even in some embodiments, the microstructure comprises more than 86% martensite and/or tempered martensite. For some applications the maximum content should be limited. In an embodiment, the microstructure comprises less than 99% martensite and/or tempered martensite. In another embodiment, the microstructure comprises less than 84% martensite and/or tempered martensite. In another embodiment, the microstructure comprises less than 74% martensite and/or tempered martensite. In another embodiment, the microstructure comprises less than 54% martensite and/or tempered martensite and even in some embodiments, the microstructure comprises less than 49% martensite and/or tempered martensite. In an embodiment, the above disclosed percentages of martensite and/or tempered martensite are by volume. All the above disclosed disclosed embodiments can be combined in any combination provided they are not mutually exclusive, for example a microstructure comprising more than 56% and less than 99% by volume martensite and/or tempered martensite. In an embodiment, the microstructure of the steel further comprises retained austenite, ferrite, bainite and/or primary carbides.

All the upper and lower limits disclosed in the different embodiments can be combined in any combination provided they are not mutually exclusive.

A preferred embodiment of the cold work tool steel disclosed in preceding paragraphs is a cold work tool steel comprising primary carbides having the following composition, all percentages being in weight percentage (% wt):

| | | | |
|---|---|---|---|
| % $C_{eq}$ = 0.51-1.49 | % C = 0.51-1.49 | % N = 0-0.49 | % B = 0-0.49 |
| % Cr = 2.1-14 | % Ni = 0-4.9 | % Si = 0.01-1.9 | % Al = 0-0.9 |

-continued

| | | | |
|---|---|---|---|
| % Mn = 0.01-2.8 | % Ti = 0.12-4.9 | % Mo = 0-3.9 | % W = 0-4.9 |
| % $Mo_{eq}$ = 0.26-3.9 | % Ta = 0-0.4 | % Zr = 0-0.9 | % Hf = 0-0.3 |
| % V = 0-1.4 | % Nb = 0-1.4 | % Cu = 0-1.9 | % Co = 0-2.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Pm = 0-0.3 | % Eu = 0-0.3 | | |

the rest consisting of iron and trace elements, wherein

% Ceq=% C+0.86*% N+1.2*% B, and

% $Mo_{eq}$=% Mo+½*% W, wherein % Mn+% Si=0.04-3.9.

Any embodiment disclosed in preceding paragraphs for the cold work tool steel (including any lower and upper limit for the content of any element and/or their sum) can also be applied to this preferred embodiment, provided that they are not mutually exclusive.

In an embodiment, the invention refers to a steel, in particular a cold work tool steel, having the following composition, all percentages being in weight percentage (% wt):

| | | | |
|---|---|---|---|
| % $C_{eq}$ = 0.61-0.98 | % C = 0.61-0.98 | % N = 0-0.19 | % B = 0-0.09 |
| % Cr = 3.6-9.9 | % Ni = 0-0.9 | % Si = 0.1-1.4 | % Al = 0-0.2 |
| % Mn = 0.3-1.4 | % Ti = 0.32-1.4 | % Mo = 1.1-2.8 | % W = 0-1.9 |
| % $Mo_{eq}$ = 1.1-2.9 | % Ta = 0-0.2 | % Zr = 0-0.4 | % Hf = 0-0.2 |
| % V = 0-1.4 | % Nb = 0-0.6 | % Cu = 0-0.49 | % Co = 0-0.3 |
| % La = 0-0.1 | % Ce = 0-0.1 | % Nd = 0-0.1 | % Gd = 0-0.1 |
| % Sm = 0-0.1 | % Y = 0-0.1 | % Pr = 0-0.1 | % Sc = 0-0.1 |
| % Pm = 0-0.1 | % Eu = 0-0.1 | | |

the rest consisting of iron and trace elements, wherein

% Ceq=% C+0.86*% N+1.2*% B, and

% $Mo_{eq}$=% Mo+½*% W,

Trace elements refers to several elements, unless context clearly indicates otherwise, including but not limited to, H, He, Xe, F, Ne, Na, P, S, Cl, Ar, K, Br, Kr, Sr, Tc, Ru, Rh, Pd, Ag, I, Be, Re, Os, Ir, Pt, Au, Hg, Tl, Po, At, Rn, Fr, Ra, Ac, Pa, U, Np, Pu, Am, Cm, Sk, Cf, Es, Fm, Md, No, Lr, Rf, db, Sg, Bh, Hs, Cs, Tb, Dy, Ho, Er, Tm, Yb, Lu, O, U, Be, Mg, Ca, Rb, Zn, Cd, Ga, In, Ge, Sn, Pb, Bi, Sb, As, Se, Te, Th, Ds, Rg, Cn, Nh, Fl, Mc, Lv, Ts, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments, the sum of all trace elements in the steel is below 2.0% by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% Ceq). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % Ceq should not be too high. In different embodiments, % Ceq is 0.91% by weight or less, 0.88% by weight or less, 0.82% by weight or less, 0.78% by weight or less and even 0.74% by weight or less. Some applications, like sometimes applications requiring a rather good polishing ability in the tool steel or good weldability it is often interesting to keep even lower levels of % Ceq. In different embodiments, % Ceq is 0.71% by weight or less, 0.68% by weight or less, and even 0.67% by weight or less. In contrast, in some applications higher contents of % Ceq are preferred. In different embodiments, % Ceq is above 0.62% by weight, above 0.84% by weight, above 0.68% by weight and even above 0.72% by weight. For some applications, if abundant primary carbides are desirable, then the % Ceq content should be higher, in different embodiments, % Ceq is 0.73% by weight or more, 0.76% by weight or more and even 0.78% by weight or more.

Different applications require different levels of carbon (% C). For some applications, % C should not be too high. In different embodiments, % C is 0.91% by weight or less, 0.88% by weight or less, 0.82% by weight or less, 0.78% by weight or less and even 0.74% by weight or less. Some applications, like sometimes applications requiring a rather good polishing ability in the tool steel or good weldability it is often interesting to keep even lower levels of % C. In different embodiments, % C is 0.71% by weight or less, 0.68% by weight or less, and even 0.67% by weight or less. In contrast, in some applications higher contents of % C are preferred. In different embodiments, % C is above 0.66% by weight, above 0.69% by weight, above 0.71% by weight and even above 0.72% by weight. For some applications, if abundant primary carbides are desirable, then the % C content should be higher, in different embodiments, % C is 0.74% by weight or more, 0.77% by weight or more and even 0.79% by weight or more.

It has been found that for some applications the presence of nitrogen (% N) is desirable while yet for other applications it is rather an impurity. In different embodiments, % N is 0.002% by weight or higher, 0.01% by weight or higher and even 0.09% by weight or higher. In contrast, in some applications an excessively high content of % N is rather detrimental. In different embodiments, % N is less than 0.14% by weight, less than 0.1% by weight, less than 0.01% by weight, less than 0.006% by weight, and even less than 0.002% by weight. Obviously, there are cases where the desired nominal content is 0% by weight or nominal absence of the element as occurs with all optional elements for certain applications.

It has been found that for some applications the presence of boron (% B) is desirable while yet for other applications it is rather an impurity. In different embodiments, % B is above 1 ppm by weight, above 11 ppm by weight, above 26 ppm by weight, above 32 ppm by weight, above 42 ppm by weight, 0.00002% by weight or higher, 0.0009% by weight or higher and even 0.01% by weight or higher. In some applications if primary borides or carbo-nitro borides are desirable, then the % B content should be higher, in different embodiments, % B is 0.01% by weight or higher, 0.02% by weight or higher and even 0.04% by weight or higher. In contrast, in some applications an excessively high content of % B is rather detrimental. In different embodiments, % B is less than 0.08% by weight, less than 0.035% by weight, less than 0.002% by weight, less than 0.001% by weight, and even less than 0.0002% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is above 0.001% by weight, above 0.04% by weight, above 0.11% by weight, above 0.21% by weight, above 0.31% by weight and even above 0.41% by weight. In contrast, in some applications an excessively high content of % Nb is rather detrimental. In different embodiments, % Nb is less than 0.52% by weight, less than 0.49% by weight, less than 0.39% by weight, less than 029% by weight and even less than 0.19% by weight. Obviously, there are cases where the desired nominal content is 0% by weight or nominal absence of the element as occurs with all optional elements for certain applications.

It has been found that in some applications the steels benefit from having a higher content of chromium (% Cr). In different embodiments, % Cr is 3.8% by weight or higher, 4.2% by weight or higher, 4.62% by weight or higher, 5.1% by weight or higher, 6.61% by weight or higher, 7.8% by weight or higher and even 8.6% by weight or higher. In contrast, in some applications an excessively high content of % Cr is rather detrimental. In different embodiments, % Cr is less than 9.7% by weight, less than 8.9% by weight, less than 7.6% by weight, less than 6.2% by weight, less than 5.4% by weight and even less than 4.9% by weight.

It has been found that for some applications the presence of nickel (% Ni) is desirable while yet for other applications it is rather an impurity. In different embodiments, % Ni is 0.001% by weight or higher, 0.01% by weight or higher, 0.12% by weight or higher, 0.24% by weight or higher, 0.42% by weight or higher, and even 0.84% by weight or higher. In contrast, in some applications an excessively high content of % Ni is rather detrimental. In different embodiments, % Ni is less than 0.8% by weight, less than 0.6% by weight, less than 0.4% by weight, less than 0.12% by weight, less than 0.09% by weight, and even less than 0.001% by weight. Obviously, there are cases where the desired nominal content is 0% by weight or nominal absence of the element as occurs with all optional elements for certain applications.

It has been found that in some applications the steels benefit from having a higher content of silicon (% Si). In different embodiments, % Si is 0.18% by weight or higher, 0.21% by weight or higher, 0.36% by weight or higher, 0.38% by weight or higher, 0.41% by weight or higher, 0.52% by weight or higher, 0.82% by weight or higher and even 1.01% by weight or higher. In contrast, in different embodiments, the presence of % Si is rather detrimental. In different embodiments, % Si is less than 12% by weight, less than 0.89% by weight, less than 0.49% by weight, less than 0.19% by weight and even less than 0.17% by weight.

It has been found that in some application the steels benefit from having a higher content of manganese (% Mn). In different embodiments, % Mn is 0.08% by weight or higher, 0.12% by weight or higher, 0.23% by weight or higher, 0.44% by weight or higher, 0.51% by weight or higher, 0.71% by weight or higher, and even 1.2% by weight or higher. In contrast, in some applications the presence of % Mn is rather detrimental. In different embodiments, % Mn is less than 1.2% by weight, less than 1.1% by weight, less than 0.9% by weight, and even less than 0.4% by weight.

It has been found that in some applications the steels benefit from having a higher content of aluminium (% Al). In different embodiments, % Al is 0.002% by weight or higher, 0.01% by weight or higher, 0.09% by weight or higher, 0.1% by weight or higher and even 0.16% by weight or higher. In contrast, in some applications an excessively high content of % Al is rather detrimental. In different embodiments, % Al is less than 0.19% by weight, less than 0.14% by weight, less than 0.09% by weight and even less than 0.009% by weight. Obviously, there are cases where the desired nominal content is 0% by weight or nominal absence of the element as occurs with all optional elements for certain applications.

It has been found that in some applications the steels benefit from having a higher content of molybdenum (% Mo). In different embodiments, % Mo is 1.2% by weight or higher, 1.3% by weight or higher, 1.4% by weight or higher, 1.6% by weight or higher, 1.7% by weight or higher, 1.9% by weight or higher, and even 2.1% by weight or higher. In contrast, in some applications the presence of % Mo is rather detrimental. In different embodiments, % Mo is less 2.8% by weight, less than 2.49% by weight, less than 2.4% by weight, less than 2.1% by weight, less than 1.9% by weight, less than 1.7% by weight, and even less than 1.3% by weight.

It has been found that in some applications the steels benefit from having a higher content of equivalent molybdenum (% $Mo_{eq}$, being % $Mo_{eq}$=% Mo+½*% W). In different embodiments, % $Mo_{eq}$ is 1.16% by weight or higher, 1.81% by weight or higher, 1.82% by weight or higher, 2.1% by weight or higher and even 2.6% by weight or higher. In contrast, in some applications the presence of % $Mo_{eq}$ is rather detrimental. In different embodiments, % $Mo_{eq}$ is less than 2.8% by weight, less than 2.7% by weight, less than 2.2% by weight, less than 1.8% by weight, and even less than 1.6% by weight.

It has been found that for some applications the presence of tungsten (% W) is desirable while yet for other applications it is rather an impurity. In different embodiments, % W is 0.003% by weight or higher, 0.02% by weight or higher, 0.22% by weight or higher, 0.61% by weight or higher, 0.89% by weight or higher, 1.14% by weight or higher, and even 1.62% by weight or higher. In contrast, in some applications an excessively high content of % W is rather detrimental. In different embodiments, % W is less than 1.8% by weight, less than 1.6% by weight, less than 12% by weight, less than 0.61% by weight, less than 0.43% by weight, less than 0.19% by weight, and even less than 0.09% by weight. Obviously, there are cases where the desired nominal content is 0% by weight or nominal absence of the element as occurs with all optional elements for certain applications.

It has been found that in some applications the steels benefit from having a higher content of vanadium (% V). In different embodiments, % V is 0.001% by weight or higher, 0.12% by weight or higher, 0.36% by weight or higher, 0.41% by weight or higher, 0.71% by weight or higher and even 1.12% by weight or higher. In contrast, in some applications an excessively high content of % V is rather detrimental. In different embodiments, % V is less than 1.14% by weight, less than 0.94% by weight, less than 0.49% by weight, less than 0.29% by weight and even less than 0.14% by weight. Obviously, there are cases where the desired nominal content is 0% by weight or nominal absence of the element as occurs with all optional elements for certain applications.

It has been found that in some applications the steels benefit from having a higher content of titanium (% Ti). In different embodiments, % Ti is 0.41% by weight or higher, 0.56% by weight or higher, 0.62% by weight or higher, and even 0.72% by weight or higher. For some applications, when abundant primary carbides are desirable, the % Ti content should be higher, in different embodiments, % Ti is 0.89% by weight or higher, 0.96% by weight or higher, 1.01% by weight or higher, 1.16% by weight or higher, and even 1.21% by weight or higher. In contrast, in some applications an excessively high content of % Ti is rather detrimental. In different embodiments, % Ti is less than 1.2% by weight, less than 0.9% by weight, less than 0.74% by weight, less than 0.63% by weight, less than 0.58% by weight, and even less than 0.46% by weight.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.12% by weight or higher, and even 0.16% by weight or higher. In contrast, in some applications an excessively high content of % Zr is rather detrimental. In different embodiments, % Zr is less 0.34% by weight, less than 0.29% by weight, less than 0.21% by weight, les than 0.12% by weight, less than 0.04% by weight and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.001% by weight or higher, 0.01% by weight or higher, 0.09% by weight or higher, 0.11% by weight or higher, and even 0.21% by weight or higher. In contrast, in some applications an excessively high content of % Co is rather detrimental. In different embodiments, % Co is less than 0.22% by weight, less than 0.19% by weight, less than 0.12% by weight, less than 0.04% by weight, and even less than 0.002% by weight. Obviously, there are cases where the desired nominal content is 0% by weight or nominal absence of the element as occurs with all optional elements for certain applications.

The inventor has found that the sum of % Al+% Ti+% Ta+% Zr+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 1.9% by weight or less, 1.4% by weight or less, 0.9% by weight or less and even 0.4% by weight or less. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 0.41% by weight or more, 0.61% by weight or more, 0.71% by weight or more, 0.83% by weight or more and even 1.01% by weight or more.

The inventor has found that the sum of % Al+% Ta+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ta+% Hf+% V+% Nb+% Cu+% La+% Ce+% Nd+% Gd+% Sm+% Y+% Pr+% Sc+% Eu+% Pm is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Eu+% Pm is 0.002% by weight or more, 0.02% by weight or more, 0.12% by weight or more and even 0.21% by weight or more.

The inventor has found that for some applications certain element combinations are preferred. In an embodiment, % Ti>(% Mo+% Cr)/4. In another embodiment, % Ti>(% Mo+% Cr)/5. In another embodiment, % Ti>(% Mo+% Cr)/5.5. In another embodiment, % Ti>(% Mo+% Cr)/6. In another embodiment, % Ti>(% Mo+% Cr)/7. In another embodiment, % Ti>(% Mo+% Cr)/8. In another embodiment, % Ti>(% Mo+% Cr)/11.

The inventor has found that for some applications certain element combinations are preferred. In an embodiment, % Ti<(% Mo+% Cr+% V+% Si+% W)/7. In another embodiment, % Ti<(% Mo+% Cr+% V+% Si+% W)/5. In another embodiment, % Ti<(% Mo+% Cr+% V+% Si+% W)/4. In another embodiment, % Ti<(% Mo+% Cr+% V+% Si+% W)/3. In another embodiment, % Ti<(% Mo+% Cr+% V+% Si+% W)/2, in another embodiment, % Ti<(% Mo+% Cr+% V+% Si+% W)/1. In another embodiment, % Ti<(% Mo+% Cr+% V+% Si+% W)/0.5.

The inventor has found that for some applications certain element combinations are preferred. In an embodiment, % Ti+% V+% W+% Nb>4. In another embodiment, % Ti+% V+% W+% Nb>6, % Ti+% V+% W+% Nb>7. In another embodiment, % Ti+% V+% W+% Nb>8. In another embodiment, % Ti+% V+% W+% Nb>10. In another embodiment, % Ti+% V+% W+% Nb>11.

The inventor has found that for some applications certain element combinations are preferred. For some applications the following has to be true: % Ti/TCE<% Ceq<% Ti*TCI. In an embodiment, TCE is 4. In another embodiment, TCE is 6. In another embodiment, TCE is 8. In another embodiment, TCE is 10. In another embodiment, TCE is 11. In another embodiment, TCE is 12. In an embodiment, TCI is 0.5. In another embodiment, TCI is 1. In another embodiment, TCI is 3. In another embodiment, TCI is 4. In another embodiment, TCI is 6. All the values disclosed in the different embodiments can be combined in any combination provided they are not mutually exclusive, for example: % Ti/10<% Ceq<% Ti*3.

The inventor has found that for some applications certain element combinations are preferred. In an embodiment, % Ti+% Mo+% Cr+% Nb>(% V+% W)/0.6. In another embodiment, % Ti+% Mo+% Cr+% Nb>(% V+% W)/0.8. In another embodiment, % Ti+% Mo+% Cr+% Nb>(% V+% W). In another embodiment, % Ti+% Mo+% Cr+% Nb>(% V+% W)/1.2. In another embodiment, % Ti+% Mo+% Cr+% Nb>(% V+% W)/1.4. In another embodiment, % Ti+% Mo+% Cr+% Nb>(% V+% W)/1.6. In another embodiment, % Ti+% Mo+% Cr+% Nb>(% V+% W)/2.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is preferred. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

In some applications, where wear resistance is important but simultaneously a high level of resilience or fracture toughness are also required, morphology of primary carbides can be of primordial importance. Also, many primary carbides tend to become larger the slower the cooling rate from the melting temperature, and thus are very small for powder metallurgical steels and very large for big cross sections of castings or conventionally melted and then forged blocks. This has often a strong influence in toughness related properties. To make matters worse in most alloyed tool steels segregation takes place during dendritic solidification, generally leading to enriched interdendritic liquid where the primary carbide precipitation usually takes place and thus primary carbides tend to form in those areas and are not uniformly distributed but rather aligned surrounding the dendrites. This leads again to strong reduction of toughness related properties. This is also one of the main reasons why primary carbide containing tool steels are normally forged or rolled to break those primary carbide alignments. The inventor has found that provided the right conditions, it is possible to have a uniform primary carbide distribution even in alloyed tool steels with dendritic solidification and interdendritic liquid enrichment. Moreover, it is possible to do so with carbides that have a preferable morphology and a sufficient degree of coherence to the matrix.

In some applications it has been found that sufficient but not excessive niobium content tends to control the shape and distribution of titanium-rich primary carbides. In different embodiments, % Nb is 0.05% by weight or larger, 0.11% by weight or larger, 0.21% by weight or larger and even 0.35% by weight or larger. In different embodiments, the % Nb is 1.4% by weight or smaller, 0.9% by weight or smaller, 0.45% by weight or smaller, 0.19% by weight or smaller and even 0.09% by weight or smaller. In a set of embodiments, the niobium effect is only provided when chromium is present in the right amount. In an embodiment, % Cr>5*% Nb. In another embodiment, % Cr>10*% Nb. In another embodiment, % Cr>15*% Nb. In another embodiment, % Cr>20*% Nb. In an embodiment, % Cr<50*(% Nb+% Ti). In another embodiment, % Cr<30*(% Nb+% Ti). In another embodiment, % Cr<20*(% Nb+% Ti). In another embodiment, % Cr<10*(% Nb+% Ti). In another embodiment, % Cr<5*(% Nb+% Ti). In an embodiment, the aforementioned in this paragraph is specially reinforced when % Nb<% Ti/1.2. In another embodiment, the aforementioned in this paragraph is specially reinforced when % Nb<% Ti/1.5. In another embodiment, the aforementioned in this paragraph is specially reinforced when % Nb<% Ti/2. In another embodiment, the aforementioned in this paragraph is specially reinforced when % Nb<% Ti/2.5. In another embodiment, the aforementioned in this paragraph is specially reinforced when % Nb<% Ti/3.5.

In some applications it has been found that boron can be used to control the primary carbide morphology. In different embodiments, a % B of 0.01% by weight or more is used, 0.11% by weight or more, 0.51% by weight or more, 0.76% by weight or more and even 1.02% by weight or more is used. In some applications it has been found that the boron effect on the spherical microstructure of primary carbides is reinforced for powder metal, in an embodiment, the steel with the aforementioned boron additions is atomized to obtain steel powder. In different embodiments, the powder has a mean particle size (D50) of 512 microns or less, 212 microns or less and even 99 microns or less. In an embodiment, the powder is consolidated into a form or ingot. In an embodiment, the powder has a mean particle size (D50) of 55 microns or more. In an embodiment, the consolidation process involves powder forging in a can. In an embodiment, the consolidation process involves HIP. In an embodiment, D50, refers to a particle size at which 50% of the sample's volume is comprised of smaller particles in the cumulative distribution of particle size. In an embodiment, particle size is measured by laser diffraction according to ISO 13320-2009.

In some applications, it is important to be able to repair by welding, and some of those applications require high toughness in the repaired area. It has been found that for some of the steels of the present invention to be weldable with high resilience, the following has to be true: PTC1*(% Ti/% Ceq)>% Cr>PMS1*(% Mn+% Si). In an embodiment, PTC1 is 50. In another embodiment, PTC1 is 30. In another embodiment, PTC1 is 20. In another embodiment, PTC1 is 15 and even in some embodiment, PTC1 is 10. In an embodiment, PMS1 is 1. In another embodiment, PMS1 is 2.3. In another embodiment, PMS1 is 3. In another embodiment, PMS1 is 3.5 and even in some embodiments, PMS1 is 5. In some embodiments, on top it has to be true that % Mo>% Ti. In some embodiments, on top it has to be true that % Mo<3*(% Ti+% Ceq). In some embodiments, it has to be true that 2.5*(% Mo+% Ti)>(% Cr−2*% Ceq).

The inventor has found that for some applications a certain relation between % B and % Ti content is preferred, and different levels are desirable for different applications. In different embodiments, 50% B>% Ti/3, % By % Ti/4, % B>% Ti/4.5, % B>% Ti/5, % B>% Ti/5.5, % B>% Ti/6 and even % B>% Ti/10 is preferred.

The inventor has found that for some applications a certain relation between % B and % Ti content is preferred, and different levels are desirable for different applications. In different embodiments, 1.5*% Ti>% B, 2*% Ti>% B, 0.7*% Ti>% B, 0.5*% Ti>% B, and even 0.4*% Ti>% B is preferred.

In an embodiment, the steel comprises primary carbides. In different embodiments, the steel comprises more than 2.1% primary carbides, more than 3.6% primary carbides, more than 5.2% primary carbides, more than 6.1% primary carbides, more than 8.2% primary carbides and even more than 11% primary carbides. In an embodiment, the above disclosed percentages of primary carbides are by volume. In an embodiment, the primary carbides comprise also primary borides, nitrides and mixtures thereof.

The inventor has found that for some applications, a steel wherein at least part of the primary carbides have a certain size is preferred. In an embodiment, at least part of the primary carbides refers to at least a 51% of all primary carbides. In another embodiment, at least part of the primary carbides refers to at least a 66% of all primary carbides. In another embodiment, at least part of the primary carbides refers to at least a 76% of all primary carbides. In another embodiment, at least part of the primary carbides refers to at least an 81% of all primary carbides. In another embodiment, at least part of the primary carbides refers to at least an 86% of all primary carbides. In another embodiment, at least part of the primary carbides refers to at least a 91% of all primary carbides and even in some embodiments, at least part of the primary carbides refers to refers to at least a 96% of all primary carbides. In different embodiments, certain size refers to 49 microns of less, 39 microns or less, 29 microns or less, 19 microns or less, 14 microns or less, and even 9 microns or less. The above disclosed embodiments, can be combined in any combination, for example a steel wherein at least an 81% of all primary carbides have a size of 19 microns or less or a steel wherein at least an 81% of all primary carbides have a size of 49 microns or less.

The inventor has found that for some applications a certain relation between % Ti, % Ceq and % $Mo_{eq}$ content is preferred, and different levels are desirable for different applications wherein the following has to be true: % Ti/FCT<% Ceq<FCD*% Ti+% $Mo_{eq}$. In an embodiment, FCT is 1.5. In another embodiment, FCT is 1.8. In another embodiment, FCT is 2. In another embodiment, FCT is 2.2. In another embodiment, FCT is 2.5. In another embodiment, FCT is 3. In an embodiment, FCD is 1.5. In another embodiment, FCD is 2. In another embodiment, FCD is 2.5. In another embodiment, FCD is 3. In another embodiment, FCD is 3.5. All the above disclosed embodiments can be combined in any combination provided they are not mutually exclusive, for example % Ti/2<% Ceq<2*Ti+% Moeq.

In an embodiment, the microstructure of the steel comprises martensite and/or tempered martensite. In an embodiment, the microstructure comprises more than 34% martensite and/or tempered martensite. In another embodiment, the microstructure comprises more than 48% martensite and/or tempered martensite. In another embodiment, the microstructure comprises more than 48% martensite and/or tempered martensite. In another embodiment, the microstructure comprises more than 56% martensite and/or tempered martensite. In another embodiment, the microstructure comprises more than 66% martensite and/or tempered martensite. In another embodiment, the microstructure comprises more than 78% martensite and/or tempered martensite and even in some embodiments, the microstructure comprises more than 86% martensite and/or tempered martensite. For some applications the maximum content should be limited. In an embodiment, the microstructure comprises less than 99% martensite and/or tempered martensite. In another embodiment, the microstructure comprises less than 84% martensite and/or tempered martensite. In another embodiment, the microstructure comprises less than 74% martensite and/or tempered martensite. In another embodiment, the microstructure comprises less than 54% martensite and/or tempered martensite and even in some embodiments, the microstructure comprises less than 49% martensite and/or tempered martensite. In an embodiment, the above disclosed percentages of martensite and/or tempered martensite are by volume. All the above disclosed embodiments can be combined in any combination provided they are not mutually exclusive, for example a microstructure comprising more than 56% and less than 99% by volume martensite and/or tempered martensite. In an embodiment, the microstructure of the steel further comprises retained austenite, ferrite, bainite and/or primary carbides.

All the upper and lower limits disclosed in the different embodiments can be combined in any combination provided they are not mutually exclusive.

A preferred embodiment of the cold work tool steel disclosed in preceding paragraphs is a cold work tool steel comprising primary carbides having the following composition, all percentages being in weight percentage (% wt):

| | | | |
|---|---|---|---|
| % $C_{eq}$ = 0.61-0.98 | % C = 0.61-0.98 | % N = 0-0.19 | % B = 0-0.09 |
| % Cr = 3.6-9.9 | % Ni = 0-0.9 | % Si = 0.1-1.4 | % Al = 0-0.2 |
| % Mn = 0.3-1.4 | % Ti = 0.32-1.4 | % Mo = 1.1-2.8 | % W = 0-1.9 |
| % $Mo_{eq}$ = 1.1-2.9 | % Ta = 0-0.2 | % Zr = 0-0.4 | % Hf = 0-0.2 |
| % V = 0-1.4 | % Nb = 0-0.6 | % Cu = 0-0.49 | % Co = 0-0.3 |
| % La = 0-0.1 | % Ce = 0-0.1 | % Nd = 0-0.1 | % Gd = 0-0.1 |
| % Sm = 0-0.1 | % Y = 0-0.1 | % Pr = 0-0.1 | % Sc = 0-0.1 |
| % Pm = 0-0.1 | % Eu = 0-0.1 | | |

the rest consisting of iron and trace elements, wherein

% Ceq=% C+0.86*% N+1.2*% B, and

% $Mo_{eq}$=% Mo+½*% W.

Wherein the microstructure comprises more than 56% and less than 99% martensite and/or tempered martensite.

Any embodiment disclosed in preceding paragraphs for the cold work tool steel (including any lower and upper limit for the content of any element and/or their sum) can also be applied to this preferred embodiment, provided that they are not mutually exclusive.

In an embodiment, the invention refers to a steel, in particular an extreme wear resistance tool steel, having the following composition, all percentages being in weight percentage (% wt):

| | | | |
|---|---|---|---|
| % Ceq = 1.26-4.68 | % C = 0.6-4.4 | % N = 0-2.9 | % B = 0-3.4 |
| % Cr = 0-11 | % Ni = 0-8 | % Si = 0-2.5 | % Mn = 0-3 |
| % Al = 0-2.5 | % Mo = 0-12 | % W = 0-14 | % Ti = 1.5-14 |
| % Ta = 0-3 | % Zr = 0-4 | % Hf = 0-3 | % V = 0-12 |
| % Nb = 0-9 | % Cu = 0-2 | % Co = 0-14 | % $Mo_{eq}$ = 0.5-16 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |
| % Lu = 0-2 | | | |

the rest consisting of iron and trace elements, wherein

% Ceq=% C+0.86*% N+1.2*% B, and

% $Mo_{eq}$=% Mo+½*% W.

Trace elements refers to several elements, unless context clearly indicates otherwise, including but not limited to, H, He, Xe, F, Ne, Na, P, S, Cl, Ar, K, Br, Kr, Sr, Tc, Ru, Rh, Pd, Ag, I, Ba, Re, Os, Ir, Pt, Au, Hg, Tl, Po, At, Rn, Fr, Ra, Ac, Pa, U, Np, Pu, Am, Cm, Sk, Cf, Es, Fm, Md, No, Lr, Rf, db, Sg, Bh, Ha, O, Li, Be, Mg, Ca, Rb, Zn, Cd, Ga, In, Cs, Ge, Sn, Pb, Bi, Sb, As, Se, Te, Th, Ds, Rg, Cn, Nh, Fl, Mc, Lv, Ta, Og and Mt. In an embodiment, trace elements comprise at least one of the elements listed above.

Trace elements may be added intentionally to attain a particular functionality to the steel, such as reducing the cost of production and/or its presence may be unintentional and related mostly to the presence of impurities in the alloying elements and scraps used for the production of the steel.

The inventor has found that it is important for some applications limit the content of any trace element to amounts of less than 1.8% by weight, less than 0.8% by weight, less than 0.3% by weight, less than 0.1% by weight, less than 0.09% by weight and even below 0.03% by weight.

There are several applications wherein the presence of trace elements is detrimental for the overall properties of the steel. In different embodiments, the sum of all trace elements in the steel is below 2.0% by weight, below 1.4% by weight, below 0.8% by weight, below 0.4% by weight, below 0.2% by weight, below 0.1% by weight and even below 0.06% by weight. There are even some embodiments for a given application wherein trace elements are preferred being absent from the steel.

There are several applications wherein the presence of trace elements is preferred. In different embodiments, the sum of all trace elements is above 0.0012% by weight, above 0.012% by weight, above 0.06% by weight, above 0.12% by weight and even above 0.55% by weight.

Different applications require different levels of equivalent carbon (% Ceq). Also, the level of equivalent carbon together with the rest of the alloying, with special mention to carbide formers, determines the plausible volume fractions of primary carbides or the absence thereof. For some applications, where excessive primary carbides are rather not desirable like is the case in applications where the toughness requirements are more detrimental than the wear resistance ones, % Ceq should not be too high. In different embodiments, % Ceq is 4.26% by weight or less, 3.9% by weight or less, 3.7% by weight or less, 3.6% by weight or less and even 3.4% by weight or less. Some applications, like sometimes applications requiring a rather good polishing ability in the tool steel or good weldability it is often interesting to keep even lower levels of % Ceq. In different embodiments, % Ceq is 3.2% by weight or less, 2.9% by weight or less, and even 2.7% by weight or less. Even for some applications % Ceq should not be too high, in different embodiments, % Ceq is 2.4% by weight or less, 1.9% by weight or less, 1.42% by weight or less and even 1.29% by weight or less. In contrast, in some applications higher contents of % Ceq are preferred. In different embodiments, % Ceq is above 1.36% by weight, above 1.48% by weight, above 1.89% by weight, above 2.16% by weight, above 2.3% by weight and even above 2.7% by weight. For some applications, if abundant primary carbides are desirable, then the % Ceq content should be higher, in different embodiments, % Ceq is 2.9% by weight or more, 3.1% by weight or more, 3.3% by weight or more, 3.6% by weight or more and oven 3.8% by weight or more.

Different applications require different levels of carbon (% C). For some applications, % C should not be too high. In different embodiments, % C is 4.26% by weight or less, 3.9% by weight or less, 3.7% by weight or less, 3.6% by weight or less and even 3.4% by weight or less. Some applications, like sometimes applications requiring a rather good polishing ability in the tool steel or good weldability it is often interesting to keep even lower levels of % C, in different embodiments, % C is 3.2% by weight or less, 2.9% by weight or less, and even 2.6% by weight or less. For some applications % C should not be too high, in different embodiments, % C is 2.3% by weight or less, 1.8% by weight or less, 1.32% by weight or less, 1.19% by weight or less, 0.9% by weight or less and even 0.83% by weight or less. In contrast, in some applications higher contents of % C are preferred. In different embodiments, % C is above 0.86% by weight, above 1.16% by weight, above 1.62% by weight, above 2.16% by weight, above 2.28% by weight and even above 2.36% by weight. For some applications, if abundant primary carbides are desirable, then the % C content should be higher, in different embodiments, % C is 2.61% by weight or more, 2.9% by weight or more, 3.2% by weight or more, 3.4% by weight or more and even 3.7% by weight or more.

It has been found that for some applications the presence of nitrogen (% N) is desirable while yet for other applications it is rather an impurity. In different embodiments, % N is 0.002% by weight or higher, 0.01% by weight or higher, 0.09% by weight or higher, 0.18% by weight or higher, 0.59% by weight or higher, 0.91% by weight or higher, 1.18% by weight or higher and even 1.61% by weight or higher. In contrast, in some applications an excessively high content of % N is rather detrimental. In different embodiments, % N is less than 2.6% by weight, less than 2.4% by weight, less than 1.8% by weight, less than 1.2% by weight, less than 0.89% by weight, less than 0.44% by weight, les than 0.1% by weight, less than 0.01% by weight, less than 0.006% by weight and even less than 0.002% by weight. Obviously, there are cases where the desired nominal content is 0% by weight or nominal absence of the element as occurs with all optional elements for certain applications.

It has been found that for some applications the presence of boron (% B) is desirable while yet for other applications it is rather an impurity. In different embodiments, % B is above 1 ppm by weight, above 11 ppm by weight, 26 ppm by weight, above 32 ppm by weight and even above 42 ppm by weight. In some applications if primary borides or carbo-nitro borides are desirable, then the % B content should be higher, in different embodiments, % B is 0.01% by weight or higher, 0.02% by weight or higher, 0.04% by weight or higher, 0.1% by weight or higher, 0.26% by weight or higher and even 0.36% by weight or higher. For some applications, even higher % B contents are preferred, in different embodiments, % B is 0.62% by weight or more, 0.12% by weight or more, 1.62% by weight or more, 2.18% by weight or more and even 2.63% by weight or more. In contrast, in some applications an excessively high content of % B is rather detrimental. In different embodiments, % B is less than 3.1% by weight, less than 2.8% by weight, less than 2.4% by weight, less than 1.9% by weight, less than 0.43% by weight, less than 0.38% by weight, less than 0.21% by weight, less than 0.035% by weight and even less than 0.002% by weight. Obviously, there are cases where the desired nominal content is 0% by weight or nominal absence of the element as occurs with all optional elements for certain applications.

It has been found that for some applications the presence of niobium (% Nb) is desirable while yet for other applications it is rather an impurity. In different embodiments, % Nb is above 0.001% by weight, above 0.04% by weight, above 0.11% by weight, above 0.21% by weight, above 0.31% by weight and even above 0.41% by weight. For some applications even higher levels are preferred, in different embodiments, % Nb is 0.63% by weight or more, 1.16% by weight or more, 2.62% by weight or more, 3.14% by weight or more, 4.12% by weight or more and even 5.68% by weight or more. In contrast, in some applications an excessively high content of % Nb is rather detrimental. In different embodiments, % Nb is less than 8.41% by weight, less than 7.2% by weight, less than 6.32% by weight, less than 4.91% by weight, less than 3.86% by weight, less than 2.93% by weight, less than 2.41% by weight, less than 1.89% by weight, and even less than 1.43% by weight. For some applications even lower levels are preferred. In different embodiments, % Nb is less than 0.9% by weight, less than 0.49% by weight, less than 0.39% by weight, less than 0.29% by weight and even less than 0.19% by weight. Obviously, there are cases where the desired nominal content is 0% by weight or nominal absence of the element as occurs with all optional elements for certain applications.

It has been found that for some applications the presence of chromium (% Cr) is desirable while yet for other applications it is rather an impurity. In different embodiments, % Cr is 0.12% by weight or higher, 0.34% by weight or higher 1.8% by weight or higher, 2.3% by weight or higher, 3.1% by weight or higher, 3.8% by weight or higher, 4.2% by weight or higher, 5.1% by weight or higher, 7.8% by weight or higher and even 8.6% by weight or higher. In contrast, in some applications an excessively high content of % Cr is rather detrimental. In different embodiments, % Cr is less than 9.9% by weight, less than 8.9% by weight, less than 7.6% by weight, less than 6.2% by weight, less than 3.8% by weight, less than 2.9% by weight, less than 1.9% by weight, and even less than 1.4% by weight. Obviously, there are cases where the desired nominal content is 0% by weight or nominal absence of the element as occurs with all optional elements for certain applications.

It has been found that for some applications the presence of nickel (% Ni) is desirable while yet for other applications it is rather an impurity. In different embodiments, % Ni is 0.001% by weight or higher, 0.1% by weight or higher, 0.12% by weight or higher, 0.24% by weight or higher, 0.42% by weight or higher and even 0.84% by weight or higher. For some applications even higher levels are preferred. In different embodiments. % Ni is 1.18% by weight or higher, 1.66% by weight or higher, 2.6% by weight or higher, 3.21% by weight or higher, 3.64% by weight or higher, 4.1% by weight or higher, and even 5.1% by weight or higher. In contrast, in some applications an excessively high content of % Ni is rather detrimental. In different embodiments, % Ni is less than 7.2% by weight, less than 6.1% by weight, less than 5.9% by weight, less than 4.8% by weight, less than 3.9% by weight, less than 2.9% by weight, less than 1.9% by weight, less than 1.4% by weight, less than 0.9% by weight, less than 0.4% by weight and even less than 0.09% by weight. Obviously, there are cases where the desired nominal content is 0% by weight or nominal absence of the element as occurs with all optional elements for certain applications.

It has been found that for some applications the presence of silicon (% Si) is desirable while yet for other applications it is rather an impurity. In different embodiments, % Si is 0.02% by weight or higher, 0.21% by weight or higher, 0.38% by weight or higher, 0.52% by weight or higher, 0.82% by weight or higher, 1.01% by weight or higher and even 1.61% by weight or higher. In contrast, in some applications an excessively high content of % Si is rather detrimental. In different embodiments, % Si is less than 2.1% by weight, less than 1.7% by weight, less than 1.48% by weight, less than 0.89% by weight, less than 0.49% by weight, less than 0.19% by weight, and even less than 0.09% by weight. Obviously, there are cases where the desired nominal content is 0% by weight or nominal absence of the element as occurs with all optional elements for certain applications.

It has been found that in some applications the steels benefit from having a higher content of aluminium (% Al). In different embodiments, % Al is 0.06% by weight or higher, 0.26% by weight or higher, 0.41% by weight or higher, 0.62% by weight or higher, 0.91% by weight or higher, 1.26% by weight or higher, 1.56% by weight or higher and even 2.1% by weight or higher. In contrast, in some applications an excessively high content of % Al is rather detrimental. In different embodiments, % Al is less than 2.24% by weight, less than 1.98% by weight, less than 1.49% by weight, less than 0.98% by weight, less than 0.68% by weight and even less than 0.49% by weight. Obviously, there are cases where the desired nominal content is 0% by weight or nominal absence of the element as occurs with all optional elements for certain applications.

It has been found that for some applications the presence of manganese (% Mn) is desirable while yet for other applications it is rather an impurity. In different embodiments, % Mn is 0.08% by weight or higher, 0.12% by weight or higher, 0.23% by weight or higher, 0.44% by weight or higher, 0.71% by weight or higher, 1.2% by weight or higher, 1.64% by weight or higher and even 2.14% by weight or higher. In contrast, in some applications an excessively high content of % Mn is rather detrimental. In different embodiments, % Mn is less than 2.6% by weight, les than 2.1% by weight, less than 1.9% by weight, less than 1.6% by weight, less than 0.9% by weight, less than 0.4% by weight, less than 0.19% by weight and even less than 0.09% by weight. Obviously, there are cases where the desired nominal content is 0% by weight or nominal absence of the element as occurs with all optional elements for certain applications.

It has been found that for some applications the presence of molybdenum (% Mo) is desirable while yet for other applications should be limited. In different embodiments, % Mo is 0.1% by weight or higher, 0.6% by weight or higher, 1.12% by weight or higher, 1.4% by weight or higher, 1.62% by weight or higher, 1.7% by weight or higher, 1.9% by weight or higher, 2.1% by weight or higher, 2.4% by weight or higher, 2.6% by weight or higher, 3.62% by weight or higher 4.21% by weight or higher, 6.62% by weight or higher and even 8.1% by weight or higher. In contrast, in some applications an excessively high content of % Mo is rather detrimental. In different embodiments, % Mo is less 11.3% by weight, less than 10.4% by weight, less than 8.6% by weight, less than 7.4% by weight, less than 6.2% by weight, less than 4.9% by weight, less than 3.6% by weight, less than 2.8% by weight, less than 2.49% by weight, less than 1.9% by weight, less than 1.3% by weight and even less than 0.8% by weight. Obviously, there are cases where the desired nominal content is 0% by weight or nominal absence of the element as occurs with all optional elements for certain applications.

It has been found that in some applications the steels benefit from having a higher content of equivalent molybdenum (% $Mo_{eq}$, being % $Mo_{eq}$=% Mo+½*% W). In different embodiments, % $Mo_{eq}$ is 1.3% by weight or higher, 1.82% by weight or higher, 2.1% by weight or higher, 2.6% by weight or higher, 3.7% by weight or higher, 4.1% by weight or higher, 5.6% by weight or higher, and even 8.3% by weight or higher. In contrast, in some applications the presence of % $Mo_{eq}$ is rather detrimental. In different embodiments, % $Mo_{eq}$ is less than 14.8% by weight, less than 12.7% by weight, less than 10.4% by weight, less than 8.9% by weight, less than 6.43, by weight less than 4.76% by weight, less than 3.7% by weight, less than 2.6% by weight, less than 1.8% by weight, less than 1.4% by weight, less than 0.9% by weight, less than 0.7% by weight and even less than 0.4% by weight.

It has been found that for some applications the presence of tungsten (% W) is desirable while yet for other applications it is rather an impurity. In different embodiments, % W is 0.3% by weight or higher, 0.9% by weight or higher, 1.2% by weight or higher, 1.6% by weight or higher, 2.1% by weight or higher, 4.3% by weight or higher, 5.6% by weight or higher, 7.1% by weight or higher and even 8.6% by weight or higher. In contrast, in some applications an excessively high content of % W is rather detrimental. In different embodiments, % W is less than 12.2% by weight, less than 10.6% by weight, less than 8.6% by weight, less than 7.8% by weight, less than 6.9% by weight, less than 6.4% by weight, less than 4.8% by weight, less than 3.6% by weight, less than 2.9% by weight, less than 2.4% by weight, less than 1.2% by weight, less than 0.61% by weight and even less than 0.43% by weight. Obviously, there are cases where the desired nominal content is 0% by weight or nominal absence of the element as occurs with all optional elements for certain applications.

It has been found that in some applications the steels benefit from having a higher content of vanadium (% V). In different embodiments, % V is 0.1% by weight or higher, 0.52% by weight or higher, 1.12% by weight or higher, 2.56% by weight or higher, 3.51% by weight or higher and even 5.12% by weight or higher. In contrast, in some applications an excessively high content of % V is rather detrimental. In different embodiments, % V is less than 9.94% by weight, less than 6.43% by weight, less than 4.94% by weight, less than 3.48% by weight, less than 2.24% by weight, less than 1.9% by weight, less than 1.49% by weight and even less than 0.49% by weight. Obviously, there are cases where the desired nominal content is 0% by weight or nominal absence of the element as occurs with all optional elements for certain applications.

It has been found that in some applications the steels benefit from having a higher content of titanium (% Ti). In different embodiments, % Ti is 1.51% by weight or higher, 1.8% by weight or higher, 2.1% by weight or higher, 2.6% by weight or higher, 3.1% by weight or higher, 3.6% by weight or higher, 4.2% by weight or higher, 5.16% by weight or higher, 6.62% by weight or higher, 7.21% by weight or higher and even 8.16% by weight or higher. In contrast, in some applications the presence of % Ti is rather detrimental. In different embodiments, % Ti is less than 12.2% by weight, less than 9.6% by weight, less than 8.1% by weight, less than 7.2% by weight, less than 6.1% by weight and even less than 4.9% by weight. For some applications lower % Ti contents are preferred, in different embodiments, % Ti is less than 4.89% by weight, less than 4.6% by weight, less than 4.1% by weight, less than 3.6% by weight, less than 2.8% by weight, less than 2.39% by weight and even less than 1.9% by weight.

It has been found that for some applications the presence of zirconium (% Zr) is desirable while yet for other applications it is rather an impurity. In different embodiments, % Zr is 0.001% by weight or higher, 0.009% by weight or higher, 0.02% by weight or higher, 0.12% by weight or higher and even 0.16% by weight or higher. For some applications higher % Zr contents are preferred, in different embodiments, % Zr is 0.61% by weight or more, 1.16% by weight or more, 1.62% by weight or more, 2.18% by weight or more and even 2.64% by weight or more. In contrast, in some applications an excessively high content of % Zr is rather detrimental. In different embodiments, % Zr is less 3.4% by weight, less than 2.9% by weight, less than 2.2% by weight, less than 1.8% by weight, and even less than 1.4% by weight. For some applications lower % Zr contents are preferred, in different embodiments, % Zr is less than 0.92% by weight, less than 0.7% by weight, less than 0.42% by weight, less than 0.21% by weight, less than 0.12% by weight, less than 0.04% by weight and even less than 0.002% by weight. Obviously, there are cases where the desired nominal content is 0% by weight or nominal absence of the element as occurs with all optional elements for certain applications.

It has been found that for some applications the presence of cobalt (% Co) is desirable while yet for other applications it is rather an impurity. In different embodiments, % Co is 0.0002% by weight or higher, 0.01% by weight or higher, 0.11% by weight or higher, 0.21% by weight or higher, 1.1% by weight or higher, and even 2.1% by weight or higher. For some applications higher % Co contents are preferred, in different embodiments. % Co is 3.62% by weight or higher, 4.16% by weight or higher, 5.12% by weight or higher, 5.61% by weight or higher and even 6.62% by weight or higher. In contrast, in some applications an excessively high content of % Co is rather detrimental. In different embodiments, % Co is less than 11.4% by weight, less than 8.3% by weight, less than 7% by weight, less than 6.4% by weight, less than 4.9% by 50 weight, and even less than 3.8% by weight. For some applications lower % Co contents are preferred, in different embodiments, % Co is less than 2.6% by weight, less than 2.4% by weight, less than 1.1% by weight, less than 0.14% by weight and even less than 0.12% by weight. Obviously, there are cases where the desired nominal content is 0% by weight or nominal absence of the element as occurs with all optional elements for certain applications.

The inventor has found that the sum of % Al+% Ti+% Ta+% Zr+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 9.9% by weight or less, 7.4% by weight or less, 5.9% by weight or less, 5.4% by weight or less and even 2.9% by weight or less. In different embodiments, % Al+% Ti+% Ta+% Zr+% Hf+% V+% Nb+% Cu+% La+% Ce+% Nd+% Gd+% Sm+% Y+% Pr+% Sc+% Eu+% Pm is 1.64% by weight or more, 2.16% by weight or more, 2.64% by weight or more, 3.16% by weight or more, 4.62% by weight or more and even 6.63% by weight or more.

The inventor has found that the sum of % Al+% Ta+% Hf+% V+% Nb+% Cu+% La+% Ce+% Nd+% Gd+% Sm+% Y+% Pr+% Sc+% Eu+% Pm can be of importance for some applications, and different levels are desirable for different embodiments. In different embodiments, % Al+% Ta+% Hf+% V+% Nb+% Cu+% La+% Ce+% Nd+% Gd+% Sm+% Y+% Pr+% Sc+% Eu+% Pm is 1.9% by weight or less, 1.4% by weight or less, 0.9% by weight or less, 0.4% by weight or less, 0.2% by weight or less and even 0.09% by weight or less. In different embodiments, % Al+% Ta+% Hf+% V+% Nb+% Cu+% La+% Ce+% Nd+% Gd+% Sm+% Y+% Pr+% Sc+% Eu+% Pm is 0.002% by weight or more, 0.02% by weight or more, 0.12% by weight or more and even 0.21% by weight or more.

The inventor has found that for some applications certain element combinations are preferred. In different embodiments, % Ti>(% Mo+% Cr)/4, % Ti>(% Mo+% Cr)/5, % Ti>(% Mo+% Cr)/5.5. % Ti>(% Mo+% Cr)/6, % Ti>(% Mo+% Cr)/7, % Ti>(% Mo+% Cr)/8 and even % Ti>(% Mo+% Cr)/11.

The inventor has found that for some applications certain element combinations are preferred. In different embodiments, % Ti<(% Mo+% Cr+% V+% Si+% W)/7, % Ti<(% Mo+% Cr+% V+% Si+% W)/5, % Ti<(% Mo+% Cr+% V+% Si+% W)/4, % Ti<(% Mo+% Cr+% V+% Si+% W)/3, % Ti<(% Mo+% Cr+% V+% Si+% W)/2, % Ti<(% Mo+% Cr+% V+% Si+% W)/1 and even % Ti<(% Mo+% Cr+% V+% Si+% W)/0.5.

The inventor has found that for some applications certain element combinations are preferred. In different embodiments, % Ti+% V+% W+% Nb>4, % Ti+% V+% W+% Nb>6, % Ti+% V+% W+% Nb>7, % Ti+% V+% W+% Nb>8, % Ti+% V+% W+% Nb>10 and even % Ti+% V+% W+% Nb>11.

The inventor has found that for some applications certain element combinations are preferred. For some applications the following has to be true: % Ti/TCE<% Ceq<% Ti*TCI. In an embodiment, TCE is 4. In another embodiment, TCE is 6. In another embodiment, TCE is 8. In another embodiment, TCE is 10. In another embodiment, TCE is 11. In another embodiment, TCE is 12. In an embodiment, TCI is 0.5. In another embodiment, TCI is 1. In another embodiment, TCI is 3. In another embodiment, TO is 4. In another embodiment, TCI is 6. All the values disclosed in the different embodiments can be combined in any combination provided they are not mutually exclusive, for example: % Ti/10<% Ceq<% Ti*3.

The inventor has found that for some applications certain element combinations are preferred. In an embodiment, % Ti+% Mo+% Cr+% Nb>(% V+% W)/0.6. In another embodiment, % Ti+% Mo+% Cr+% Nb>(% V+% W)/0.8. In another embodiment, % Ti+% Mo+% Cr+% Nb>(% V+% W), % Ti+% Mo+% Cr+% Nb>(% V+% W)/1.2. In another embodiment, % Ti+% Mo+% Cr+% Nb>(% V+% W)/1.4. In another embodiment, % Ti+% Mo+% Cr+% Nb>(% V+% W)/1.6. In another embodiment, % Ti+% Mo+% Cr+% Nb>(% V+% W)/2.

In different embodiments, the sum of all elements other than % C, % B, % Cr, % Si, % Ni, % Mn, % Ti, % Mo, % W, % Nb and % V is less than 1.2% by weight, less than 0.8% by weight, less than 0.4% by weight, less than 0.2% by weight and even less than 0.09% by weight. In some applications a minimum content of such elements is. In different embodiments, the sum of all elements other than % C, % B, % Cr, % Si, % Ni, % Mn, % Ti, % Mo, % W, % Nb and % V is 0.001% by weight or more, 0.02% by weight or more and even 0.11% by weight or more.

In some applications, where wear resistance is important but simultaneously a high level of resilience or fracture toughness are also required, morphology of primary carbides can be of primordial importance. Also, many primary carbides tend to become larger the slower the cooling rate from the melting temperature, and thus are very small for powder metallurgical steels and very large for big cross sections of castings or conventionally melted and then forged blocks. This has often a strong influence in toughness related properties. To make matters worse in most alloyed tool steels segregation takes place during dendritic solidification, generally leading to enriched interdendritic liquid where the primary carbide precipitation usually takes place and thus primary carbides tend to form in those areas and are not uniformly distributed but rather aligned surrounding the dendrites. This leads again to strong reduction of toughness related properties. This is also one of the main reasons why primary carbide containing tool steels are normally forged or rolled to break those primary carbide alignments. The inventor has found that provided the right conditions, it is possible to have a uniform primary carbide distribution even in alloyed tool steels with dendritic solidification and interdendritic liquid enrichment. Moreover, it is possible to do so with carbides that have a preferable morphology and a sufficient degree of coherence to the matrix.

In some applications it has been found that sufficient but not excessive niobium content tends to control the shape and distribution of titanium-rich primary carbides. In different embodiments, % Nb is 0.05% by weight or larger, 0.11% by weight or larger, 0.21% by weight or larger and even 0.35% by weight or larger. In different embodiments, % Nb is 1.4% by weight or smaller, 0.9% by weight or smaller, 0.45% by weight or smaller, 0.19% by weight or smaller and even 0.09% by weight or smaller. In a set of embodiments, the niobium effect is only provided when chromium is present in the right amount. In an embodiment, % Cr>5*% Nb. In another embodiment, % Cr>10*% Nb. In another embodiment, % Cr>15*% Nb. In another embodiment, % Cr>20*% Nb. In an embodiment, % Cr<50*(% Nb+% Ti). In another embodiment, % Cr<30*(% Nb+% Ti). In another embodiment, % Cr<20*(% Nb+% Ti). In another embodiment, % Cr<10*(% Nb+% Ti). In another embodiment, % Cr<5*(% Nb+% Ti). In an embodiment, the aforementioned in this paragraph is specially reinforced when % Nb<% Ti/1.2. In another embodiment, the aforementioned in this paragraph is specially reinforced when % Nb<% Ti/1.5. In another embodiment, the aforementioned in this paragraph is specially reinforced when % Nb<% Ti/2. In another embodiment, the aforementioned in this paragraph is specially reinforced when % Nb<% Ti/2.5. In another embodiment, the aforementioned in this paragraph is specially reinforced when % Nb<% Ti/3.5.

In some applications it has been found that boron can be used to control the primary carbide morphology. In different embodiments, a % B of 0.01% by weight or more is used, 0.11% by weight or more, 0.51% by weight or more, 0.76% by weight or more and even 1.02% by weight or more is used. In some applications it has been found that the boron effect on the spherical microstructure of primary carbides is reinforced for powder metal. In an embodiment, the steel with the aforementioned boron additions is atomized to obtain steel powder. In different embodiments, the powder has a mean particle size (D50) of 512 microns or less, 212 microns or less and even 99 microns or less. In an embodiment, the powder is consolidated into a form or ingot. In an embodiment, the powder has a mean particle size (D50) of 55 microns or more. In an embodiment, the consolidation process involves powder forging in a can. In an embodiment, the consolidation process involves HIP. In an embodiment, D50, refers to a particle size at which 50% of the sample's volume is comprised of smaller particles in the cumulative distribution of particle size. In an embodiment, particle size is measured by laser diffraction according to ISO 13320-2009.

In some applications, it is important to be able to repair by welding, and some of those applications require high toughness in the repaired area. It has been found that for some of the steels of the present invention to be weldable with high resilience, the following has to be true: PTC1*(% Ti/%

Ceq)>% Cr>PMS1*(% Mn+% Si). In an embodiment, PTC1 is 50. In another embodiment, PTC1 is 30. In another embodiment, PTC1 is 20. In another embodiment, PTC1 is 15 and even in some embodiments, PTC1 is 10. In an embodiment, PMS1 is 1. In another embodiment, PMS1 is 2.3. In another embodiment, PMS1 is 3. In another embodiment, PMS1 is 3.5 and even in some embodiments, PMS1 is 5. In some embodiment, on top it has to be true that % Mo>% Ti. In some embodiments, on top it has to be true that % Mo>3*(% Ti+% Ceq). In some embodiments, it has to be true that 2.5*(% Mo+% Ti)>(% Cr−2*% Ceq).

The inventor has found that for some applications a certain relation between % B and % Ti content is preferred, and different levels are desirable for different applications. In different embodiments, % B>% Ti/3, % B>% Ti/4, % B>% Ti/4.5, % B>% Ti/5, % B>% Ti/5.5, % B>% Ti/6 and even % B>% Ti/10 is preferred.

The inventor has found that for some applications a certain relation between % B and % Ti content is preferred, and different levels are desirable for different applications. In different embodiments, 1.5*% Ti>% B, 2*% T/>% B, 0.7*% T>% B, 0.5*% Ti>% B, and even 0.4*% Ti>% B is preferred.

In an embodiment, the steel comprises primary carbides. In different embodiments, the steel comprises more than 2.1% primary carbides, more than 3.6% primary carbides, more than 5.2% primary carbides, more than 6.1% primary carbides, more than 8.2% primary carbides and even more than 11% primary carbides. In an embodiment, the above disclosed percentages of primary carbides are by volume. In an embodiment, the primary carbides comprises also primary borides, nitrides and mixtures thereof.

The inventor has found that for some applications, a steel wherein at least part of the primary carbides have a certain size is preferred. In an embodiment, at least part of the primary carbides refers to at least a 51% of all primary carbides. In another embodiment, at east part of the primary carbides refers to at least a 66% of all primary carbides. In another embodiment, at least part of the primary carbides refers to at least a 76% of all primary carbides. In another embodiment, at least part of the primary carbides refers to at least an 81% of all primary carbides. In another embodiment, at least part of the primary carbides refers to at least an 86% of all primary carbides. In another embodiment, at least part of the primary carbides refers to at least a 91% of all primary carbides and even in some embodiments, at least part of the primary carbides refers to refers to at least a a 96% of all primary carbides. In different embodiments, certain size refers to 49 microns of less, 39 microns or less, 29 microns or less, 19 microns or less, 14 microns or less, and even 9 microns or less. The above disclosed embodiments can be combined in any combination, for example a steel wherein at least an 81% of all primary carbides have a size of 19 microns or less or a steel wherein at least an 81% of all primary carbides have a size of 49 microns or less.

The inventor has found that for some applications a certain relation between % Ti, % Ceq and % $Mo_{eq}$ content is preferred, and different levels are desirable for different applications wherein the following has to be true: % Ti/FCT<% Ceq<FCD*% Ti+% $Mo_{eq}$. In an embodiment, FCT is 1.5. In another embodiment, FCT is 1.8. In another embodiment, FCT is 2. In another embodiment, FCT is 2.2. In another embodiment, FCT is 2.5. In another embodiment, FCT is 3. In an embodiment, FCD is 1.5. In another embodiment, FCD is 2. In another embodiment, FCD is 2.5. In another embodiment, FCD is 3. In another embodiment, FCD is 3.5. All the above disclosed embodiments can be combined in any combination provided they are not mutually exclusive, for example % Ti/2<% Ceq<2*Ti+% Moeq.

In an embodiment, the microstructure of the steel comprises martensite and/or tempered martensite. In an embodiment, the microstructure comprises more than 34% martensite and/or tempered martensite. In another embodiment, the microstructure comprises more than 46% martensite and/or tempered martensite. In another embodiment, the microstructure comprises more than 48% martensite and/or tempered martensite. In another embodiment, the microstructure comprises more than 56% martensite and/or tempered martensite. In another embodiment, the microstructure comprises more than 66% martensite and/or tempered martensite. In another embodiment, the microstructure comprises more than 78% martensite and/or tempered martensite and even in some embodiments, the microstructure comprises more than 86% martensite and/or tempered martensite. For some applications the maximum content should be limited. In an embodiment, the microstructure comprises less than 99% martensite and/or tempered martensite. In another embodiment, the microstructure comprises less than 84% martensite and/or tempered martensite. In another embodiment, the microstructure comprises less than 74% martensite and/or tempered martensite. In another embodiment, the microstructure comprises less than 54% martensite and/or tempered martensite and even in some embodiments, the microstructure comprises less than 49% martensite and/or tempered martensite. In an embodiment, the percentages of martensite and/or tempered martensite disclosed above are by volume. All the above disclosed embodiments can be combined in any combination provided they are not mutually exclusive, for example a microstructure comprising more than 58% and less than 99% by volume martensite and/or tempered martensite. In an embodiment, the microstructure of the steel further comprises retained austenite, ferrite, bainite and/or primary carbides.

All the upper and lower limits disclosed in the different embodiments can be combined in any combination provided they are not mutually exclusive.

A preferred embodiment of the extreme wear resistance tool steel disclosed in preceding paragraphs is an extreme wear resistance tool steel comprising more than 5.2% primary carbides, having the following composition, all percentages being in weight percentage (% wt):

| | | | |
|---|---|---|---|
| % Ceq = 1.26-4.68 | % C = 0.6-4.4 | % N = 0-2.9 | % B = 0-3.4 |
| % Cr = 0-11 | % Ni = 0-8 | % Si = 0-2.5 | % Mn = 0-3 |
| % Al = 0-2.5 | % Mo = 0-12 | % W = 0-14 | % Ti = 1.5-14 |
| % Ta = 0-3 | % Zr = 0-4 | % Hf = 0-3 | % V = 0-12 |
| % Nb = 0-9 | % Cu = 0-2 | % Co = 0-14 | % $Mo_{eq}$ = 0.5-16 |
| % La = 0-2 | % Ce = 0-2 | % Nd = 0-2 | % Gd = 0-2 |
| % Sm = 0-2 | % Y = 0-2 | % Pr = 0-2 | % Sc = 0-2 |
| % Pm = 0-2 | % Eu = 0-2 | % Tb = 0-2 | % Dy = 0-2 |
| % Ho = 0-2 | % Er = 0-2 | % Tm = 0-2 | % Yb = 0-2 |
| % Lu = 0-2 | | | |

the rest consisting of iron and trace elements, wherein

% Ceq=% C+0.86*% N+1.2*% B, and

% $Mo_{eq}$=% Mo+½*% W.

wherein % Ti>(% Mo+% Cr)/6.

Any embodiment disclosed in preceding paragraphs for the extreme wear resistance tool steel (including any lower and upper limit for the content of the components of the steel and/or their sum) can also be applied to this preferred embodiment, provided that they are not mutually exclusive.

Further embodiments can be found in the examples and in the claims. Any embodiment disclosed in this document can be combined with any other embodiment in any combination provided they are not mutually exclusive.

EXAMPLES

Example 1. Several Manufactured Steels are Shown in Table 1

TABLE 1

| Steel compositions (% wt). | | | | | | | | | | | | | |
|---|---|---|---|---|---|---|---|---|---|---|---|---|---|
| Material | % B | % C | % Cr | % Mo | % Mn | % Si | % Ti | % V | % Al | % Ni | % Zr | % Others | Hmax |
| 1.2379 | | 1.52 | 11.3 | 0.75 | 0.23 | 0.27 | | 0.76 | | | | | 61 |
| 2988LAB-1 | | 1.07 | 7.5 | 0.6 | 0.4 | 1.5 | 1 | | | | | | 60 |
| 2988LAB-2 | | | | | | | 2 | | 2 | 4.5 | 1.5 | | 51.7 |
| 2988LAB-3 | | | 12 | | | | 2 | | 2 | 4.5 | 1.5 | | 48 |
| 2989LAB-1 | 0.4 | 0.84 | 7.5 | 0.6 | 0.4 | 1.5 | 1 | | | | | | 54 |
| 2989LAB-2 | 0.4 | | | | | | 2 | | 2 | 4.5 | 1.5 | | 46 |
| 2989LAB-3 | 0.4 | | 12 | | | | 2 | | 2 | 4.5 | 1.5 | | 49 |
| 4904LAB-1 | | 1.09 | 7.5 | 0.6 | 0.4 | 1.5 | 1 | 0.65 | | | | | 58 |
| 4904LAB-2 | 0.4 | 0.9 | 7.5 | 0.6 | 0.4 | 1.5 | 1 | 0.65 | | | | | 58.5 |
| 4989LAB-1 | 0.4 | 0.91 | 7.5 | 0.6 | 0 | 0 | 1 | 0.65 | | | | | 52 |
| 4989LAB-2 | 0.4 | 0.9 | 7.5 | 0.6 | 2 | 0 | 1 | 0.65 | | | | | 52.5 |
| 4989LAB-3 | 0.4 | 0.41 | 5 | 0.6 | 0.4 | 1.5 | 1 | 0.65 | | | | | 54.5 |
| 4989LAB-4 | 0.4 | 0.91 | 7.5 | 0.6 | 0.4 | 1.5 | 1 | 0 | | | | | 54.5 |
| 4989LAB-5 | 0.4 | 0.88 | 7.5 | 0.6 | 0.4 | 1.5 | 2 | 0.65 | | | | | 53 |
| 4989LAB-6 | 0.4 | 0.93 | 7.5 | 0.6 | 0.4 | 1.5 | 0.8 | 0.65 | | | | | 55 |
| 5082LAB-1 | 0.1 | 0.96 | 7.5 | | | | 0.7 | | | | | | 56 |
| 5082LAB-2 | 0.2 | 1.13 | 8 | | 2 | 1 | 0.7 | | | | | 0.2Nb | 60 |
| 5082LAB-3 | 0.4 | 0.96 | 7.5 | | | | 0.7 | | | | | 0.4Nb | 52 |
| 5082LAB-4 | | 1.49 | 11.3 | 0.75 | 0.23 | 0.27 | | 0.76 | | | | | 62 |
| 5082LAB-5 | | 1.07 | 7.7 | 1.74 | 0.31 | 1.29 | | 2.44 | | | | 1.26W | 62 |
| 5082LAB-6 | | 1.49 | 11.3 | 0.75 | 0.23 | 0.27 | | 0.76 | | | | | 62.5 |
| 5082LAB-7 | | 1.11 | 7.7 | 1.74 | 0.31 | 1.29 | | 2.44 | | | | 1.26W | 62.5 |
| 5113LAB-1 | | 0.96 | 4.5 | 0.5 | 0.6 | 1 | | | | | | 0.4Nb | 60 |
| 5113LAB-2 | | 1.14 | 7.5 | 0.5 | 0.6 | 1 | | | | | | 0.4Nb | 62 |
| 5113LAB-3 | | 1.15 | 7.5 | 0.8 | 0.8 | 1.2 | | | | | | | 60 |
| 5113LAB-4 | 0.1 | 1.11 | 8 | | 2 | 1 | 0.7 | | | | | 0.07Nb | 59 |
| 5113LAB-5 | 0.1 | 1.15 | 8 | | 2 | 1 | 0.7 | | | | | 0.07Nb | 57.5 |
| 5113LAB-6 | | 1.18 | 7.5 | 0.5 | 0.6 | 1 | | | | | | 0.07Nb | 58 |
| 5130LAB-1 | 0.18 | 1.11 | 8 | | 2 | 1 | 0.7 | | | | | 0.2Nb | 55 |
| 5130LAB-2 | 0.18 | 1.16 | 8 | | 0 | 1 | 0.7 | | | | | 0.2Nb | 54 |
| 5130LAB-3 | 0.18 | 1.15 | 8 | | 2 | 0 | 0.7 | | | | | 0.2Nb | 52 |
| 5130LAB-4 | 0.18 | 1.16 | 4 | | 2 | 1 | 0.7 | | | | | 0.2Nb | 54 |
| 5130LAB-5 | 0.18 | 1.14 | 6 | | 2 | 1 | 0.7 | | | | | 0.2Nb | 56 |
| 5130LAB-6 | 0.18 | 1.11 | 8 | | 2 | 1 | 0.7 | | | | | 0.1Nb | 56 |
| 5205LAB-1 | | 0.69 | 5 | 1.5 | 0.65 | 0.25 | 0.4 | | | | | | 58 |
| 5205LAB-2 | 0.1 | 0.86 | 8 | 1.8 | 0.6 | 1 | 0.7 | | | | | | 60.5 |
| 5205LAB-3 | 0.004 | 0.86 | 5 | 2.4 | 0.5 | 0.2 | 0.7 | | | | | | 60 |
| 5205LAB-4 | 0.012 | 0.7 | 5 | 1.5 | 0.65 | 0.25 | 0.4 | | | | | | 58 |
| 5205LAB-5 | 0.03 | 0.83 | 8 | 1.8 | 0.6 | 1 | 0.7 | | | | | | 61.5 |
| 5205LAB-6 | 0.03 | 0.86 | 5 | 2.4 | 0.5 | 0.2 | 0.7 | | | | | | 59 |
| 5205LAB-7 | 0.004 | 0.71 | 5 | 1.5 | 0.65 | 0.25 | 0.4 | | | | | | 59.5 |
| 5205LAB-8 | 0.004 | 0.85 | 8 | 1.8 | 0.6 | 1 | 0.7 | | | | | | 62 |
| 5205LAB-9 | | 0.86 | 5 | 2.4 | 0.5 | 0.2 | 0.7 | | | | | | 60 |
| 5205LA8-10 | 0.1 | 0.71 | 5 | 1.5 | 0.65 | 0.25 | 0.4 | | | | | | 55 |
| 5205LAB-11 | | 0.83 | 8 | 1.8 | 0.6 | 1 | 0.7 | | | | | | 59.5 |
| 5205LAB-12 | 0.1 | 0.88 | 5 | 2.4 | 0.5 | 0.2 | 0.7 | | | | | | 56 |
| 5245LAB-1 | | 0.77 | 5 | 1.5 | 0.65 | 1 | 0.4 | | | | | | 61 |
| 5245LAB-2 | | 0.85 | 8 | 1.8 | 0.6 | 1 | 0.7 | | | | | 0.2Nb | 62 |
| 5245LAB-3 | | 0.86 | 5 | 2 | 0.5 | 0.2 | 0.7 | | | | | 0.07Nb | 60 |

Balance: iron and trace elements.

Example 2. Several Manufactured Steels are Shown in Table 2

TABLE 2

| Steel compositions(% wt). | | | | | | | | |
|---|---|---|---|---|---|---|---|---|
| Material | % B | % C | % Mo | % Mn | % Ni | % Zr | % Others | Hmax |
| 5246LAB-4 | 0.006 | 0.24 | 1.8 | 0.08 | 0 | 0.08 | | 410HB |
| 5246LAB-3 | 0.06 | 0.24 | 1.8 | 0 | 0 | 0.08 | | 473HB |
| 5246LAB-2 | 0.004 | 0.24 | 1.7 | 0 | 0.53 | | | 459HB |
| 5246LAB-1 | 0.004 | 0.24 | 1.5 | 0.78 | 0 | | | 399HB |
| 5188LAB-3 | 0.003 | 0.25 | 1.5 | 0.3 | 0.43 | | | 433HB |
| 5188LAB-2 | 0.004 | 0.3 | 1.2 | 0 | 0.53 | | | 388HB |

TABLE 2-continued

| Steel compositions(% wt). | | | | | | | | |
|---|---|---|---|---|---|---|---|---|
| Material | % B | % C | % Mo | % Mn | % Ni | % Zr | % Others | Hmax |
| 5188LAB-1 | 0.004 | 0.24 | 1.5 | 0.85 | 0 | | | 432HB |
| 5037LAB-6 | 0.004 | 0.254 | 1 | 0.75 | 0 | | | 357HB |
| 5037LAB-5 | 0.004 | 0.25 | 1 | 0.75 | 0 | | | 377HB |
| 5037LAB-4 | 0.004 | 0.235 | 1.5 | 0 | 0.43 | | | 389HB |
| 5037LAB-3 | 0.004 | 0.235 | 1.5 | 0 | 0.43 | | | 340HB |
| 5037LAB-2 | 0.004 | 0.21 | 1.5 | 0.75 | 0 | | | 340HB |
| 5037LAB-1 | 0.004 | 0.21 | 1.5 | 0.75 | 0 | | | 367HB |
| 4825LAB-9 | 0.004 | 0.18 | 0.65 | 0.2 | 0.35 | | | 308HB |
| 4825LAB-8 | 0.004 | 0.24 | 1.5 | 0.3 | 0.35 | | | 370HB |
| 4825LAB-7 | 0.004 | 0.18 | 1 | 0.3 | 0.35 | | | 357HB |
| 4825LAB-6 | 0.004 | 0.19 | 1.5 | 0.5 | 0 | | | 352HB |
| 4825LAB-5 | 0.004 | 0.18 | 1 | 0.5 | 0 | | | 333HB |
| 4825LAB-4 | 0.004 | 0.21 | 0.65 | 0.75 | 0 | | | 325HB |
| 4825LAB-3 | 0.004 | 0.22 | 0.8 | 0.75 | 0 | | | 343HB |
| 4825LAB-2 | 0.004 | 0.22 | 1 | 0.45 | 0 | | | 349HB |
| 4825LAB-17 | 0.004 | 0.215 | 1.5 | 0.75 | 0 | | | 301HB |
| 4825LA8-16 | 0.004 | 0.23 | 1 | 0.75 | 0 | | | 349HB |
| 4825LAB-15 | 0.004 | 0.18 | 1 | 0.75 | 0 | | | 367HB |
| 4825LAB-14 | 0.004 | 0.2 | 1.5 | | 0.35 | | | 293HB |
| 4825LA8-13 | 0.004 | 0.17 | 1 | 0 | 0.35 | | | 336HB |
| 4825LAB-12 | 0.004 | 0.2 | 1.5 | 0.75 | 0 | | | 303HB |
| 4825LAB-11 | 0.004 | 0.24 | 1 | 0.75 | 0 | | | 367HB |
| 4825LAB-10 | 0.004 | 0.18 | 1 | 0.75 | 0 | | | 367HB |
| 4825LAB-1 | 0.004 | 0.21 | 1 | 0.65 | 0 | | | 367HB |
| 4691LAB-9 | 0.004 | 0.24 | 2 | 0 | 0.35 | | | 37HRc |
| 4691LAB-8 | 0.004 | 0.2 | 1.5 | 0.75 | 0 | | | 35HRc |
| 4691LAB-7 | 0.004 | 0.23 | 1 | 0.75 | 0 | | | 32.5HRc |
| 4891LAB-6 | 0.004 | 0.19 | 1 | 0.75 | 0 | | | 28HRc |
| 4691 LAB-5 | 0.004 | 0.24 | 1.5 | 0.75 | 0 | | | 31HRc |
| 4691LAB-4 | 0.004 | 0.24 | 1.5 | 0 | 0.35 | | | 33.5HRc |
| 4691LAB-3 | 0.004 | 0.2 | 1.5 | 0 | 0.35 | | | 32HRc |
| 4691LAB-2 | 0.004 | 0.24 | 1 | 0 | 0.35 | | | 31HRc |
| 4691LAB-10 | 0.004 | 0.24 | 2 | 0.75 | 0 | | | 36HRc |
| 4691LAB-1 | 0.004 | 0.18 | 1 | 0 | 0.35 | | | 238HB |
| 4628LAB-9 | 0.004 | 0.25 | 2.3 | 0.65 | 0 | 0.05 | | 38HRc |
| 4628LAB-8 | 0.004 | 0.245 | 2.8 | 0.85 | 0 | 0.15 | | 40HRc |
| 4628LAB-7 | 0.004 | 0.26 | 2.8 | 0 | 0 | 0.07 | Co = 3.0 | 41.5HRc |
| 4828LAB-6 | 0.004 | 0.255 | 2.8 | 0.85 | 0 | | | 37HRc |
| 4628LAB-5 | 0.004 | 0.235 | 2.2 | 0.85 | 0 | | | 38HRc |
| 4628LAB-4 | 0.004 | 0.24 | 2.2 | 0 | 0.35 | | | 38HRc |
| 4628LAB-3 | 0.004 | 0.24 | 2.2 | 0 | 0 | | | 36.5HRc |
| 4628LAB-2 | 0.004 | 0.25 | 2.2 | 0 | 0 | 0.12 | | 37HRc |
| 4828LAB-1 | 0.006 | 0.25 | 2.2 | 0 | 0 | 0.12 | | 38HRc |
| 2987LAB-3 | 0.006 | 0.26 | 2.8 | 0.8 | 0.35 | | V = 0.10 | 44HRc |
| 2987LAB-2 | 0.006 | 0.26 | 2 | 0.8 | 0.35 | | V = 0.10 | 37HRc |
| 2987LAB-1 | 0.006 | 0.25 | 1.8 | 0.8 | 0.35 | | V = 0.10 | 38.5HRC |
| 1707LAB-7 | 0.006 | 0.23 | 2 | 0 | 0.4 | 0.08 | | 328HB |
| 1707LAB-6 | 0.006 | 0.26 | 2.8 | 0 | 0 | 0.08 | | 328HB |
| 1707LAB-5 | 0.006 | 0.23 | 2 | 0 | 0.4 | 0.08 | Nb = 0.05; Ce = 0.03 | 318HB |
| 1179LAB-4 | 0.06 | 0.23 | 1.8 | 0 | 0 | 0.1 | | 370HB |
| 1179LAB-3 | 0.06 | 0.27 | 3.3 | 0 | 0 | 0.2 | | 328HB |
| 1179LAB-2 | 0.06 | 0.26 | 2.8 | 0 | 0 | 0.18 | | 370HB |
| 1179LAB-1 | 0.06 | 0.23 | 2.2 | 0 | 0 | 0.12 | | 359HB |

Balance: iron and trace elements.

Example 3. Several Manufactured Steels are Shown in Table 3

TABLE 3

| Steel compositions(% wt). | | | | | | | |
|---|---|---|---|---|---|---|---|
| Material | B | C | Mo | Mn | Ni | Zr | Others |
| Material -1 | 0.004 | 0.24 | 1 | 0 | 0.4 | 0 | Ti = 0.018 |
| Material -2 | 0.004 | 0.3 | 1 | 0 | 0.4 | 0.02 | Ti = 0.02 |
| Material -3 | 0.004 | 0.34 | 1 | 0 | 0.4 | 0 | Ti = 0.018 |
| Material -4 | 0.004 | 0.24 | 1 | 0.7 | 0 | 0.02 | Ti = 0.02 |
| Material -5 | 0.004 | 0.3 | 1.5 | 0 | 0.4 | 0 | Ti = 0.018 |
| Material -6 | 0.004 | 0.34 | 1.5 | 0 | 0.4 | 0 | |
| Material -7 | 0.004 | 0.3 | 0 | 0.8 | 0 | 0 | Ti = 0.018 |

TABLE 3-continued

| Steel compositions(% wt). | | | | | | | |
|---|---|---|---|---|---|---|---|
| Material | B | C | Mo | Mn | Ni | Zr | Others |
| Material -8 | 0.004 | 0.3 | 0 | 0.8 | 0 | 0.03 | |
| Material -9 | 0.004 | 0.3 | 0 | 0 | 0.35 | 0.03 | |

Balance: iron and trace elements.

Any embodiment disclosed in this document can be combined with any other embodiment, provided that they are not mutually exclusive.

The invention claimed is:

1. A steel, which is a cold work tool steel comprising primary carbides, having the following composition, all percentages being in % wt:

| | | | |
|---|---|---|---|
| % $C_{eq}$ = 0.51-1.49 | % C = 0.51-1.49 | % N = 0-0.49 | % B = 0-0.49 |
| % Cr = 2.1-14 | % Ni = 0-4.9 | % Si = 0.01-1.9 | % Al = 0-0.9 |
| % Mn = 0.01-2.8 | % Ti = 0.12-4.9 | % Mo = 0-3.9 | % W = 0-4.9 |
| % $Mo_{eq}$ = 0.26-3.9 | % Ta = 0-0.4 | % Zr = 0-0.9 | % Hf = 0-0.3 |
| % V = 0-1.4 | % Nb = 0-1.4 | % Cu = 0-1.9 | % Co = 0-2.9 |
| % La = 0-0.3 | % Ce = 0-0.3 | % Nd = 0-0.3 | % Gd = 0-0.3 |
| % Sm = 0-0.3 | % Y = 0-0.3 | % Pr = 0-0.3 | % Sc = 0-0.2 |
| % Pm = 0-0.3 | % Eu = 0-0.3 | | |

the rest consisting of iron and trace elements, wherein

% Ceq=% C+0.86*% N+1.2*% B, and

% $Mo_{eq}$=% Mo+½*% W, wherein the microstructure comprises more than 56% martensite and/or tempered martensite, and wherein at least 81% of all primary carbides have a size of 49 microns or less.

2. The steel according to claim 1, which is a cold work tool steel comprising primary carbides, having the following composition, all percentages being in % wt:

| | | | |
|---|---|---|---|
| % Ceq = 0.61-0.98 | % C = 0.61-0.98 | % N = 0-0.19 | % B = 0-0.09 |
| % Cr = 3.6-9.9 | % Ni = 0-0.9 | % Si = 0.1-1.4 | % A1 = 0-0.2 |
| % Mn = 0.3-1.4 | % Ti = 0.32-1.4 | % Mo = 1.1-2.8 | % W = 0-1.9 |
| % Moeq = 1.1-2.9 | % Ta = 0-0.2 | % Zr = 0-0.4 | % Hf = 0-0.2 |
| % V = 0-1.4 | % Nb = 0-0.6 | % Cu = 0-0.49 | % Co = 0-0.3 |
| % La = 0-0.1 | % Ce = 0-0.1 | % Nd = 0-0.1 | % Gd = 0-0.1 |
| % Sm = 0-0.1 | % Y = 0-0.1 | % Pr = 0-0.1 | % Sc = 0-0.1 |
| % Pm = 0-0.1 | % Eu = 0-0.1 | | |

the rest consisting of iron and trace elements, wherein

% Ceq=% C+0.86*% N+1.2*% B, and

% Moeq=% Mo+½*% W, wherein the microstructure comprises more than 56% and less than 99% martensite and/or tempered martensite.

3. The steel according to claim 1, wherein % Mn+% Si=0.04-3.9.

4. The steel according to claim 1, wherein

% Ti+% V+% W+% Nb>8, and

% Ti/10<% Ceq<% Ti*3, and

% Ti+% Mo+% Cr+% Nb> (% V+% W)/1.2.

5. The steel, according to claim 1 wherein % Ti/2<% Ceq<2*Ti+% Moeq.

6. The steel according to claim 1, wherein % B>% Ti/5 and at least 81% of all primary carbides have a size of 19 microns or less.

7. The steel according to claim 1, wherein the sum of all elements other than % C, % B, % Cr, % Si, % Ni, % Mn, % Ti, % Mo, % W, % Nb and % V is less than 0.4% by weight.

8. The steel according to claim 1, wherein % B is higher than 0.0001% by weight and no more than 0.49% by weight.

9. The steel according to claim 1, wherein % B is higher than 0.0011% by weight and no more than 0.49% by weight.

10. The steel according to claim 1, wherein % B is lower than 0.035% by weight.

11. The steel according to claim 1, wherein the sum of all trace elements is less than 0.4% by weight.

12. The steel according to claim 1, wherein any trace element is less than 0.09% by weight.

13. The steel according to claim 1, wherein the microstructure comprises more than 56% and less than 99% martensite or tempered martensite.

14. The steel according to claim 1, wherein % Ti/FCT<% Ceq<FCD*% Ti+% $Mo_{eq}$, being FCT=3 and FCD=3.5.

15. The steel according to claim 1, wherein % Ti>(% Mo+% Cr)/4.

16. The steel according to claim 1, wherein % Cr<20 (% Nb+% Ti).

17. The steel according to claim 1, wherein primary carbides are more than 2.1 vol %.

* * * * *